US006103458A

United States Patent [19]

Seki

[11] Patent Number: 6,103,458

[45] **Date of Patent: *Aug. 15, 2000**

[54] METHOD FOR PROCESSING A SILVER HALIDE COLOR PHOTOGRAPHIC LIGHT-SENSITIVE MATERIAL

[75] Inventor: Hiroyuki Seki, Minami-ashigara, Japan

[73] Assignee: Fuji Photo Film Co., Ltd., Kanagawa-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/903,701

[22] Filed: Jul. 31, 1997

[30] Foreign Application Priority Data

Aug. 2, 1996 [JP] Japan ..... 8-220572

[51] Int. Cl.[7] ..... G03C 7/42

[52] U.S. Cl. ..... 430/393; 430/380; 430/448; 430/460

[58] Field of Search ..... 430/380, 393, 430/435, 460, 448, 566

[56] References Cited

U.S. PATENT DOCUMENTS

| | | | |
|---|---|---|---|
| 803,783 | 11/1905 | Pfeifer et al. | 182/166 |
| 2,424,256 | 7/1947 | Schmidt et al. | 430/376 |

(List continued on next page.)

FOREIGN PATENT DOCUMENTS

| | | |
|---|---|---|
| 0545491A1 | 6/1993 | European Pat. Off. . |
| 0565165A1 | 10/1993 | European Pat. Off. . |

(List continued on next page.)

OTHER PUBLICATIONS

Database Crossfire Beilstein Informationssysteme GmbH, Frankfurt DE, BRN=3446337, XP002003474.

(List continued on next page.)

*Primary Examiner*—Hoa Van Le

*Attorney, Agent, or Firm*—Birch, Stewart, Kolasch & Birch, LLP

[57] ABSTRACT

There is disclosed a method for processing a silver halide color photographic light-sensitive material, which comprises processing a silver halide color photographic light-sensitive material that contains a color-forming reducing agent, with an alkaline solution that is substantially free from any color-developing agent, and then processing the light-sensitive material with a bleach-fix solution that contains a ferric complex salt of a compound represented by formula (I) or (II):

formula (I)

formula (II)

wherein, in formula (I), $R_1$ represents a hydrogen atom, or an aliphatic hydrocarbon, aryl, or heterocyclic group; $L_1$ and $L_2$ each represent an alkylene group; and $M_1$ and $M_2$ each represent a hydrogen atom or a cation; and wherein, in formula (II), $R_{21}$, $R_{22}$, $R_{23}$, and $R_{24}$ each represent a hydrogen atom, or an aliphatic hydrocarbon, aryl, heterocyclic, hydroxyl, or carboxyl group; t and u are each 0 or 1; W represents a divalent carbon-containing linking group; and $M_{21}$, $M_{22}$, $M_{23}$, and $M_{24}$ each represent a hydrogen atom or a cation. According to the processing method, by the use of a material excellent in environmental preservation, the light-sensitive material after the processing in a processing step that was excellent in handleability was less in stain, and also the processing method is excellent in image stability in the processed light-sensitive material.

18 Claims, 1 Drawing Sheet

U.S. PATENT DOCUMENTS

| | | | |
|---|---|---|---|
| 3,285,957 | 11/1966 | Baker et al. | 564/34 |
| 3,342,597 | 9/1967 | Harnish et al. | 430/376 |
| 3,719,492 | 3/1973 | Barr et al. | 430/376 |
| 3,782,949 | 1/1974 | Olivares et al. | 430/17 |
| 4,060,418 | 11/1977 | Waxman et al. | 430/212 |
| 4,481,268 | 11/1984 | Bailey et al. | 430/17 |
| 4,684,604 | 8/1987 | Harder | 430/375 |
| 4,740,453 | 4/1988 | Nakamura et al. | 430/505 |
| 4,978,602 | 12/1990 | Fujita et al. | 430/264 |
| 5,030,546 | 7/1991 | Takamuki et al. | 430/264 |
| 5,147,764 | 9/1992 | Bowne | 430/372 |
| 5,230,983 | 7/1993 | Inoue et al. | 430/264 |
| 5,262,274 | 11/1993 | Katoh | 430/264 |
| 5,273,859 | 12/1993 | Katoh et al. | 430/264 |
| 5,278,025 | 1/1994 | Okamura et al. | 430/264 |
| 5,279,920 | 1/1994 | Onodera et al. | 430/264 |
| 5,286,598 | 2/1994 | Inoue et al. | 430/264 |
| 5,298,370 | 3/1994 | Kojima et al. | 430/393 |
| 5,338,649 | 8/1994 | Inaba et al. | 430/430 |
| 5,385,816 | 1/1995 | Stanley et al. | 430/544 |
| 5,415,981 | 5/1995 | Clarke et al. | 430/384 |
| 5,416,218 | 5/1995 | Chan et al. | 548/338.1 |
| 5,424,170 | 6/1995 | Sudo et al. | 430/264 |
| 5,441,847 | 8/1995 | Fukawa et al. | 430/264 |
| 5,447,835 | 9/1995 | Sakai et al. | 430/598 |
| 5,627,015 | 5/1997 | Okada et al. | 430/393 |
| 5,629,140 | 5/1997 | Harder et al. | 430/489 |
| 5,667,945 | 9/1997 | Takeuchi et al. | 430/380 |
| 5,683,853 | 11/1997 | Makuta et al. | 430/264 |
| 5,693,450 | 12/1997 | Makuta et al. | 430/264 |

FOREIGN PATENT DOCUMENTS

| | | |
|---|---|---|
| 0567126 | 10/1993 | European Pat. Off. . |
| 0593110A1 | 4/1994 | European Pat. Off. . |
| 1159758 | 12/1963 | Germany . |
| 57-76543 | 5/1982 | Japan . |
| 58-14671 | 3/1983 | Japan . |
| 58-14672 | 3/1983 | Japan . |
| 59-81643 | 5/1984 | Japan . |
| 1-201650 | 8/1989 | Japan . |
| 4-313752 | 11/1992 | Japan . |
| 5-265159 | 10/1993 | Japan . |
| 6-59422 | 3/1994 | Japan . |
| 6-161065 | 6/1994 | Japan . |
| 7325358 | 12/1995 | Japan . |
| 803783 | 10/1958 | United Kingdom . |
| 1069061 | 5/1967 | United Kingdom . |

OTHER PUBLICATIONS

Chemische Berichte, vol. 54, 1921, Weinheim, DE, pp. 660–669, XPOO2003472, W. Borsche, "Uber Cyan–nitro–phenylhydrazine", pp. 662,665.

Journal of the Chemical Society, Hegarty et al., Hydrolysis of Azoester . . . , 1980, pp. 1238–1243.

METHOD FOR PROCESSING A SILVER HALIDE COLOR PHOTOGRAPHIC LIGHT-SENSITIVE MATERIAL

FIELD OF THE INVENTION

The present invention relates to a method for processing a silver halide color photographic light-sensitive material (hereinafter sometimes referred to simply as a light-sensitive material or a photographic material). More particularly, the present invention relates to a method for processing a silver halide color photographic light-sensitive material, which contains a color-forming reducing agent, with a bleach-fix solution after processing with an alkaline solution that is substantially free from any color-developing agent.

BACKGROUND OF THE INVENTION

In general, fundamentals for the photographic process of a silver halide color photographic light-sensitive material consist of a color development step and a desilvering step. In the desilvering step, the developed silver produced in the color development step is oxidized, to become a silver salt, by the action of an oxidant (a so-called bleaching agent), and further, the silver salt is dissolved and removed from the light-sensitive material, by an agent capable of dissolving a silver ion (a so-called fixing agent).

As the bleaching agent used in the above desilvering step, iron(III) complex salts of organic acids, and particularly iron(III) complex salt of ethylenediamine-N,N,N',N'-tetraacetic acid (hereinafter abbreviated as EDTA), have long been used, and, in view of rapid processing and the reduction of waste liquor components of processing solutions, iron(III) complex salt of 1,3-propanediamine-N,N,N',N'-tetraacetic acid (hereinafter abbreviated as 1,3-PDTA) is also widely used.

However, under the recent increase in consciousness toward earth environmental preservation, strong attention is being given to the discharge of the above chelating agents, which are low in biodegradability in nature and tend to solubilize harmful heavy metal ions, the development of substitutes for them is desired. Some chelating agents having good biodegradability are described, for example, in JP-A-4-313752 ("JP-A" means unexamined published Japanese patent application), 5-265159, and 6-161065.

On the other hand, with the propagation of small-scale store processing laboratories (photofinishers), which are called mini-labs, processing in the shortest possible period by using automatic processors that are as small as possible is demanded continuously and strongly. In this regard, it is rather advantageous to carry out the desilvering step by using a processing solution in which a bleaching agent, for oxidizing silver, and a fixing agent, for solubilizing silver ions, coexist in the same bath, that is, using a bleach-fix solution.

However, when processing is carried out continuously for a long period of time by using a bleach-fix solution in which, as a bleaching agent, an iron(III) complex salt of a chelating agent excellent in biodegradability, is used, it is observed that dirt (stain) is apt to adhere to the processed light-sensitive material also, the image part of the light-sensitive material, with time after being processed, is apt to be easily discolored with, for example, a stain.

SUMMARY OF THE INVENTION

An object of the present invention is to provide a method for processing a silver halide color photographic light-sensitive material, which is excellent in view of environmental preservation, and in the method, in a processing step that provides great merit to users, stain hardly occurs and the stability to aging after processing of the light-sensitive material is excellent.

Other and further objects, features, and advantages of the invention will appear more fully from the following description, taken in connection with the accompanying drawings.

DETAILED DESCRIPTION OF THE INVENTION

Figure 1:
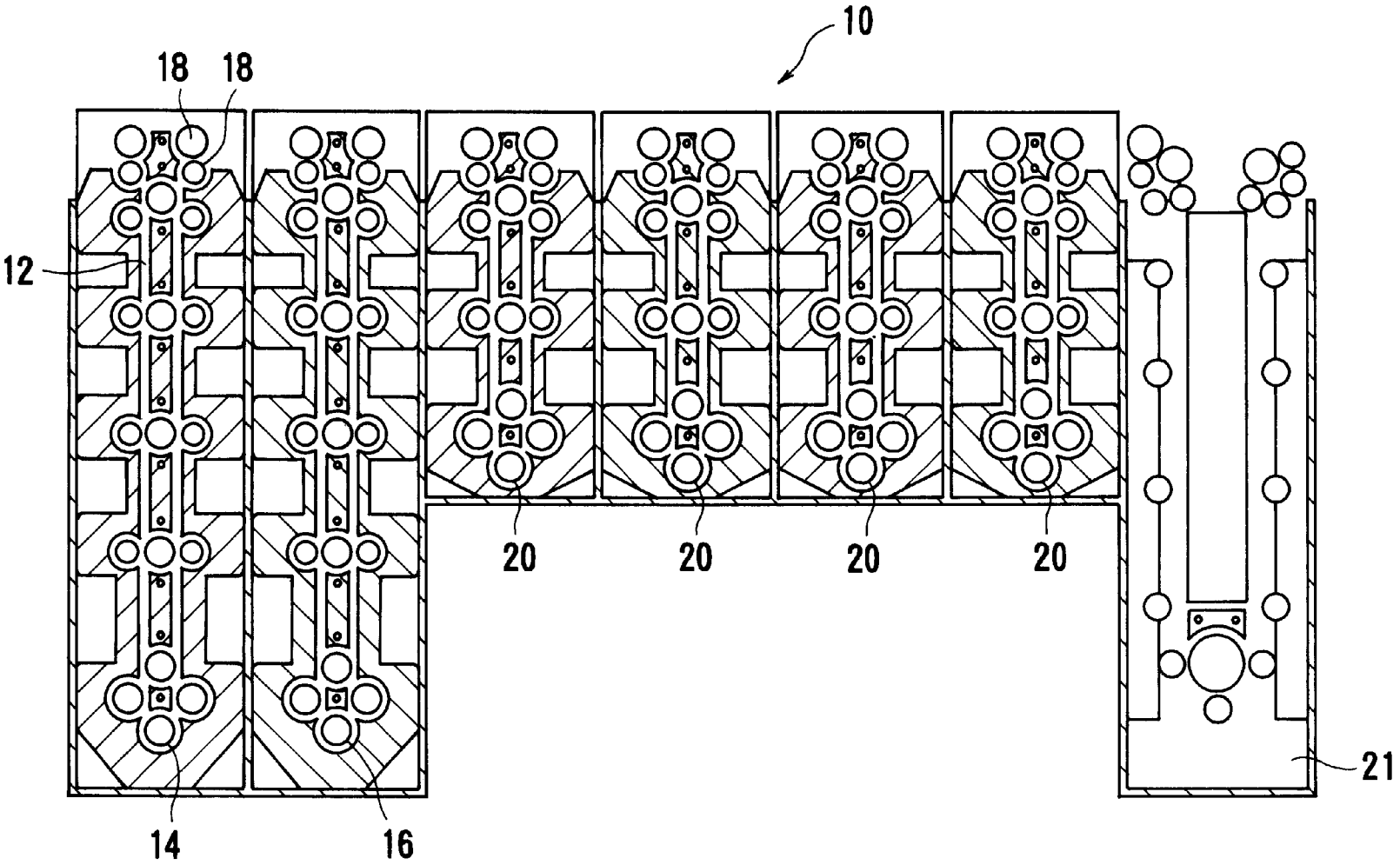
FIG. 1 is a schematic cross section showing a light-sensitive material processor preferable for use with the processing method of the present invention, which processor is equipped with a developing tank (or activator tank), a bleach-fix tank, and four rinsing tanks, having a slit-like processing path.

The present inventor, having studied how to attain the above object in various ways, has attained the object by providing the following processing method:

(1) A method for processing a silver halide color photographic light-sensitive material, comprising processing a silver halide color photographic light-sensitive material that contains a color-forming reducing agent, with an alkaline solution that is substantially free from any color-developing agent, and then processing said silver halide color photographic light-sensitive material with a bleach-fix solution containing at least one selected from the group consisting of ferric complex salts of a monoamine compound represented by the following formula (I) and ferric complex salts of a compound represented by the following formula (II):

formula (I)

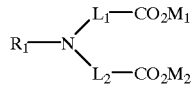

wherein $R_1$ represents a hydrogen atom, an aliphatic hydrocarbon group, an aryl group, or a heterocyclic group; $L_1$ and $L_2$ each represent an alkylene group; and $M_1$ and $M_2$ each represent a hydrogen atom or a cation;

formula (II)

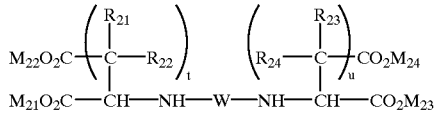

wherein $R_{21}$, $R_{22}$, $R_{23}$, and $R_{24}$ each represent a hydrogen atom, an aliphatic hydrocarbon group, an aryl group, a heterocyclic group, a hydroxyl group, or a carboxyl group; t and u are each 0 or 1; W represents a divalent carbon-containing linking group; and $M_{21}$, $M_{22}$, $M_{23}$, and $M_{24}$ each represent a hydrogen atom or a cation.

(2) The method for processing a silver halide color photographic light-sensitive material as stated in the above (1), wherein said bleach-fix solution contains at least one selected from compounds represented by one of the following formulae (A) to (E):

formula (A)

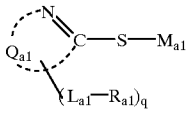

wherein $Q_{a1}$ represents a group of non-metal atoms required to form a 5- or 6-membered heterocycle, which may be condensed to a carboaromatic ring or a heteroaromatic ring; $L_{a1}$ represents a single bond, a divalent aliphatic group, a divalent aromatic hydrocarbon group, a divalent heterocyclic group, or a linking group formed by these groups in combination; $R_{a1}$ represents a carboxylic acid or its salt, a sulfonic acid or its salt, a phosphonic acid or its salt, an amino group, or an ammonium salt; q is an integer of 1 to 3, and $M_{a1}$ represents a hydrogen atom or a cation;

formula (B)

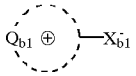

wherein $Q_{b1}$ represents a 5- or 6-membered meso-ionic ring composed of carbon atoms, nitrogen atoms, oxygen atoms, sulfur atoms, or selenium atoms; and $X_{b1}^-$ represents $—O^-$, $—S^-$, or $—N^-R_{b1}$, in which $R_{b1}$ represents an aliphatic group, an aromatic hydrocarbon group, or a heterocyclic group;

formula (C)

$$L_{C1}—(A_{C1}—L_{C2})_r—A_{C2}—L_{C3}$$

wherein $L_{C1}$ and $L_{C3}$, which are the same or or different, each represent an aliphatic group, an aromatic hydrocarbon group, or a heterocyclic group; $L_{C2}$ represents a divalent aliphatic group, a divalent aromatic hydrocarbon group, a divalent heterocyclic linking group, or a linking group formed by these in combination; $A_{C1}$ and $A_{C2}$ each represent —S—, —O—, $—NR_{C20}—$, —CO—, $—SO_2—$, or a group formed by these in combination; and r is an integer of 1 to 10, with the proviso that at least one of $L_{C1}$ and $L_{C3}$ is substituted by $—SO_3M_{C1}$, $—PO_3M_{C2}M_{C3}$, $—NR_{C1}(R_{C2})$, $—N^+R_{C3}(R_{C4})(R_{C5}).X_{C1}^-$, $—SO_2NR_{C6}(R_{C7})$, $—NR_{C8}SO_2R_{C9}$, $—CONR_{C10}(R_{C11})$, $—NR_{C12}COR_{C13}$, $—SO_2R_{14}$, $—PO(—NR_{C15}(R_{C16}))_2$, $—NR_{C17}CONR_{C18}(R_{C19})$, $—COOM_{C4}$, or a heterocyclic group, in which $M_{C1}$, $M_{C2}$, $M_{C3}$, and $M_{C4}$, which are the same or different, each represent a hydrogen atom or a counter cation, $R_{C1}$ to $R_{C20}$, which are the same or different, each represent a hydrogen atom, an aliphatic group, or an aromatic hydrocarbon group, and $X_{C1}^-$ represents a counter anion, and with the proviso that at least one of $A_{C1}$ and $A_{C2}$ represents —S—;

formula (D)

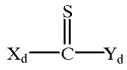

wherein $X_d$ and $Y_d$ each represent an aliphatic group, an aromatic hydrocarbon group, a heterocyclic group, $—N(R_{d1})R_{d2}$, $—N(R_{d3})N(R_{d4})R_{d5}$, $—OR_{d6}$, or $—SR_{d7}$; $X_d$ and $Y_d$ may form a ring but are not enolized, in which $R_{d1}$, $R_{d2}$, $R_{d3}$, $R_{d4}$, and $R_{d5}$ each represent a hydrogen atom, an aliphatic group, an aromatic hydrocarbon group, or a heterocyclic group, and in which $R_{d6}$ and $R_{d7}$ each represent a hydrogen atom, a cation, an aliphatic group, an aromatic hydrocarbon group, or a heterocyclic group, with the proviso that at least one of $X_d$ and $Y_d$ is substituted by at least one selected from the group consisting of a carboxylic acid or its salt, a sulfonic acid or its salt, a phosphonic acid or its salt, an amino group, an ammonium group, and a hydroxyl group;

$$RSO_2SM$$ formula (E)

wherein R represents an aliphatic group, an aryl group, or a heterocyclic group, and M represents a hydrogen atom or a cation.

(3) The method for processing a silver halide color photographic light-sensitive material as stated in the above (1) or (2), wherein an ammonium ion concentration of said bleach-fix solution is 0 to 0.1 mol/liter or less.

(4) The method for processing a silver halide color photographic light-sensitive material as stated in the above (1), (2) or (3), wherein a sulfite concentration of said bleach-fix solution is 0 to 0.05 mol/liter or less.

(5) The method for processing a silver halide color photographic light-sensitive material as stated in the above (1), (2), (3), or (4), wherein at least one of said color-forming reducing agent contained in said silver halide color photographic light-sensitive material is represented by the following formula (CH):

formula (CH)

$$R^{11}—NHNH—X—R^{12}$$

wherein $R^{11}$ represents an aryl group or a heterocyclic group; $R^{12}$ represents an alkyl group, an alkenyl group, an alkynyl group, an aryl group, or a heterocyclic group; and X represents $—SO_2—$, —CO—, —COCO—, —CO—O—, $—CO—N(R^{13})—$, —COCO—O—, $—COCO—N(R^{13})—$ or $—SO_2N(R^{13})—$, in which $R^{13}$ represents a hydrogen atom or a group represented by $R^{12}$ that is defined above.

Now the specific constitutions of the present invention are described in detail.

In the present invention, processing a silver halide color photographic light-sensitive material, which contains a color-forming reducing agent, with an alkaline solution that is substantially free from any color-developing agent, is defined as "an activator process." Processing solution substantially free from any color-developing agent that is used in that process is referred to as "an activator solution." In the present invention, "the activator solution" is characterized by being substantially free from any color-forming reducing agent as mentioned above or any p-phenylenediamine-series color-developing agent as used in conventional color-developing solutions for silver halide color photographic light-sensitive materials, and it may contain other components (e.g. alkalis, halogens, and chelating agents). To retain the processing stability, preferably a reducing agent is not contained in the activator solution in some cases, and preferably it is substantially free from auxiliary developing agents, hydroxylamines, sulfites, and the like.

Herein, the term "substantially free from" means that in each case the content is preferably 0.5 mmol/liter or less, more preferably 0.1 mmol/liter or less, and particularly preferably zero (not contained at all).

The pH of the alkaline solution (aqueous solution) used in the present invention is preferably 9 to 14, and particularly preferably 10 to 13.

As components to be contained in the activator solution, first, an alkali agent is mentioned, to keep the pH at 9 to 14. As preferable alkali agents, alkali metal hydroxides, such as potassium hydroxide, sodium hydroxide, and lithium hydroxide; alkali metal carbonates, such as potassium carbonate, sodium carbonate, potassium hydrogencarbonate, and sodium hydrogencarbonate; alkali metal phosphates, such as tripotassium phosphate, trisodium phosphate, dipotassium phosphate, and disodium phosphate; alkali metal borates, such as sodium borate and potassium borate; and alkali metal sulfosalicylates, such as sodium sulfosalicylate, can be mentioned.

Preferably the activator solution has a satisfactory pH buffering ability in the desired pH range, and for that end it is preferable to use an alkali metal hydroxide in combination with 0.05 to 0.5 mol/liter of a carbonate, a phosphate, a borate, or a sulfosalicylate, to adjust the pH.

To prevent calcium ions, magnesium ions, iron(II) or iron(III) ions, and the like from precipitating, preferably the activator solution contains one or, if necessary, more sequestration agents, such as ethylenediaminetetraacetic acid, diethylenetriaminepentaacetic acid, hydroxyethyliminodiacetic acid, nitrilotriacetic acid, ethylenediaminetetramethylenephosphonic acid, nitrilotrimethylenephosphonic acid, 1-hydroxyethylidene-1,1-diphosphonic acid, anhydrous polymaleic acid, ethylenediaminedisuccinic acid, and Tiron (trade name of 1,2-dihydroxy-3,5-benzenedisulfonic acid disodium salt).

To prevent fogging, the activator solution preferably contains an alkali metal halide, such as potassium chloride, sodium chloride, potassium bromide, and sodium bromide. Preferably the concentration of the halides is generally in the range of 0.0001 to 0.2 mol/liter.

To prevent lowering of the pH of the activator solution due to absorption of carbon dioxide, preferably the activator solution is used so that it has little contact with the air. Specifically preferably, the contact area of the processing tank or the replenishing tank with the air is made as small as possible. As a means of attaining that, preferably the shape of the processing tank or the replenishing tank is made such that the opening area, called a slit, is made narrow, as described, for example, in JP-A-63-148944 and 6-230146, or the opening area is reduced by floating a plastic floating lid or a high-boiling liquid having a specific gravity smaller than that of the activator solution, such as liquid paraffin, on the surface of the activator solution in that tank.

In processing with the activator solution, preferably the activator solution is constantly stirred, in order to promote the development reaction. In particular, the method wherein a jet stream of the activator solution is struck against the emulsion surface of the light-sensitive material by using a jet stirring method described in JP-A-62-183460, is most effective.

Further, the method wherein a circulating stream is generated by bubbling air or nitrogen gas in the processing tank may also be used, and in that case preferably the air or nitrogen gas used therein is passed through an alkaline solution previously, to remove carbon dioxide.

Preferably the processing with the activator solution is carried out at a temperature in the range of 20 to 80° C. for a period of 5 to 120 sec, particularly preferably at a temperature in the range of 30 to 60° C. for a period of 10 to 60 sec, and particularly more preferably at a temperature in the range of 35 to 50° C. for a period of 10 to 30 sec, in view of improving the stability of the development reaction.

Preferably the activator solution is used continuously by replenishing it. In that case, the replenishment rate of the activator solution is preferably 5 to 100 ml, and particularly preferably 10 to 50 ml, per $m^2$ of the light-sensitive material.

A compound represented by formula (I) for use in the present invention is described in detail below. The number of carbon atoms hereinafter referred to means a number of carbon atoms, excluding that in a substituent moiety.

Examples of the aliphatic hydrocarbon group represented by $R_1$ include a straight, branched, or cyclic alkyl group having preferably 1 to 12, more preferably 1 to 10, and still more preferably 1 to 8 carbon atoms; an alkenyl group having preferably 2 to 12, more preferably 2 to 10, and still more preferably 2 to 7 carbon atoms; and an alkynyl group having preferably 2 to 12, more preferably 2 to 10, and still more preferably 2 to 7 carbon atoms, each of which may be substituted with a substituent.

Examples of such a substituent include an aryl group having preferably 6 to 12, more preferably 6 to 10, and particularly preferably 6 to 8 carbon atoms (e.g. phenyl, methylphenyl); an alkoxy group having preferably 1 to 8, more preferably 1 to 6, and particularly preferably 1 to 4 carbon atoms (e.g. methoxy, ethoxy); an aryloxy group having preferably 6 to 12, more preferably 6 to 10, and particularly preferably 6 to 8 carbon atoms (e.g. phenyloxy); an acyl group having preferably 1 to 12, more preferably 2 to 10, and particularly preferably 2 to 8 carbon atoms (e.g. acetyl); an alkoxycarbonyl group having preferably 2 to 12, more preferably 2 to 10, and particularly preferably 2 to 8 carbon atoms (e.g. methoxycarbonyl); an acyloxy group having preferably 1 to 12, more preferably 2 to 10, and particularly preferably 2 to 8 carbon atoms (e.g. acetoxy); an acylamino group having preferably 1 to 10, more preferably 2 to 6, and particularly preferably 2 to 4 carbon atoms (e.g. acetylamino); a sulfonylamino group having preferably 1 to 10, more preferably 1 to 6, and particularly preferably 1 to 4 carbon atoms (e.g. methanesulfonylamino); a sulfamoyl group having preferably 0 to 10, more preferably 0 to 6, and particularly preferably 0 to 4 carbon atoms (e.g. sulfamoyl and methylsulfamoyl); a carbamoyl group having preferably 1 to 10, more preferably 1 to 6, and particularly preferably 1 to 4 carbon atoms (e.g. carbamoyl and methylcarbamoyl); an alkylthio group having preferably 1 to 8, more preferably 1 to 6, and particularly preferably 1 to 4 carbon atoms (e.g. methylthio and ethylthio); a sulfonyl group having preferably 1 to 8, more preferably 1 to 6, and particularly preferably 1 to 4 carbon atoms (e.g. methanesulfonyl); a sulfinyl group having preferably 1 to 8, more preferably 1 to 6, and particularly preferably 1 to 4 carbon atoms (e.g. methanesulfinyl); a hydroxyl group, a halogen atom (e.g. fluorine, chlorine, bromine, and iodine), a cyano group, a sulfo group, a carboxyl group, a nitro group; and a heterocyclic group (e.g. imidazolyl, pyridyl). These groups may be further substituted. When there are two or more subsituents, they are the same or different.

Preferred among the above-listed substituents for the aliphatic hydrocarbon groups represented by $R_1$, are an alkoxy group, a carboxyl group, a hydroxyl group, and a sulfo group, and more preferred are a carboxyl group and a hydroxyl group.

Preferred among the aliphatic hydrocarbon groups represented by $R_1$, is an alkyl group, more preferably a chain alkyl group. Still more preferable examples thereof include methyl, ethyl, carboxymethyl, 1-carboxyethyl, 2-carboxyethyl, 1,2-dicarboxyethyl, 1-carboxy-2-hydroxyethyl, 2-carboxy-2-hydroxyethyl, 2-hydroxyethyl, 2-methoxyethyl, 2-sulfoethyl, 1-carboxypropyl, 1-carboxybutyl, 1,3-dicarboxypropyl, 1-carboxy-2-(4-imidazolyl)ethyl, 1-carboxy-2-phenylethyl, 1-carboxy-3-methylthiopropyl, 2-carbamoyl-1-carboxyethyl, and 4-imidazolylmethyl; and the particularly preferred are methyl, carboxymethyl, 1-carboxyethyl, 2-carboxyethyl, 1,2-dicarboxyethyl, 1-carboxy-2-hydroxyethyl, 2-carboxy-2-hydroxyethyl, 2-hydroxyethyl, 1-carboxypropyl, 1-carboxybutyl, 1,3-dicarboxypropyl, 1-carboxy-2-phenylethyl, and 1-carboxy-3-methylthiopropyl.

Preferred among the aryl groups represented by $R_1$, is an aryl group composed of a single ring or twin rings, each having 6 to 20 carbon atoms (e.g. phenyl and naphthyl); more preferred is an aryl group having 6 to 15 carbon atoms; and still more preferred is an aryl group having 6 to 10 carbon atoms.

The aryl group represented by $R_1$ may have a substituent, examples of which include an alkyl group having preferably 1 to 8, more preferably 1 to 6, and particularly preferably 1 to 4 carbon atoms (e.g. methyl and ethyl); an alkenyl group having preferably 2 to 8, more preferably 2 to 6, and particularly preferably 2 to 4 carbon atoms (e.g. vinyl and allyl); and an alkynyl group having preferably 2 to 8, more preferably 2 to 6, and particularly preferably 2 to 4 carbon atoms (e.g. propargyl), in addition to the above-listed groups as the substituents for the aliphatic hydrocarbon group represented by $R_1$.

Preferred among the substituents for the aryl group represented by $R_1$, are an alkyl group, an alkoxy group, a hydroxyl group, and a sulfo group; and more preferred are an alkyl group, a carboxyl group, and a hydroxyl group.

Specific examples of the aryl group represented by $R_1$ include 2-carboxyphenyl and 2-carboxymethoxyphenyl.

The heterocyclic group represented by $R_1$ is a residue of a 3- to 10-membered saturated or unsaturated heterocyclic compound containing at least one of N, O, and S atoms, which may be a single ring or a condensed ring.

Preferred among the heterocyclic groups, is a 5- or 6-membered aromatic heterocyclic group, with a more preferred example being a 5- or 6-membered nitrogen atom-containing aromatic heterocyclic group. Still more preferred is a 5- or 6-membered aromatic heterocyclic group containing one or two nitrogen atoms.

Specific examples of the heterocyclic group include pyrrolidinyl, piperidyl, piperazinyl, imidazolyl, pyrazolyl, pyridyl, and quinolyl. Preferred among these groups are an imidazolyl group and a pyridyl group.

The heterocyclic group represented by $R_1$ may have a substituent, examples of which include an alkyl group having preferably 1 to 8, more preferably 1 to 6, and particularly preferably 1 to 4 carbon atoms (e.g. methyl and ethyl); an alkenyl group having preferably 2 to 8, more preferably 2 to 6, and particularly preferably 2 to 4 carbon atoms (e.g. vinyl and allyl); and an alkynyl group having preferably 2 to 8, more preferably 2 to 6, and particularly preferably 2 to 4 carbon atoms (e.g. propargyl), in addition to the above-listed groups as the substituents for the aliphatic hydrocarbon group represented by $R_1$.

Preferred among the substituents for the heterocyclic group represented by $R_1$, are an alkyl group, an alkoxy group, a hydroxyl group, and a sulfo group; and more preferred are an alkyl group, a carboxyl group, and a hydroxyl group.

$R_1$ is preferably a hydrogen atom, or an alkyl group having 1 to 8 carbon atoms, and more preferred is a hydrogen atom, a methyl group, an ethyl group, a 1-carboxyethyl group, a 2-carboxyethyl group, a hydroxyethyl group, or a 2-carboxy-2-hydroxyethyl group. A hydrogen atom is especially preferred.

The alkylene groups represented by $L_1$ and $L_2$ are the same or different, and they may be straight chain, branched chain, or cyclic groups. Further, they may have a substituent, examples of which include an alkenyl group having preferably 2 to 8, more preferably 2 to 6, and particularly preferably 2 to 4 carbon atoms (e.g. vinyl and allyl); and an alkynyl group having preferably 2 to 8, more preferably 2 to 6, and particularly preferably 2 to 4 carbon atoms (e.g. propargyl), in addition to the above-listed groups as the substituent for the aliphatic hydrocarbon group represented by $R_1$.

Preferred among the substituents for the alkylene groups represented by $L_1$ and $L_2$, are an aryl group, an alkoxy group, a hydroxy group, a carboxyl group, and a sulfo group; and more preferred are an aryl group, a carboxyl group, and a hydroxyl group.

Preferred alkylene groups represented by $L_1$ and $L_2$ are groups whose alkylene moieties have 1 to 6 carbon atoms, and more preferably 1 to 4 carbon atoms. Still more preferred alkylene groups are substituted or unsubstituted methylene and ethylene groups.

Preferred specific examples of the alkylene group include methylene, ethylene, trimethylene, methylmethylene, ethylmethylene, n-propylmethylene, n-butylmethylene, 1,2-cyclohexylene, 1-carboxymethylene, carboxymethylmethylene, carboxyethylmethylene, hydroxymethylmethylene, 2-hydroxyethylmethylene, carbamoylmethylmethylene, phenylmethylene, benzylmethylene, 4-imidazolylmethylmethylene, and 2-methylthioethylmethylene; and more preferred are methylene, ethylene, methylmethylene, ethylmethylene, n-propylmethylene, n-butylmethylene, 1-carboxymethylene, carboxymethylmethylene, carboxyethylmethylene, hydroxymethylmethylene, benzylmethylene, 4-imidazolylmethylmethylene, and 2-methylthioethylmethylene; and still more preferred are methylene, ethylene, methylmethylene, ethylmethylene, n-propylmethylene, n-butylmethylene, 1-carboxymethylene, carboxymethylmethylene, hydroxymethylmethylene, and benzylmethylene.

The cation represented by $M_1$ or $M_2$ is an organic or inorganic cation, examples of which include an alkali metal ion (e.g. $Li^+$, $Na^+$, $K^+$, $Cs^+$), an alkali earth metal ion (e.g. $Mg^{2+}$, $Ca^{2+}$), an ammonium ion (e.g. ammonium, trimethylammonium, triethylammonium, tetramethylammonium, tetraethylammonium, tetrabutylammonium, 1,2-ethanediammonium), a pyridinium ion, an imidazolium ion, and a phosphonium ion (e.g. tetrabutylphosphonium).

Preferred examples of $M_1$ and $M_2$ are an alkali metal ion and an ammonium ion, and more preferred are $Na^+$, $K^+$, and $NH_4^+$.

Preferred among the compounds represented by formula (I), are those represented by the following formula (I-a):

formula (I-a)

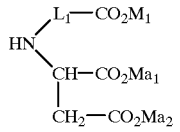

wherein $L_1$ and $M_1$ each have the same meanings as those in formula (I), and therefore their preferred ones are also same; $Ma_1$ and $Ma_2$ each have the same meanings as $M_2$ in formula (I).

Preferred among the compounds represented by formula (I-a), are those in which $L_1$ is a substituted or unsubstituted methylene or ethylene group, and $M_1$, $Ma_1$, and $Ma_2$ are any one of a hydrogen atom, an alkali metal, and an ammonium, respectively. More preferred compounds are ones in which $L_1$ is a substituted or unsubstituted methylene group, and $M_1$, $Ma_1$, and $Ma_2$ are any one of a hydrogen atom, an alkali metal, and an ammonium, respectively. Particularly preferred compounds are ones in which $L_1$ is a substituted or unsubstituted methylene group having 1 to 10 total carbon atoms including its substituent, and $M_1$, $Ma_1$, $Ma_2$ are any one of a hydrogen atom, $Na^+$, $K^+$, and $NH_4^+$, respectively.

Now, the compound represented by formula (II) is described in detail.

The aliphatic hydrocarbon group, the aryl group, and the heterocyclic group, represented by $R_{21}$, $R_{22}$, $R_{23}$, and $R_{24}$, have the same meanings as those of the aliphatic hydrocarbon group, the aryl group, and the heterocyclic group, represented by $R_1$ in formula (I), and preferable groups represented by $R_{21}$, $R_{22}$, $R_{23}$, and $R_{24}$ are the same as the preferable groups represented by $R_1$ in formula (I).

$R_{21}$, $R_{22}$, $R_{23}$, and $R_{24}$ preferably each represent a hydrogen atom or a hydroxyl group, and more preferably a hydrogen atom.

t and u are each 0 or 1, and preferably 1.

The divalent linking group represented by W preferably can be represented by the following formula (W):

formula (W)

$$—(W^1—D)_v—(W^2)_w—$$

wherein $W^1$ and $W^2$, which are the same or different, each represent a straight-chain or branched alkylene group having 2 to 8 carbon atoms (e.g. ethylene, propylene, and trimethylene), a cycloalkylene group having 5 to 10 carbon atoms (e.g. 1,2-cyclohexylene), an arylene group having 6 to 10 carbon atoms (e.g. o-phenylene), an aralkylene group having 7 to 10 carbon atoms (e.g. o-xylenyl), a divalent nitrogen-containing heterocyclic group, or a carbonyl group. As the divalent nitrogen-containing heterocyclic group, a 5- or 6-membered heterocyclic group whose hetero atom is a nitrogen atom, and one that is bonded to $W^1$ and $W^2$ at the carbon atoms that are adjacent to each other, such as an imidazolyl group, are preferable. D represents —O—, —S—, or —N($R_w$)—, wherein $R_w$ represents a hydrogen atom or an alkyl group having 1 to 8 carbon atoms (e.g. methyl), or an aryl group having 6 to 10 carbon atoms (e.g. phenyl), each of which may be substituted by a carboxyl group, a phosphono group, a hydroxyl group, or a sulfo group.

$W^1$ and $W^2$ preferably each represent an alkylene group having 2 to 4 carbon atoms.

v is an integer of 0 to 3. When v is 2 or 3, $W^1$-D's are the same or different. v is preferably 0 to 2, more preferably 0 or 1, and particularly preferably 0. w is an integer of 1 to 3. When w is 2 or 3, $W^2$'s are the same or different. w is preferably 1 or 2.

Examples of W are the following:

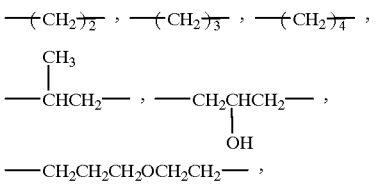

-continued

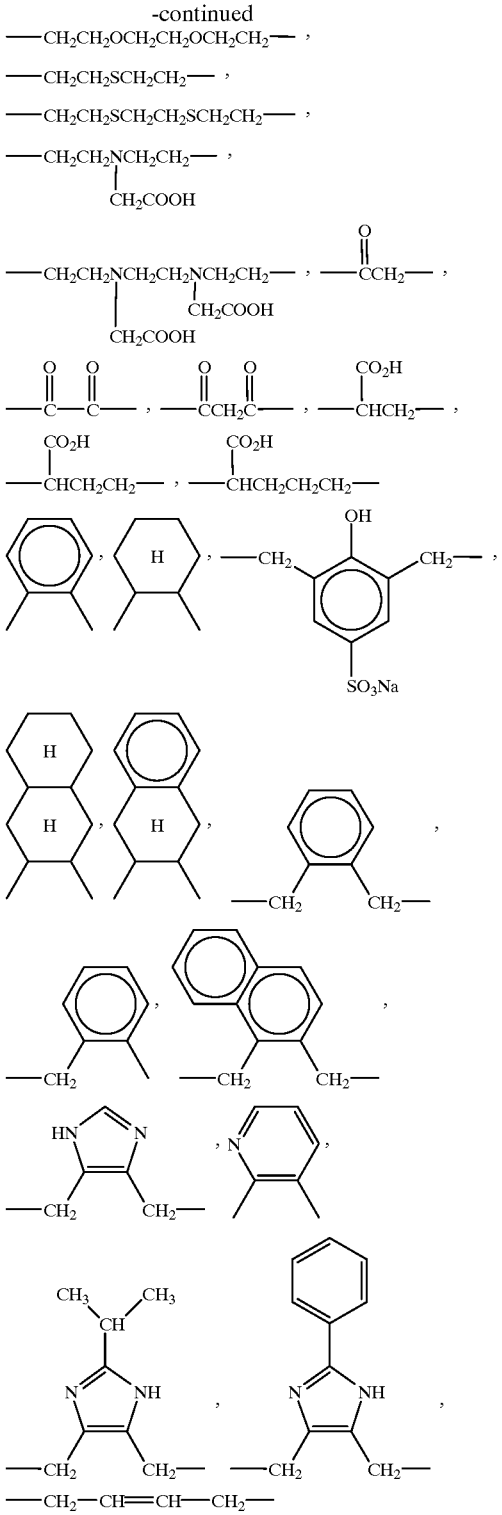

Preferably W represents ethylene, propylene, trimethylene, or 2,2-dimethyltrimethylene, and particularly preferably ethylene or trimethylene.

$M_{21}$, $M_{22}$, $M_{23}$, and $M_{24}$ each represent a hydrogen atom or a cation, which has the same meaning as that of $M_1$ and $M_2$ in formula (I).

Out of the compounds represented by formula (II), preferable ones are those wherein $R_{22}$ and $R_{24}$ each represent a hydrogen atom, and t and u are each 1, and more preferable ones are those wherein $R_{21}$, $R_{22}$, $R_{23}$, and $R_{24}$ each represent a hydrogen atom, and t and u are each 1.

Out of the compounds represented by formula (II), further more preferable ones are those wherein $R_{21}$, $R_{22}$, $R_{23}$, and $R_{24}$ each represent a hydrogen atom, t and u are each 1, W represents ethylene, and $M_{21}$, $M_{22}$, $M_{23}$, and $M_{24}$ each represent one selected from the group consisting of a hydrogen atom, $Na^+$, $K^+$, and $NH_4^+$, and those wherein $R_{21}$, $R_{22}$, $R_{23}$, and $R_{24}$ each represent a hydrogen atom, t and u are each 1, W represents trimethylene, and $M_{21}$, $M_{22}$, $M_{23}$, and $M_{24}$ each represent one selected from among a hydrogen atom, $Na^+$, $K^+$, and $NH_4^+$.

Further, when the compound represented by formula (I) or (II) has asymmetric carbon atoms in the molecule, preferably at least one asymmetric carbon atom is in an L-form. When there are two or more asymmetric carbon atoms, the more numerous the L-form structures of the asymmetric carbon sections are, the more preferable it is.

Specific examples of the compound represented by formula (I) or (II) are shown below, which do not limit the present invention.

Additionally, among the compounds, those compounds wherein L is annexed are ones wherein the asymmetric carbon section of the annexed part is in an L-form, and those wherein L is not annexed are mixtures of a D-form and a L-form.

I-1

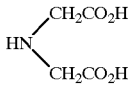

I-2

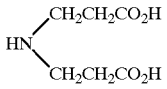

I-3

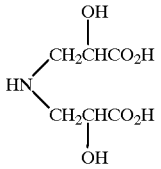

I-4

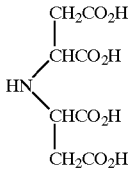

I-5

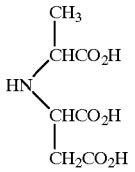

-continued

I-6

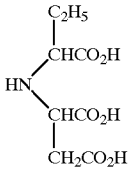

I-7

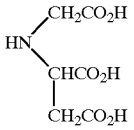

I-8

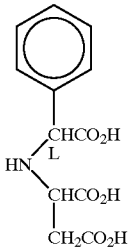

I-9

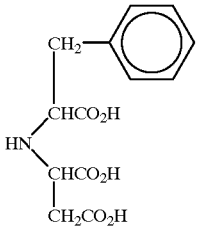

I-10

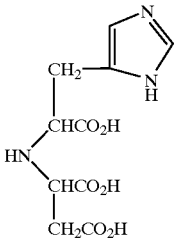

I-11

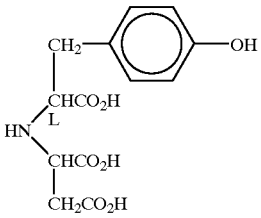

I-12

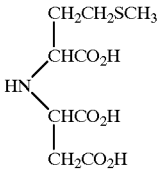

-continued
I-13
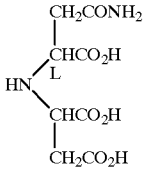
I-14
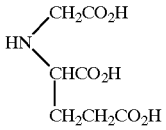
I-15
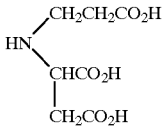
I-16
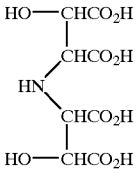
I-17
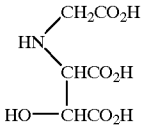
I-18
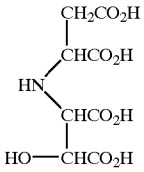
I-19
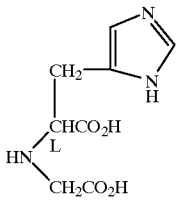
I-20
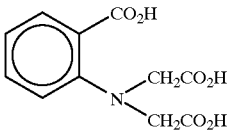
I-21
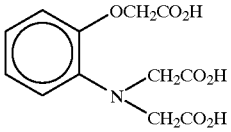
-continued
I-22
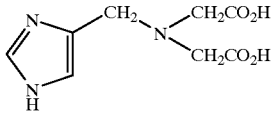
I-23
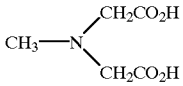
I-24
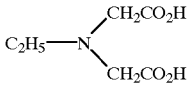
I-25
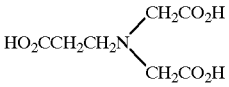
I-26
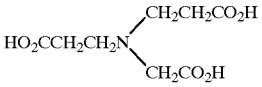
I-27
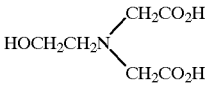
I-28
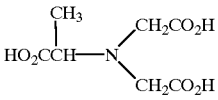
I-29
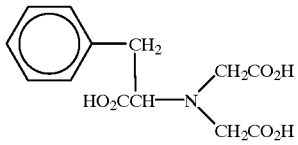
I-30
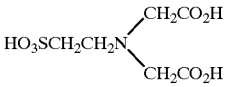
I-31
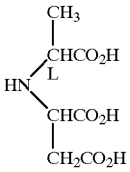
I-32
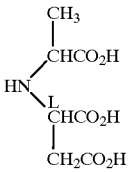

-continued
I-33
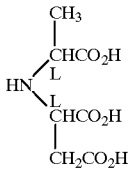
I-34
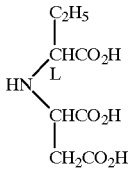
I-35
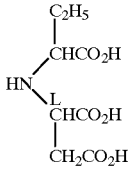
I-36
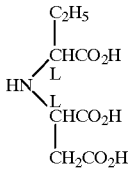
I-37
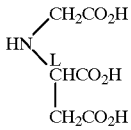
I-38
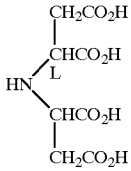
I-39
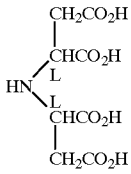
I-40
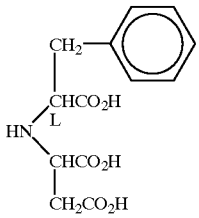
-continued
I-41
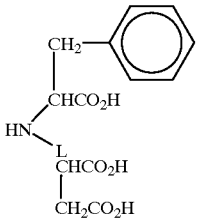
I-42
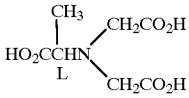
I-43
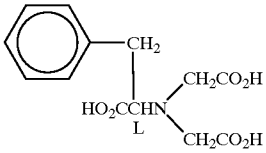
I-44
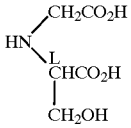
I-45
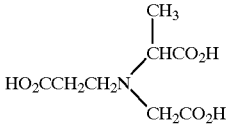
I-46
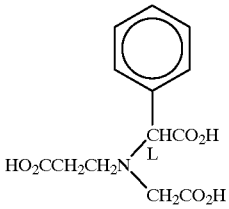
I-47
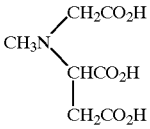
I-48
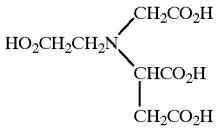
I-49
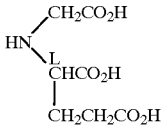

-continued
I-50
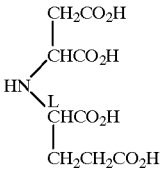
I-51
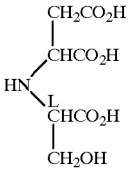
I-52
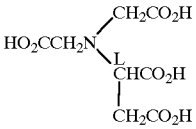
I-53
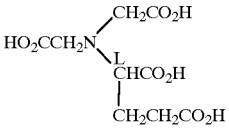
I-54
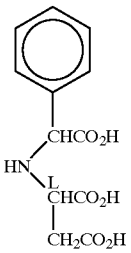
I-55
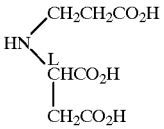
I-56
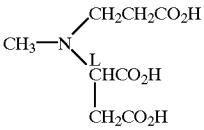
I-57
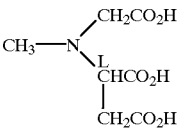
I-58
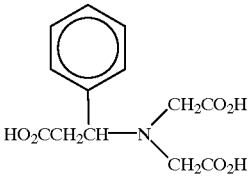
-continued
II-1
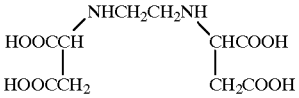
II-2
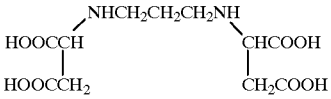
II-3
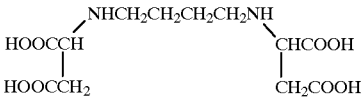
II-4
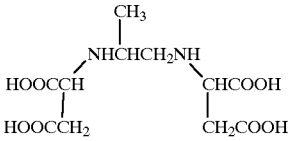
II-5
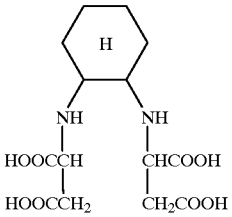
II-6
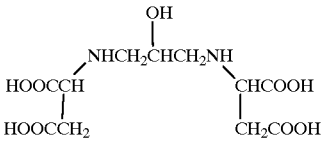
II-7
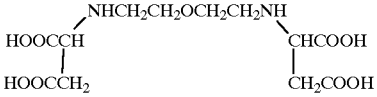
II-8
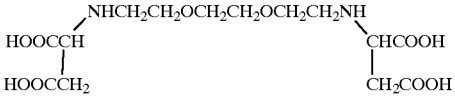
II-9
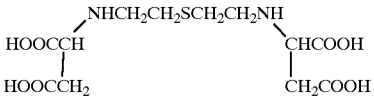
II-10
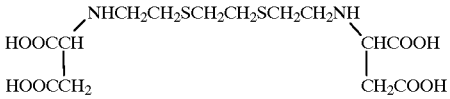
II-11
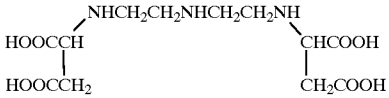

-continued
II-12
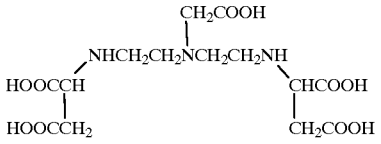
II-13
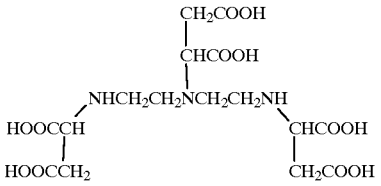
II-14
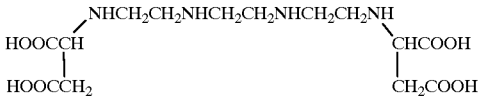
II-15
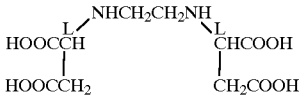
II-16
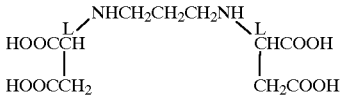
II-17
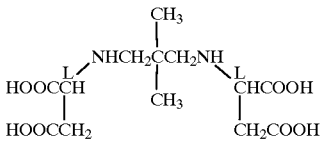
II-18
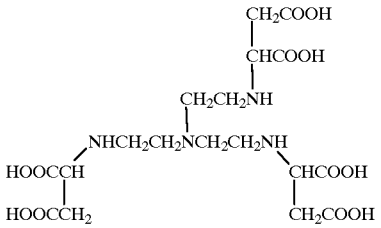
II-19
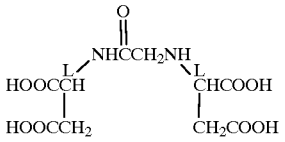
II-20
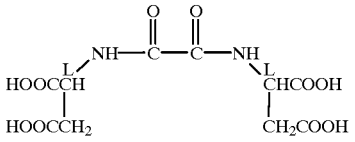
-continued
II-21
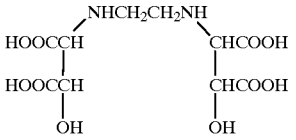
II-22
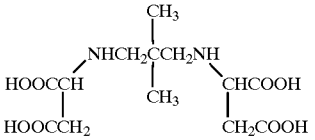
II-23
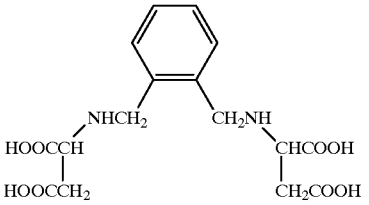
II-24
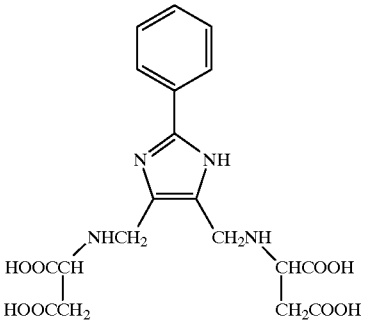
II-25
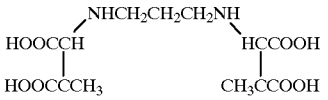
II-26
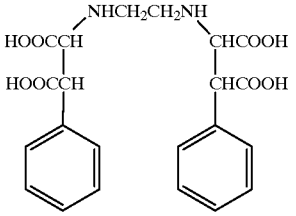
II-27
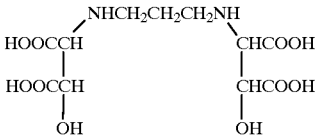
II-28
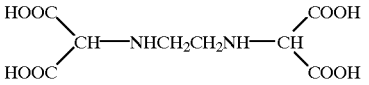
II-29
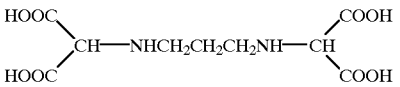

-continued

II-30

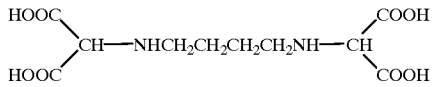

II-31

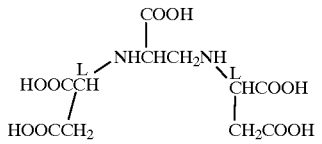

II-32

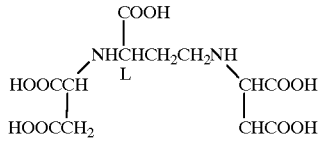

II-33

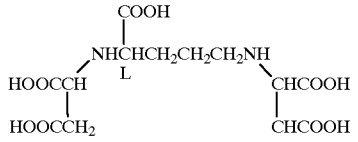

II-34

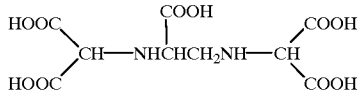

II-35

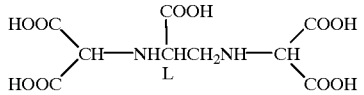

The above-listed compounds may be ones in which a hydrogen atom of the carboxyl group is substituted with a cation, respectively. In this case, the cation has the same meanings as defined for those represented by $M_1$ and $M_2$ in formula (I).

The compound represented by formula (I) for use in the present invention can be prepared according to the methods described in, for example, *Journal of Inorganic and Nuclear Chemistry*, Vol. 35, p. 523 (1973), Swiss patent No. 561504, DE-A-391255(A1), ibid. A-3939755(A1), ibid. A-3939756 (A1), JP-A-5-265159, ibid. 6-59422 (methods for preparing L types of exemplified compounds I-42, I-43, I-46, I-52, and I-53 are described in the synthesis examples 1, 2, 3, 4 and 6), ibid. 6-95319 (methods for preparing L types of exemplified compounds I-8, I-11, I-37, I-38, and I-40 are described in the synthesis examples 2 to 6), ibid. 6-161054, and ibid. 6-161065.

Further, the compound represented by formula (II) can be synthesized according to methods described, for example, in JP-A-63-199295 and 3-173857; "Bulletin of the Chemical Society of Japan," Vol. 46, page 884, (1973); and "Inorganic Chemistry," Vol. 7, page 2405, (1968) (a method of synthesizing the L,L-form of Exemplified Compound II-15 is described).

In the present invention, a ferric (iron (III)) complex salt of a compound represented by formula (I) or (II) may be added in the form of an isolated compound. Alternatively, the compound of formula (I) or (II) and a ferric salt (e.g. ferric nitrate, ferric chloride and ferric bromide) may be added in a solution to coexist therein, and subjected to a complex formation in a processing solution.

Further, the compound of formula (I) or (II) for use in the present invention may be used singly or in a combination of two or more kinds thereof.

In the present invention, the compound of formula (I) or (II) may be used somewhat in excess of the amount necessary to form a complex salt of ferric ion (e.g. 0.5, 1, or 2 times the molar amount per the ferric ion). When the compound is used in such an excess amount, preferably the excess amount is generally regulated to the range of 0.01 to 15 mol %.

A ferric complex salt of an organic acid contained in a bleach-fix solution for use in the present invention may be used in the form of an alkali metal salt or an ammonium salt. Exemplary alkali metal salts are a lithium salt, a sodium salt, and a potassium salt. On the other hand, exemplary ammonium salts are an ammonium salt and a tetraethylammonium salt. In the present invention, the concentration of an ammonium ion in a bleach-fix solution is preferably 0 to 0.4 mol/l, and especially preferably 0 to 0.1 mol/l.

In the present invention, as a bleaching agent, the ferric complex salt of a compound represented by formula (I) or (II) can be used in combination with a ferric complex salt of known compounds, such as ethylenediamine-N,N,N',N'-tetraacetic acid, diethylenetriaminepentaacetic acid, trans-1, 2-cyclohexanediaminetetraacetic acid, glycoletherdiaminetetraacetic acid, and 1,3-propanediamine-N,N,N',N'-tetraacetic acid, and/or in combination with an inorganic oxidizing agent, such as potassium ferricyanide, a salt of persulfuric acid, hydrogen peroxide, and a salt of bromic acid. However, in the present invention it is preferred, from such points of view as environmental protection and safety for handling, that the compound represented by formula (I) or (II) occupies an amount of 70 to 100 mol %, more preferably 80 to 100 mol %, and especially preferably 100 mol %, of the total bleaching agent.

In the present invention, the concentration of the ferric complex salt of the compound represented by formula (I) or (II) in the bleach-fix solution is generally 0.003 to 3.00 mol/l, preferably 0.02 to 2.00 mol/l, more preferably 0.05 to 1.00 mol/l, and especially preferably 0.08 to 0.5 mol/l. However, the total concentration of the ferric complex salt in combination with the above-mentioned inorganic oxidizing agent, is preferably 0.005 to 0.030 mol/l.

Further, in the present invention, the compound represented by formula (I) or (II) may be contained as a chelating agent in another processing bath (e.g. a developing solution, an activator solution, a washing water, a rinsing solution, and a stabilizing step).

Preferably the bleach-fix solution contains a pH buffer, and particularly an organic acid having a pKa of 2.0 to 5.0, such as glycolic acid, succinic acid, maleic acid, malonic acid, glutaric acid, citric acid, malic acid, and tartaric acid, is preferably used. In the present invention, the pKa is the logarithm of the reciprocal of the acid dissociation constant and is the value determined by using an ionic strength of 0.1 mol/liter at 25° C. Specific examples of organic acids having a pKa of 2.0 to 5.5 include compounds described in JP-A-3-107147, page 5, lower right column, line 2, to page 6, upper left column, line 10. Among these organic acids, those that have less odor are preferably used, and particularly glycolic acid, malonic acid, succinic acid, and citric acid are preferable. Preferably the concentration of these buffers is in the range of 0 to 3 mol/liter, and particularly preferably in the range of 0.1 to 1.5 mol/liter.

A replenishing agent for a bleach-fix solution in the present invention may be a liquid or a solid (a powder, a granule, a tablet). For a granular or tablet form of a replenishing agent, the use of a polyethylene glycol-series surfactant is preferred, because such the compound also works as a binder.

In order to solidify a photographic processing agent, use can be made of various methods described in, for example, JP-A-4-29136, ibid. 4-85535, ibid. 4-85536, ibid. 4-88533, ibid. 4-85534, and ibid. 4-172341. For example, the solidification can be accomplished by kneading a dense-liquid, or a fine-powdered or granular photographic processing agent with a water-soluble binder and then molding the same, or by atomizing a water-soluble binder on the surface of a provisionally molded photographic processing agent, and then forming a coating layer thereon.

A tablet processing agent can be obtained by a general preparation method described in, for example, JP-A-51-61837, ibid. 54-155038, ibid. 52-88025, and GB-1213808, and, further, a granular processing agent can be obtained by a general preparation method described in, for example, JP-A-2-109042, ibid. 2-109043, ibid. 3-39735, and ibid. 3-39739. Further, a powdered processing agent can be obtained by a general preparation method described in, for example, JP-A-54-133332, GB-725892, ibid. 729862, and German patent No. 3733861.

In the present invention, the replenishers of the activator solution, the bleach-fix solution, and the rinsing solution can be supplied in various forms; for example, in the form of a completed solution adjusted into the use state, in the form of a concentrated solution that will be diluted with water, in the form of a suspension that will be dissolved in water, in the form of a paste, in the form of a powder, in the form of granules, and in the form of tablets.

In the above, by the term "suspension" is meant a liquid in which the undissolvable component is contained in the suspended state, and to stabilize the suspended state, preferably carboxymethylcellulose, hydroxyethylcellulose, an anionic surface-active agent, diethylene glycol, triethylene glycol, glycerin, a polyethylene glycol having a molecular weight of 300 to 6,000, or the like is added as a dispersant. By the term "paste" is meant one that is more viscous than the suspension and is in the semi-solid processing liquid state, and examples are described, for example, in JP-T-57-500485 ("JP-T" means published searched patent publication).

The containers for holding the processing agents in the above various states are produced by processing, for example, a high-density polyethylene, a low-density polyethylene, a polypropylene, a polyethylene terephthalate, a polyethylene naphthalate, a polyvinyl chloride, or a composite material of a polyethylene and nylon.

These containers are desirably produced using a single material to be made light in weight, in view of protection of the environment, and specifically they are preferably produced by stretching to have a thin wall.

To take out each of the processing agents from the containers, it may be taken out by opening the stopper manually or by providing an automatic stopper opening means for the automatic processor. The takeout from each of the containers is preferably carried out in such a manner that water is jetted into the container for washing away the processing agent as well as washing the inside of the container. Preferably such a mechanism is provided for the automatic processor.

When a replenishing agent for the bleach-fix solution is composed of a liquid, the liquid may be a single liquid, or a combination of liquids having different components. From such points of view as storage space for the replenishing agent and operability at the time of chemical mixing, preferred are one liquid or two sets of liquids, and particularly preferred is one liquid. In such cases, preferably the specific gravity of the replenishing agent to that of a replenisher is in range of from 1.0 to 5 times, and particularly preferably from 1.5 to 3 times.

The pH of the bleach-fix solution for use in the present invention is generally in the range of from 3.0 to 8.0, particularly preferably from 4.0 to 7.0. In order to adjust the pH to these ranges, in the present invention, it is preferred to add the above-mentioned organic acid as a buffer. As an alkali for adjusting the pH, preferred are an aqueous ammonia, potassium hydroxide, sodium hydroxide, potassium carbonate, sodium carbonate, and the like.

The pH of a bleach-fix solution for use in the present invention can be adjusted to the above-mentioned ranges by means of the above-listed alkali and a known acid (inorganic acids and organic acids).

Preferably these processings with a solution having a bleaching capability for use in the present invention are conducted directly after the color development. However, in the case of a reversal processing, usually they are conducted via a compensating bath (or alternatively a bleach-accelerating bath) or the like. This compensating bath may contain an image stabilizer, as described below.

Further, the solution having a bleaching capacity for use in the present invention may contain, in addition to a bleaching agent, known rehalogenizing agents, a pH buffer, and known additives, as described on page 12 of JP-A-3-144446, and further the solution may contain aminopolycarboxylic acids and organic phosphonic acids. Preferred rehalogenizing agents are sodium bromide, potassium bromide, ammonium bromide, potassium chloride, etc. The addition amount thereof is preferably from 0.1 to 1.5 mol, more preferably from 0.1 to 1.0 mol, and particularly preferably from 0.1 to 0.8 mol, per liter of the solution having a bleaching capacity.

Further, preferably the bleach-fix solution for use in the present invention contains a nitric acid compound, such as ammonium nitrate and sodium nitrate. In the present invention, the concentration of the nitric acid compound per liter of the solution having a bleaching capacity is preferably from 0 to 0.3 mol, and more preferably from 0 to 0.2 mol.

Usually, such nitric acid compounds as ammonium nitrate and sodium nitrate are used to prevent corroding of stainless steel. In the present invention, even a small amount of nitric acid compound prevents the corrosion, and desilvering is well done.

The replenishment rate of the bleach-fix solution in the present invention is preferably 10 to 500 ml, and more preferably 20 to 300 ml, per $m^2$ of the light-sensitive material.

In the present invention, the processing time of the bleach-fix processing step is preferably in the range of 10 sec to 3 min, and particularly preferably in the range of 20 sec to 1 min. The total time of the processing times of the processing steps from the activator step to the drying step is preferably 30 sec to 15 min, and more preferably 1 to 3 min. The processing temperature is generally 25 to 50° C., and preferably 35 to 45° C. In the preferable temperature range, the processing speed is improved.

Especially preferably, the bleach-fix solution for use in the present invention is subjected to aeration at the time of the processing, because such aeration keeps photographic properties extremely stable. Various means known in this technical field can be used for the aeration. For example, there are several methods, such as blowing of air into the processing solution having a bleaching capacity, and absorption of air by means of an ejector.

At the time of the blowing of air, it is preferred to deliver air into a solution through a gas-scattering tube having fine pores. The air-scattering tube is widely used for an airing tub in the activated sludge processing. For further particulars about the aeration, the articles described in Z-121, Using Process C-41, Third edition (1982), published by Eastman Kodak Co., pp. BL-1 to BL-2, can be referred to. It is preferred to vigorously stir the processing solution having a bleaching capacity for use in the present invention. A method described in JP-A-3-33847, page 8, right upper column, line 6, to the left lower column, line 2, can be used to accomplish the above-mentioned purpose.

Further, in the present invention, a bath that precedes the bleach-fix solution may contain various bleach-accelerating agents. Examples of these bleach-accelerating agents to be used include compounds having a mercapto group or a disulfide group, as described in U.S. Pat. No. 3,893,858, German patent No. 1 290 821, British patent No. 1 138 842, JP-A-53-95630, and Research Disclosure No. 17129 (July, 1978); thiazolidine derivatives, as described in JP-A-50-140129; thiourea derivatives, as described in U.S. Pat. No. 3,706,561; iodides, as described in JP-A-58-16235; polyethylene oxides, as described in German patent No. 2 748 430; and polyamine compounds, as described in JP-B-45-8836 ("JP-B" means examined Japanese patent publication). Further, compounds described in U.S. Pat. No. 4,552,834 are also preferably used. These bleach-accelerating agents may be added into a light-sensitive material.

The bleach-fix solution may further contain various fluorescent whitening agents, defoamers, or surface-active agents, polyvinyl pyrrolidones, and organic solvents, such as methanol. Further, to keep the pH of the bleach-fix solution constant, preferably buffers are added to the bleach-fix solution. Examples are phosphates, imidazoles, such as imidazole, 1-methyl-imidazole, 2-methyl-imidazole, and 1-ethyl-imidazole; triethanolamine, N-allymorpholine, and N-benzoylpiperazine.

In the present invention, a bleach step and/or a fixing step may be present before or after the processing step in which the bleach-fix solution is used. Specific modes thereof are given below, which do not limit the invention.

1. Bleach-fix
2. Bleach/bleach-fix
3. Bleach-fix/fixing
4. Bleach/bleach-fix/fixing
5. Bleach/fixing/bleach-fix
6. Bleach-fix/bleach Incidentally, a washing step may arbitrarily be provided between these processing steps.

Stirring as vigorously possible is preferred in each processing step in the processing method of the present invention. Specific examples of methods of forced stirring include a method in which a jet of the processing solution is impinged on the surface of the emulsion of the light-sensitive material, as disclosed in JP-A-62-183460 and ibid. 3-33847, page 8, right upper column, line 6, to the left lower column, line 2; a method in which the stirring effect is increased using a rotating means, as disclosed in JP-A-62-183461; a method in which the light-sensitive material is moved with a wiper blade installed in the solution, which blade is in contact with the surface of the emulsion, and the generated turbulent flow at the surface of the emulsion increases the stirring effect; and a method in which the circulating flow rate of the entire processing solution is increased. These stirring effect-improving methods are effective for any of the solution. It is supposed that improvement in the stirring accelerates the supply of the component of the processing solution into an emulsion layer, which results in enhancing the processing speed.

The bleach-fix solution for use in the present invention can be reused in the processing step by recovering the overflow liquid after use, and then compensating for the composition by the addition of components. Such a usage, which is generally called "regeneration," is preferably used in the present invention. With regard to the details of the regeneration, the items disclosed in *Fuji Film Processing Manual, Fuji Color Negative Film, CN-16 Process* (revised in August 1990), pp 39–40 (published by Fuji Photo Film Co., Ltd.), can be referred to.

With regard to the regeneration of the bleach-fix solution, in addition to the above described aeration methods, the methods disclosed in *Shashin Kogaku no Kiso—Ginn-en Shashin Hen* (The Fundamentals of Photographic Technology—Silver Salt Photography) (edited by Nippon Shashin Gakkai, published by Corona, Co., 1979), etc., can be utilized. Specific examples of the regeneration methods of the bleaching solution include a regeneration method by electrolysis and a regeneration method by a hydrogen peroxide, a bromous acid, ozone, etc., making use of a bromic acid, a chlorous acid, a bromine, a bromine precursor, a persulfate, a hydrogen peroxide, and a catalyst.

In the regeneration method by electrolysis, a regeneration processing is carried out by putting an anode and a cathode in the same bleach-fix bath, or by separating an anode bath from a cathode bath by a diaphragm, as well as that a bleaching solution and a developing solution and/or a fixing solution can be regeneration-processed at the same time, also using a diaphragm. Regeneration of the bleach-fix solution is carried out by an electrolytic reduction of the accumulated silver ion. In addition, the removal of the accumulated halogen ion by means of an anion exchange resin is also preferred, for maintaining the fixing ability.

The processing solution having a bleaching capacity for use in the present invention is preferably stored in sealed container having an oxygen-transmitting rate of 1 $cc/m^2 \cdot day \cdot atm$ or more.

Preferably the bleach-fix solution for use in the present invention contains at least one of 1,2-benzoisothiazolin-3-one or its derivatives. Specific examples of these compounds are given below, which do not limit the present invention:

1,2-benzoisothiazolin-3-one, 2-methyl-1,2-benzoisothiazolin-3-one, 2-ethyl-1,2-benzoisothiazolin-3-one, 2-(n-propyl)-1,2-benzoisothiazolin-3-one, 2-(n-butyl)-1,2-benzoisothiazolin-3-one, 2-(sec-butyl)-1,2-benzoisothiazolin-3-one, 2-(t-butyl)-1,2-benzoisothiazolin-3-one, 2-methoxy-1,2-benzoisothiazolin-3-one, 2-ethoxy-1,2-benzoisothiazolin-3-one, 2-(n-propyloxy)-1,2-benzoisothiazolin-3-one, 2-(n-butyloxy)1,2-benzoisothiazolin-3-one, 5-chloro-1,2-benzoisothiazolin-3-one, 5-methyl-1,2-benzoisothiazolin-3-one, 6-ethoxy-1,2-benzoisothiazolin-3-one, 6-cyano-1,2-benzoisothiazolin-3-one, and 5-nitro-1,2-benzoisothiazolin-3-one.

A preferable amount of these compounds to be added is 0.001 to 1 g, more preferably 0.01 to 0.5 g, and particularly preferably 0.02 to 0.2 g, per liter of the bleach-fix solution. These compounds may be added in the form of salts, and they may be added as a combination of two or more.

A replenishing solution for the processing solution having a bleach capacity, basically contains each of components in such a concentration as calculated according to the following equation:

$$C_R = C_T \times (V_1 + V_2)/V_1 + C_P$$

$C_R$: Concentration of a component in a replenishing solution, $C_T$: Concentration of a component in a mother liquid (processing tank solution), $C_P$: Concentration of a component consumed during a processing, $V_1$: Replenishing amount (ml) of the bleach-fix replenishing solution per $m^2$ of the light-sensitive material, $V_2$: Amount (ml) of solution carried by $m^2$ of the light-sensitive material from a preceding bath to a subsequent bath.

Each of the concentrations of components in a mother liquid can be kept constant by the above-described replenishing solution.

An automatic processor that is used for processing a light-sensitive material according to the present invention, preferably has transportation means of the light-sensitive material, as described in JP-A-60-191257, ibid. 60-191258, and ibid. 60-191259. As described in the above-mentioned JP-A-60-191257, these transportation means considerably decrease the amount of a solution carried from a preceding bath to a next bath, so that an effect for preventing deterioration of the processing solution can be enhanced. Consequently, this effect is particularly advantageous for shortening the processing time in each of steps and for reducing a replenishing amount of the processing solution.

In the bleach-fix step, it is preferred to recover silver by means of various kinds of silver recovery apparatuses, which are in-line or off-line set. By in-line setting, the processing can be carried out at the reduced silver concentration in the solution, which results in reduction of the replenishing amount. Further, a residual solution after off-line silver recovery treatment is preferably reused as a replenishing solution.

In the bleach-fix step, washing step, the stabilizing step, and the rinsing step, two or more processing tanks can be used, respectively. A multi-stage countercurrent system, in which these tanks are connected by a cascade piping, can be preferably adopted.

In the washing step, the stabilizing step, and the rinsing step, contents described in JP-A-4-125558, page 12, right lower column, line 6, to page 13, right lower column, line 16, are preferably applied. Particularly, in the stabilizing solution, instead of formaldehyde, azomethylamines described in EP-504609 and 519190 (OLS), and N-methylolazoles described in JP-A-4-362943, are preferably used, and magenta couplers are formed into dimers, to obtain a surface-active agent solution that does not contain an image stabilizer, such as formaldehyde, which is preferable in view of preservation of the working environment.

In the processing solutions, there are various ion components, such as calcium ions, magnesium ions, sodium ions, and potassium ions, which are brought out of the solution preparations used in preparing the replenishers, or they are brought out as extracts from the light-sensitive material. In the present invention the sodium ion concentration of the final bath of the washing step, the rinsing step, and the stabilizing step is preferably in the range of 0 to 100 mg/liter, and particularly preferably 0 to 50 mg/liter.

The replenishment rate of each of the washing liquid, the rinsing solution, and the stabilizing solution is preferably in the range of 50 to 1000 ml, and particularly preferably 100 to 500 ml, per $m^2$ of the light-sensitive material, both in view of keeping the washing, rinsing, and stabilizing function, and in view of reduction in the waste liquor for conservation of the environment. In the processing in which such a replenishment rate is used, for the purpose of preventing bacteria and mold from propagating, known mildew-proofing agents, such as thiabendazole, 1,2-benzoisothiazolin-3-one, and 5-chloro-2-methylisothiazolin-3-one; antibiotics, such as gentamycin; or water that has been deionized with an ion exchange resin or the like, are preferably used. It is more effective to use deionized water in combination with a mildew-proofing agent or an antibiotic.

Further, preferably the solution in the washing liquid tank, the rinsing solution tank, or the stabilizing solution tank is subjected to a reverse osmosis membrane process described in JP-A-3-46652, 3-53246, 3-121448, or 3-126030, to reduce the replenishment rate, which reverse osmosis membrane process preferably uses a low-pressure reverse osmosis membrane.

In the process in the present invention, particularly preferably the evaporation of each of the processing solutions is compensated, as disclosed in Kogi No. 94-4992 in *Kokai-giho*, published by Hatsumei-Kyokai. Particularly preferably the compensation is carried out using the information of temperature and humidity of the installation environment of processors based on (Formula-1) on its page 2. The water used for the compensation of evaporation is preferably taken out of the replenishing tank for washing, and in that case, deionized water is preferably used as the replenishment water for washing.

For the bleach-fix solution for use in the present invention, as the fixing agent, sodium thiosulfate and ammonium thiosulfate, as well as other known fixing agents, such as mesoionic compounds, thioureas, and a large amount of iodides, can be mentioned. These are described, for example, in JP-A-60-61749, 60-147735, 1-21444, 1-201659, 1-210951, and 2-44355, and U.S. Pat. No. 4,378,424. Examples are ammonium thiosulfate, sodium thiosulfate, potassium thiosulfate, guanidine thiosulfate, ammonium thiocyanate, sodium thiocyanate, potassium thiocyanate, and imidazole. Above all, thiosulfates and mesoionic compounds are preferable. In view of quick-fixing properties, ammonium thiosulfate is preferable, but since, as described above, the environmental problem demands the reduction of nitrogen atoms discharged into the natural world, sodium thiosulfate and mesoionic compounds are more preferably used in the present invention.

Further, by the use of a combination of two or more fixing agents, the fixing can be carried out more quickly. For example, in addition to sodium thiosulfate or ammonium thiosulfate, ammonium thiocyanate, imidazole, or thiourea is preferably used, and in this case the second fixing agent is preferably added in the range of 0.01 to 100 mol % based on sodium thiosulfate or ammonium thiosulfate.

The amount of the fixing agent is generally 0.1 to 3.0 mol, and preferably 0.5 to 2.0 mol, per liter of the bleach-fix solution.

In the present invention, preferably the compound represented by formula (A), (B), (C), (D), or (E) is contained in the bleach-fix solution.

Next, the compounds represented by any one of formulae (A) to (E) that are fixing agents used in the present invention, are described in detail below.

In the specification of this application, an aliphatic group, an aromatic hydrocarbon group, and a heterocyclic group are as follows unless otherwise specified.

An aliphatic group represents a substituted or unsubstituted, straight-chain, branched, or cyclic alkyl group, a substituted or unsubstituted alkenyl group, or a substituted or unsubstituted alkynyl group. A divalent aliphatic groups is a divalent group of the aliphatic group, and examples include a substituted or unsubstituted, straight-chain, branched, or cyclic alkylene group, a substituted or unsubstituted alkenylene group, and a substituted or unsubstituted alkynylene group. Examples of the aliphatic group include, for example, a methyl group, an ethyl group, a propyl group, a butyl group, an isopropyl group, a 2-hydroxypropyl group, a hexyl group, an octyl group, a vinyl group, a propenyl group, a butenyl group, a benzyl group, and a phenetyl group.

An aromatic hydrocarbon group (an aromatic group) represents a substituted or unsubstituted aryl group, which may be a monocyclic group, or may be condensed to an aromatic ring or heterocyclic ring. A divalent aromatic hydrocarbon group represents a substituted or unsubstituted arylene group, which may be a monocyclic ring or may be condensed to an aromatic ring or a heterocyclic ring. Examples of the aromatic hydrocarbon group include, for example, a phenyl group, a 2-chlorophenyl group, a 3-methoxyphenyl group, and a naphthyl group.

A heterocyclic group represents a 3- to 10-membered, saturated or unsaturated, substituted or unsubstituted heterocyclic group that has as a hetero atom at least one nitrogen atom, oxygen atom, or sulfur atom, and it may be a monocyclic group or may be condensed to an aromatic ring or a heterocyclic ring. Examples of the heterocyclic ring include, for example, a pyrrole ring, an imidazole ring, a pyrazole ring, a pyridine ring, a pyrazine ring, a pyrimidine ring, a triazole ring, a thiadiazole ring, an oxadiazole ring, a quinoxaline ring, a tetrazole ring, a thiazole ring, and an oxazole ring.

Further, each of the groups in this specification may be substituted unless otherwise specified, and examples of possible substituents include, for example, an alkyl group, an aralkyl group, an alkenyl group, an alkynyl group, an alkoxy group, an aryl group, an amino group, an acylamino group, a sulfonamido group, a ureido group, a urethane group, an aryloxy group, a sulfamoyl group, a carbamoyl group, an alkylthio group, an arylthio group, a sulfonyl group, a sulfinyl group, an acyl group, a hydroxyl group, a halogen atom, a cyano group, a sulfo group, a carboxyl group, a phosphono group, an aryloxycarbonyl group, an alkoxycarbonyl group, an acyloxy group, a nitro group, a hydroxamic acid group, and a heterocyclic group.

In formula (A), $Q_{a1}$ preferably represents a group of non-metal atoms required to form a 5- or 6-membered heterocyclic ring that is composed of (together with the C and the N) at least one of a carbon atom, a nitrogen atom, an oxygen atom, a sulfur atom, and a selenium atom, which heterocyclic ring may be condensed to a carboaromatic ring or a heteroaromatic ring.

As the heterocyclic ring, for example, a tetrazole ring, a triazole ring, an imidazole ring, a thiadiazole ring, an oxadiazole ring, a selenadiazole ring, an oxazole ring, a thiazole ring, a benzoxazole ring, a benzthiazole ring, a benzimidazole ring, a pyrimidine ring, a triazaindene ring, a tetraazaindene ring, and a pentaazaindene ring can be mentioned.

$R_{a1}$ represents a carboxylic acid or its salt (e.g. a sodium salt, a potassium salt, an ammonium salt, and a calcium salt), a sulfonic acid or its salt (e.g. a sodium salt, a potassium salt, an ammonium salt, a magnesium salt, and a calcium salt), a phosphonic acid or its salt (e.g. a sodium salt, a potassium salt, and an ammonium salt), a substituted or unsubstituted amino group (e.g. unsubstituted amino, dimethylamino, diethylamino, methylamino, and bismethoxyethylamino), or a substituted or unsubstituted ammonium group (e.g. trimethylammonium, triethylammonium, and dimethylbenzylammonium). $L_{a1}$ represents a single bond, a divalent aliphatic group, a divalent aromatic hydrocarbon group, a divalent heterocyclic group, or a linking group formed by combining these groups. Preferably $L_{a1}$ represents an alkylene group having 1 to 10 carbon atoms (e.g. methylene, ethylene, propylene, butylene, isopropylene, 2-hydroxypropylene, hexylene, and octylene), an alkenylene group having 2 to 10 carbon atoms (e.g. vinylene, propenylene, and butenylene), an aralkylene group having 7 to 12 carbon atoms (e.g. phenetylene), an arylene group having 6 to 12 carbon atoms (e.g. phenylene, 2-chlorophenylene, 3-methoxyphenylene, and naphthylene), a divalent group of a heterocyclic group having 1 to 10 carbon atoms (e.g. a pyridyl, thienyl, furyl, triazolyl, and imidazolyl), or a single bond; or $L_{a1}$ may be a group formed by combining these groups arbitrarily, or a group formed by arbitrarily combining —CO—, —$SO_2$—, $NR_{202}$—, —O—, and —S—, wherein $R_{202}$ represents a hydrogen atom, an alkyl group having 1 to 6 carbon atoms (e.g. methyl, ethyl, butyl, and hexyl), an aralkyl group having 7 to 10 carbon atoms (e.g. benzyl and phenetyl), or an aryl group having 6 to 10 carbon atoms (e.g. phenyl and 4-methylphenyl).

$M_{a1}$ represents a hydrogen atom or a cation (e.g. an alkali metal atom, such as a sodium atom and a potassium atom, an alkali earth metal atom, such as a magnesium atom and a calcium atom, and an ammonium group, such as an ammonium group and a triethylammonium group).

Further, the heterocyclic ring represented by formula (A) and $R_{a1}$ may be substituted, for example, by a nitro group, a halogen atom (e.g. chlorine and bromine), a mercapto group, a cyano group, a substituted or unsubstituted alkyl group (e.g. methyl, ethyl, propyl, t-butyl, and cyanoethyl), a substituted or unsubstituted aryl group (e.g. phenyl, 4-methanesulfonamidophenyl, 4-methylphenyl, 3,4-dichlorophenyl, and naphthyl), a substituted or unsubstituted alkenyl group (e.g. allyl), a substituted or unsubstituted aralkyl group (e.g. benzyl, 4-methylbenzyl, and phenethyl), a substituted or unsubstituted sulfonyl group (e.g. methanesulfonyl, ethanesulfonyl, and p-toluenesulfonyl), a substituted or unsubstituted carbamoyl group (e.g. unsubstituted carbamoyl, methylcarbamoyl, and phenylcarbamoyl), a substituted or unsubstituted sulfamoyl group (e.g. unsubstituted sulfamoyl, methylsulfamoyl, and phenylsulfamoyl), a substituted or unsubstituted carbonamido group (e.g. acetamido and bezamido), a substituted or unsubstituted sulfonamido group (e.g. methanesulfonamido, benzenesulfonamido, and p-toluenesulfonamido), a substituted or unsubstituted acyloxy group (e.g. acetyloxy and benzoyloxy), a substituted or unsubstituted sulfonyloxy group (e.g. methanesulfonyloxy), a substituted or unsubstituted ureido group (e.g. unsubstituted ureido, methylureido, ethylureido, and phenylureido), a substituted or unsubstituted acyl group (e.g. acetyl and benzoyl), a substituted or unsubstituted oxycarbonyl group (e.g. methoxycarbonyl and phenoxycarbonyl), a substituted or unsubstituted oxycarbonylamino group (e.g. methoxycarbonylamino, phenoxycarbonylamino, and 2-ethylhexyloxycarbonylamino), or a hydroxyl group. q is an integer of 1 to 3, and when q is 2 or 3, $R_{a1}$'s are the same or different.

In formula (A), $Q_{a1}$ preferably represents a tetrazole ring, a triazole ring, an imidazole ring, an oxadiazole ring, a triazaindene ring, a tetraazaindene ring, or a pentaazaindene ring; $R_{a1}$ preferably represents an alkyl group having 1 to 6 carbon atoms and substituted by 1 or 2 groups selected from among carboxylic acids or their salts and sulfonic acids or their salts, and q is preferably 1 or 2.

Among the compounds represented by formula (A), more preferable compounds are those represented by formula (A-1):

formula (A-1)

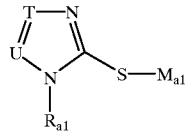

wherein $M_{a1}$ and $R_{a1}$ have the same meanings as those defined in formula (A); T and U each represent C—$R_{a2}$ or N, in which $R_{a2}$ represents a hydrogen atom, a halogen atom, a hydroxyl group, a nitro group, an alkyl group, an alkenyl group, an aralkyl group, an aryl group, a carbonamido group, a sulfonamido group, a ureido group, or a group represented by $R_{a1}$; and when $R_{a2}$ represents the group represented by $R_{a1}$, $R_{a2}$ is the same as or different from $R_{a1}$ of formula (A).

Now, formula (A-1) is described in detail.

T and U each represent C—$R_{a2}$ or N, wherein $R_{a2}$ represents a hydrogen atom, a halogen atom (e.g. chlorine and bromine), a hydroxyl group, a nitro group, an alkyl group (e.g. methyl, ethyl, methoxyethyl, n-butyl, and 2-ethylhexyl), an alkenyl group (e.g. allyl), an aralkyl group (e.g. benzyl, 4-methylbenzyl, phenetyl, and 4-methoxybenzyl), an aryl group (e.g. phenyl, naphthyl, 4-methanesulfonamidophenyl, and 4-methylphenyl), a carbonamido group (e.g. acetylamino, benzoylamino, and methoxypropionylamino), a sulfonamido group (e.g. methanesulfonamido, benzenesulfonamido, and p-toluenesulfonamido), a ureido group (e.g. unsubstituted ureido, methylureido, and phenylureido), or $R_{a1}$, and when $R_{a2}$ represents $R_{a1}$, $R_{a2}$ is the same as or different from $R_{a1}$ of formula (A).

In formula (A-1), preferably, T and U each represent N or T and U each represent C—$R_{a2}$, $R_{a2}$ represents a hydrogen atom or an alkyl group having 1 to 4 carbon atoms, and $R_{a1}$ represents an alkyl group having 1 to 4 carbon atoms and substituted by one or more groups selected from among carboxylic acids or their salts and sulfonic acids or their salts.

Specific examples of the compound represented by formula (A) for use in the present invention are shown below, which do not limit the present invention:

A-1.

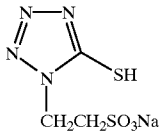

A-2.

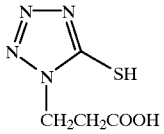

A-3.

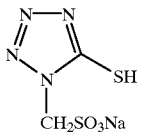

A-4.

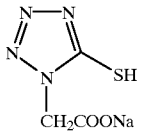

A-5.

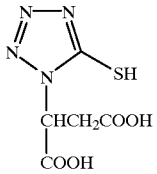

-continued

A-6.

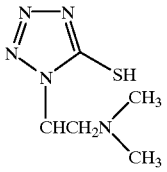

A-7.

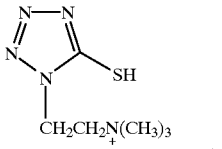

A-8.

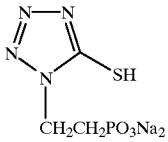

A-9.

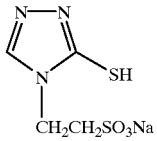

A-10.

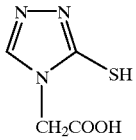

A-11.

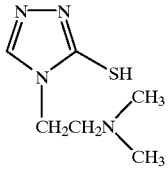

A-12.

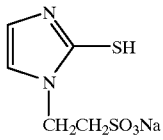

A-13.

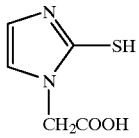

A-14.

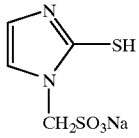

-continued

A-15.

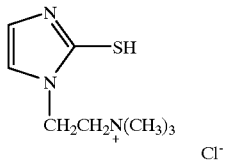

A-16.

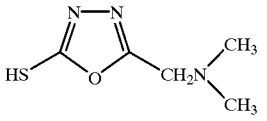

A-17.

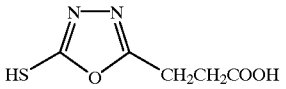

A-18.

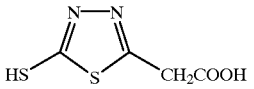

A-19.

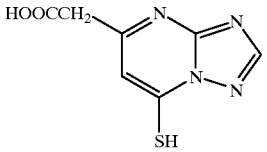

A-20.

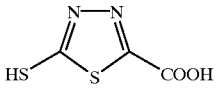

The compound represented by formula (A) used in the present invention can be synthesized in accordance with methods described in *Berichte der Deutschen Chemischen Gesellschaft* 28, 77 (1895); JP-A-60-61749 and 60-147735; *Berichte der Deutschen Chemischen Gesellschaft* 22, 568 (1889); *Berichte der Deutschen Chemischen Gesellschaft* 29, 2483 (1896); *Journal of the Chemical Society* 1932, 1806; *Journal of the American Chemical Society* 71, 4000 (1949); *Advances in Heterocyclic Chemistry* 9, 165 (1968); *Organic Synthesis* IV, 569 (1963); *Journal of the American Chemical Society* 45, 2390 (1923); and *Chemische Berichte* 9, 465 (1876).

Next, formula (B) is described in detail.

In formula (B), $Q_{b1}$ represents a 5- or 6-membered mesoionic ring composed of carbon atoms, nitrogen atoms, oxygen atoms, sulfur atoms, or selenium atoms, and $X_{b1}$ represents —$O^-$, —$S^-$, or —$N^-R_{b1}$, wherein $R_{b1}$ represents an aliphatic group, an aromatic hydrocarbon group, or a heterocyclic group.

The mesoionic compound represented by formula (B) for use in the present invention refers to a group of compounds that are defined by W. Baker and W. D. Ollis in *Quart. Rev.* 11, 15 (1957), and in *Advances in Heterocyclic Chemistry* 19, 1 (1976); and the compound "is a 5- or 6-membered heterocyclic-like compound that cannot be satisfactorily represented by a single covalently bonded structural formula or a single polar structural formula, and, in the case of a compound having a sextet of π electrons related to all of the atoms constituting the ring, the ring is partially positively charged, which is balanced with negative charges on the exocyclic atoms or atomic group."

Examples of the mesoionic ring represented by $Q_{b1}$ include, for example, an imidazolium ring, a pyrazolium ring, an oxazolium ring, a thiazolium ring, a triazolium ring, a tetrazolium ring, a thiadiazolium ring, an oxadiazolium ring, a thiatriazolium ring, and an oxatriazolium ring.

$R_{b1}$ represents a substituted or unsubstituted aliphatic group (e.g. methyl, ethyl, n-propyl, n-butyl, isopropyl, n-octyl, carboxymethyl, dimethylaminoethyl, cyclohexyl, 4-methylcyclohexyl, cyclopentyl, propenyl, 2-methylpropenyl, propargyl, butynyl, 1-methylpropargyl, benzyl, and 4-methoxybenzyl), a substituted or unsubstituted aromatic group (e.g. phenyl, naphthyl, 4-methylphenyl, 3-methoxyphenyl, and 4-ethoxycarbonylphenyl), or a substituted or unsubstituted heterocyclic group (e.g. pyridyl, imidazolyl, morpholino, triazolyl, tetrazolyl, and thienyl).

Further, the mesoionic ring represented by M may be substituted by the substituents described for formula (A).

Further, the compound represented by formula (B) may form a salt (e.g. an acetate, a nitrate, a salicylate, a hydrochloride, an iodate, and a bromate).

In formula (B), preferably $X_{b1}^-$ represents —$S^-$.

Out of the meso-ionic compounds represented by formula (B) used in the present invention, more preferable compounds are those represented by formula (B-1):

formula (B-1)

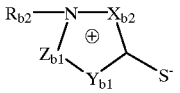

wherein $X_{b2}$ represents N or C—$R_{b3}$, $Y_{b1}$ represents O, S, N, or N—$R_{b4}$, and $Z_{b1}$ represents N, N—$R_{b5}$, or C—$R_{b6}$.

$R_{b2}$, $R_{b3}$, $R_{b4}$, $R_{b5}$, and $R_{b6}$ each represent an aliphatic group, an aromatic group, a heterocyclic group, an amino group, an acylamino group, a sulfonamido group, a ureido group, a sulfamoylamino group, an acyl group, or a carbamoyl group, and $R_{b3}$ and $R_{b6}$ each can be a hydrogen atom, and $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may form a ring, respectively.

The compound represented by formula (B-1) is now described in detail.

The aliphatic group, the aromatic group, the heterocyclic group, the amino group, the acylamino group, the sulfonamido group, the ureido group, the sulfamoylamino group, the acyl group, and the carbamoyl group represented by $R_{b2}$, $R_{b3}$, $R_{b4}$, $R_{b5}$, and $R_{b6}$ may be substituted.

In formula (B-1), preferably $X_{b2}$ represents N or C—$R_{b3}$; $Y_{b1}$ represents N—$R_{b4}$, S, or O; $Z_{b1}$ represents N or C—$R_{b6}$; and $R_{b2}$, $R_{b3}$, or $R_{b6}$ represents a substituted or unsubstituted alkyl group, a substituted or unsubstituted alkenyl group, a substituted or unsubstituted alkynyl group, or a substituted or unsubstituted heterocyclic group, and $R_{b3}$ and $R_{b6}$ each can be a hydrogen atom. Preferably $R_{b4}$ represents a substituted or unsubstituted alkyl group, a substituted or unsubstituted alkenyl group, a substituted or unsubstituted alkynyl group, a substituted or unsubstituted heterocyclic group, or a substituted or unsubstituted amino group.

In formula (B-1), more preferably $X_{b2}$ represents N, $Y_{b1}$ represents N—$R_{b4}$, $Z_{b1}$ represents C—$R_{b6}$, $R_{b2}$ and $R_{b4}$ each represent an alkyl group having 1 to 6 carbon atoms, and $R_{b6}$ represents a hydrogen atom or an alkyl group having 1 to 6 carbon atoms; but more preferably at least one alkyl group of $R_{b2}$, $R_{b4}$, and $R_{b6}$ is an alkyl group substituted by at least one carboxylic acid group, sulfonic acid group, amino group, or phosphono group.

Specific examples of the compound represented by formula (B) for use in the present invention are shown below, which do not limit the present invention:

B-1.
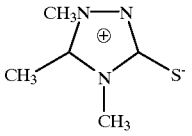
B-2.
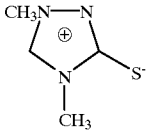
B-3.
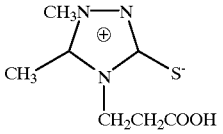
B-4.
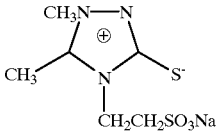
B-5.
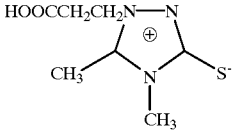
B-6.
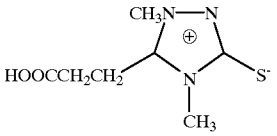
B-7.
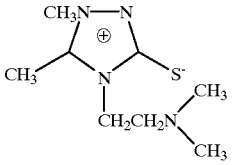
B-8.
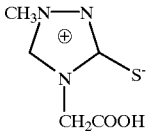
B-9.
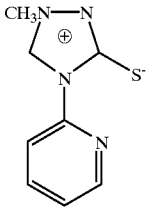
B-10.
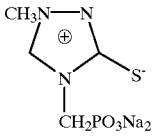
-continued
B-11.
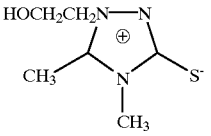
B-12.
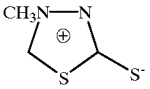
B-13.
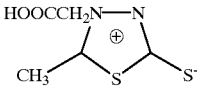
B-14.
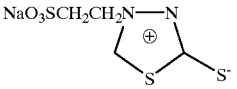
B-15.
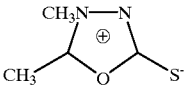
B-16.
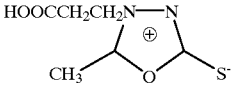
B-17.
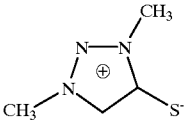
B-18.
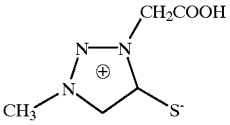
B-19.
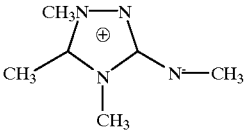
B-20.
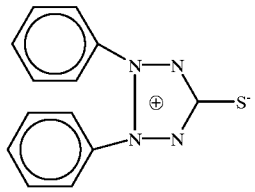
B-21.
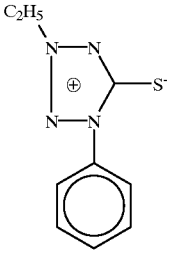

-continued

B-22.

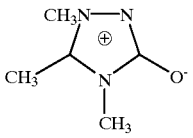

B-23.

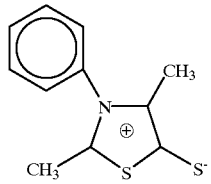

The compound represented by formula (B) for use in the present invention can be synthesized by methods described, for example, in JP-A-1-201659 and 4-143755.

Next, formula (C) is described in detail.

$L_{C1}$ and $L_{C3}$ each represent a substituted or unsubstituted aliphatic group having 1 to 10 carbon atoms (e.g. methyl, ethyl, propyl, hexyl, isopropyl, carboxyethyl, benzyl, phenetyl, vinyl, propenyl, and 1-methylvinyl), a substituted or unsubstituted aromatic group having 6 to 12 carbon atoms (e.g. phenyl, 4-methylphenyl, and 3-methoxyphenyl), or a substituted or unsubstituted heterocyclic group having 1 to 10 carbon atoms (e.g. pyridyl, furyl, thienyl, and imidazolyl), and $L_{C2}$ represents a substituted or unsubstituted divalent aliphatic group having 1 to 12 carbon atoms (e.g. methylene, ethylene, trimethylene, tetramethylene, pentamethylene, hexamethylene, 1-methylethylene, 1-hydroxytrimethylene, and 1,2-xylylene), a substituted or unsubstituted divalent aromatic group having 6 to 12 carbon atoms (e.g. phenylene and naphthylene), a substituted or unsubstituted divalent heterocyclic linking group having 1 to 10 carbon atoms (e.g.

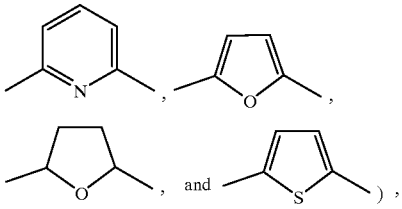

or a linking group formed by combining these groups e.g.

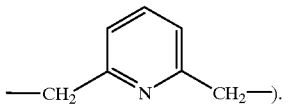

$A_{C1}$ and $A_{C2}$ each represent —S—, —O—, —$NR_{C20}$—, —CO—, —CS—, —$SO_2$—, or a group formed by combining these groups arbitrarily. Examples of the group formed by combining them arbitrarily are —$CONR_{C21}$—, —$NR_{C22}CO$—, —$NR_{C23}CONR_{C24}$—, —COO—, —OCO—, —$SO_2NR_{C25}$—, —$NR_{C26}SO_2$—, and —$NR_{C27}CONR_{C28}$—.

r is an integer of 1 to 10.

However, at least one of $L_{C1}$ and $L_{C3}$ is substituted by —$SO_3M_{C1}$, —$PO_3M_{C2}M_{C3}$, —$NR_{C1}(R_{C2})$ (which may be in the form of a salt, such as a hydrochloride and an acetate, for example, unsubstituted amino, methylamino, dimethylamino, N-methyl-N-hydroxyethylamino, and N-ethyl-N-carboxyethylamino), —$N^+R_{C3}(R_{C4})(R_{C5}).X_{C1}^-$ (e.g. trimethylammonio chloride), —$SO_2NR_{C6}(R_{C7})$ (e.g. unsubstituted sulfamoyl and dimethylsulfamoyl), —$NR_{C8}SO_2R_{C9}$ (e.g. methanesulfonamido and benzenesulfonamido), —$CONR_{C10}(R_{C11})$ (e.g. unsubstituted carbamoyl, N-methylcarbamoyl, and N,N-bis (hydroxyethyl)carbamoyl), —$NR_{C12}COR_{C13}$ (e.g. formamido, acetamido, and 4-methylbenzoylamino), —$SO_2R_{14}$ (e.g. methanesulfonyl and 4-chlorophenylsulfonyl), —$PO(—NR_{C15}(R_{C16}))_2$ (e.g. unsubstituted phosphonamido and tetramethylphosphonamido), —$NR_{C17}CONR_{C18}(R_{C19})$ (e.g. unsubstituted ureido and N,N-dimethylureido), a heterocyclic group (e.g. pyridyl, imidazolyl, thienyl, and tetrahydrofuranyl), or —$COOM_{C4}$, $M_{C1}$, $M_{C2}$, $M_{C3}$, and $M_{C4}$ each represent a hydrogen atom or a counter cation (e.g. an alkali metal atom, such as a sodium atom and a potassium atom; an alkali earth metal atom, such as a magnesium atom and a calcium atom; and an ammonium group, such as ammonium and triethylammonium).

$R_{C1}$ to $R_{C28}$ each represent a hydrogen atom, a substituted or unsubstituted aliphatic group having 1 to 12 carbon atoms (e.g. methyl, ethyl, propyl, hexyl, isopropyl, benzyl, phenetyl, vinyl, propenyl, and 1-methylvinyl), or a substituted or unsubstituted aromatic group having 6 to 12 carbon atoms (e.g. phenyl, 4-methylphenyl, and 3-methoxyphenyl), and $X_{C1}^-$ represents a counter anion (e.g. a halide ion, such as a chloride ion and a bromide ion; a nitrate ion, a sulfate ion, an acetate ion, and a p-toluenesulfonate ion).

When $L_{C1}$, $L_{C2}$, $L_{C3}$, and $R_{C1}$ to $R_{C28}$ each are substituted, examples of the substituent include, for example, a lower alkyl group having 1 to 4 carbon atoms (e.g. methyl and ethyl), an aryl group having 6 to 10 carbon atoms (e.g. phenyl and 4-methylphenyl), an aralkyl group having 7 to 10 carbon atoms (e.g. benzyl), an alkenyl group having 2 to 4 carbon atoms (e.g. propenyl), an alkoxy group having 1 to 4 carbon atoms (e.g. methoxy and ethoxy), a halogen atom (e.g. chlorine and bromine), a cyano group, a nitro group, a carboxylic acid group (which may be in the form of a salt), and a hydroxyl group.

In passing, when r is 2 or more, $A_{C1}$ and $L_{C2}$ may be an arbitrary combination of the above-mentioned groups.

Further, at least one of $A_{C1}$ and $A_{C2}$ represents —S—.

In formula (C), preferably at least one of $L_{C1}$ and $L_{C3}$ represents an alkyl group having 1 to 6 carbon atoms that is substituted by —$SO_3M_{C1}$, —$PO_3M_{C2}M_{C3}$, —$NR_{C1}(R_{C2})$, —$N^+R_{C3}(R_{C4})(R_{C5}).X_{C1}^-$, a heterocyclic group, or —$COOM_{C4}$, and $L_{C2}$ represents an alkylene group having 1 to 6 carbon atoms; $A_{C1}$ and $AC_2$ each represent —S—, —O—, or —$NR_{C20}$—; $R_{C1}$, $R_{C2}$, $R_{C3}$, $R_{C4}$, $R_{C5}$, and $R_{C20}$ each represent a hydrogen atom or an alkyl group having 1 to 6 carbon atoms, and r is an integer of 1 to 6.

In formula (C), more preferably $L_{C1}$ and $L_{C3}$ each represent an alkyl group having 1 to 4 carbon atoms and substituted by —$SO_3M_{C1}$, —$PO_3M_{C2}M_{C3}$, or —$COOM_{C4}$, $A_{C1}$ and $A_{C2}$ each represent —S—, and r is an integer of 1 to 3.

Specific examples of the compound represented by formula (C) for use in the present invention are shown below, which do not limit the present invention:

C-1.

$NaO_3S(CH_2)_2S(CH_2)_2S(CH_2)_2SO_3Na$

C-2.

$NaO_3S(CH_2)_2-(SCH_2CH_2)_2-S(CH_2)_2SO_3Na$

C-3.

$NaO_3S(CH_2)_2-(SCH_2CH_2)_3-S(CH_2)_2SO_3Na$

C-4.

$NaO_3S(CH_2)_2-(SCH_2CH_2)_4-S(CH_2)_2SO_3Na$

C-5.

$NaO_3S(CH_2)_3S(CH_2)_2S(CH_2)_3SO_3Na$

C-6.

$NaO_3S(CH_2)_3-(SCH_2CH_2)_2-S(CH_2)_3SO_3Na$

C-7.

$NaO_3S(CH_2)_3-(SCH_2CH_2)_3-S(CH_2)_3SO_3Na$

C-8.

$NaO_3S(CH_2)_3S(CH_2)_2O(CH_2)_2S(CH_2)_3SO_3Na$

C-9.

$NaO_3S(CH_2)_3S(CH_2)_2N(CH_3)(CH_2)_2S(CH_2)_3SO_3Na$

C-10.

$KO_3S(CH_2)_2S(CH_2)_2N(CH_2)_2SO_3K)(CH_2)_2SO_3K$

C-11.

$NaO_3S(CH_2)_3S(CH_2)_2CONH(CH_2)_2NHCO(CH_2)_2S(CH_2)_3SO_3Na$

C-12.

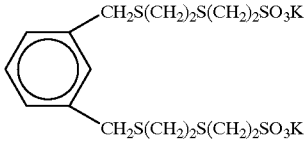

C-13.

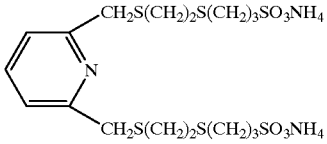

C-14.

$Na_2O_3P(CH_2)_2S(CH_2)_2S(CH_2)_2PO_3Na_2$

C-15.

$Na_2O_3P(CH_2)_2-(SCH_2CH_2)_2S(CH_2)_2PO_3Na_2$

C-16.

$Na_2O_3P(CH_2)_3-(SCH_2CH_2)_3S(CH_2)_3PO_3Na_2$

C-17.

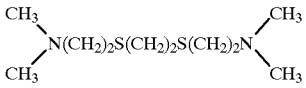

C-18.

$(CH_3)_3\overset{+}{N}(CH_2)_2S(CH_2)_2S(CH_2)_2\overset{+}{N}(CH_3)_3$ $2Cl^-$

C-19.

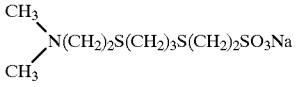

C-20.

$(CH_3)_3\overset{+}{N}(CH_2)_2S(CH_2)_2S(CH_2)_2SO_3Na$

-continued

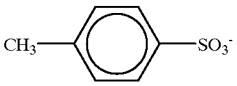

C-21.

$H_2N(CH_2)_2S(CH_2)_2S(CH_2)_2NH_2$

C-22.

$H_2NO_2S(CH_2)_2S(CH_2)_2S(CH_2)_2SO_2NH_2$

C-23.

$CH_3SO_2N(CH_3)(CH_2)_2NH(CH_2)_2S(CH_2)_2CONH_2$

C-24.

$CH_3S(CH_2)_3SO_2(CH_2)_3S(CH_2)_2SO_3Na$

C-25.

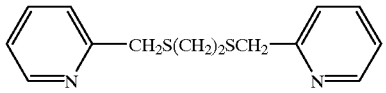

C-26.

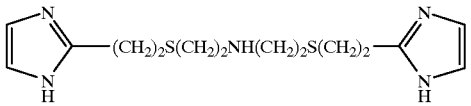

C-27.

$H_2N(=S)NH(CH_2)_2S(CH_2)_2S(CH_2)_2SO_3Na$

The compound represented by formula (C) for use in the present invention can be synthesized by methods described, for example, in JP-A-2-44355 and EP-A-458277.

Now, formula (D) is described in detail.

In formula (D), examples of the aliphatic group, the aromatic group, and the heterocyclic group represented by $X_d$, $Y_d$, $R_{d1}$, $R_{d2}$, $R_{d3}$, $R_{d4}$, $R_{d5}$, $R_{d6}$, and $R_{d7}$ are an unsubstituted or substituted alkyl group having 1 to 10 carbon atoms (e.g. methyl, ethyl, propyl, hexyl, isopropyl, carboxyethyl, sulfoethyl, aminoethyl, dimethylaminoethyl, phosphonopropyl, carboxymethyl, and hydroxyethyl), a substituted or unsubstituted alkenyl group having 2 to 10 carbon atoms (e.g. vinyl, propenyl, and 1-methylvinyl), a substituted or unsubstituted aralkyl group having 7 to 12 carbon atoms (e.g. benzyl, phenetyl, 3-carboxyphenylmethyl, and 4-sulfophenylethyl), a substituted or unsubstituted aryl group having 6 to 12 carbon atoms (e.g. phenyl, naphthyl, 4-carboxyphenyl, and 3-sulfophenyl), and a substituted or unsubstituted heterocyclic group having 1 to 10 carbon atoms (preferably a 5- or 6-membered heterocyclic group, such as pyridyl, furyl, thienyl, imidazolyl, pyrrolyl, pyrazolyl, pyrimidinyl, quinolyl, piperidyl, and pyrrolidyl).

Further, these alkyl group, alkenyl group, aralkyl group, aryl group, and heterocyclic group may be substituted. As the substituents, for example, an alkyl group, an aralkyl group, an alkenyl group, an alkynyl group, an aryl group, an alkoxy group, an aryloxy group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a halogen atom, a cyano group, and a nitro group can be mentioned, which may be further substituted. When there are two or more substituents, they are the same or different.

In formula (D), $X_d$ and $Y_d$ may form a ring, but they are not enolized. Examples of the ring formed by $X_d$ and $Y_d$ include an imidazoline-2-thion ring, an imidazolidine-2-thion ring, a thiazoline-2-thion ring, a thiazolidine-2-thion ring, an oxazoline-2-thion ring, an oxazolidine-2-thion ring, a pyrolidine-2-thion ring, and benzo-condensed rings of these.

However, at least one of $X_d$ and $Y_d$ in formula (D) is substituted by at least one of carboxylic acids or their salts (e.g. alkali metal salts and ammonium salts), sulfonic acids or their salts (e.g. alkali metal salts and ammonium salts), phosphonic acids or their salts (e.g. alkali metal salts and ammonium salts), amino groups (e.g. unsubstituted amino, dimethylamino, methylamino, and the hydrochloride of dimethylamino), ammonium groups (e.g. trimethylammonium and diemthybenzylammonium), and hydroxyl groups.

The cation represented by $R_{d6}$ and $R_{d7}$ in formula (D) represents a hydrogen atom, an alkali metal, ammonium, and the like.

In the present invention, in formula (D), preferably $X_d$ and $Y_d$ do not form a ring. Preferably $X_d$ and $Y_d$ each represent an alkyl group having 1 to 10 carbon atoms, a heterocyclic group having 1 to 10 carbon atoms, —$N(R_{d1})R_{d2}$ having 0 to 10 carbon atoms, —$N(R_{d3})N(R_{d4})R_{d5}$ having 0 to 10 carbon atoms, or —$OR_{d6}$ having 0 to 10 carbon atoms, each of which is substituted by at least one or two groups selected from among carboxylic acids or their salts, sulfonic acids or their salts, phosphonic acids or their salts, amino groups or ammonium groups, and hydroxyl groups, wherein $R_{d1}$, $R_{d2}$, $R_{d3}$, $R_{d4}$, $R_{d5}$, and $R_{d6}$ each represent a hydrogen atom or an alkyl group.

More preferably, in formula (D), $X_d$ and $Y_d$ each represent an alkyl group having 1 to 6 carbon atoms, —$N(R_{d1})R_{d2}$ having 0 to 6 carbon atoms, —$N(R_{d3})N(R_{d4})R_{d5}$ having 0 to 6 carbon atoms, or —$OR_{d6}$ having 0 to 6 carbon atoms, each of which is substituted by at least one or two groups selected from the group consisting of carboxylic acids or their salts, and sulfonic acids or their salts, wherein $R_{d1}$, $R_{d2}$, $R_{d3}$, $R_{d4}$, $R_{d5}$, and $R_{d6}$ each represent a hydrogen atom or an alkyl group.

Specific examples of the compound represented by formula (D) for use in the present invention are shown below, which do not limit the present invention:

D-1.

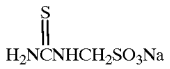

D-2.

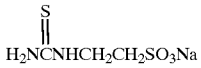

D-3.

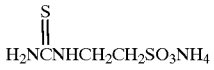

D-4.

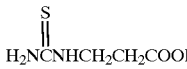

D-5.

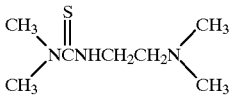

-continued

D-6.

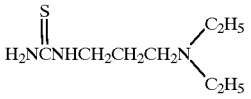

D-7.

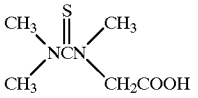

D-8.

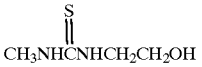

D-9.

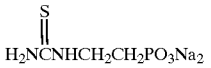

D-10.

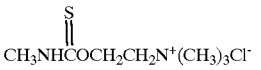

D-11.

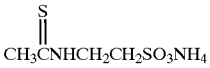

D-12.

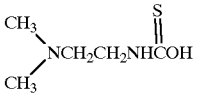

D-13.

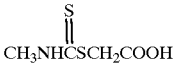

D-14.

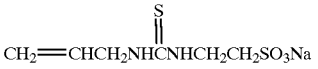

D-15.

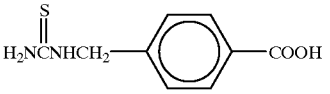

D-16.

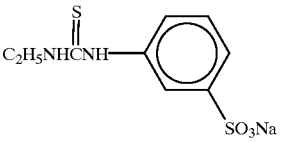

D-17.

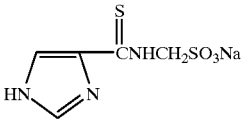

D-18.

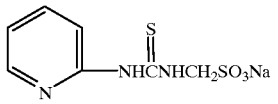

D-19.

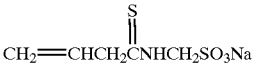

-continued

D-20.

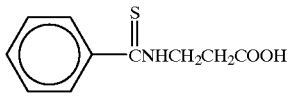

D-21.

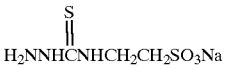

D-22.

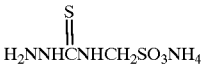

D-23.

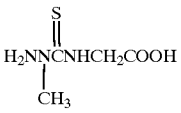

D-24.

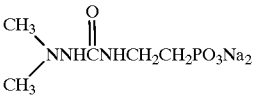

D-25.

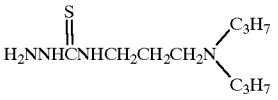

D-26.

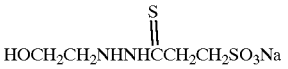

D-27.

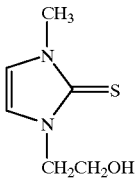

D-28.

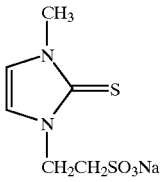

D-29.

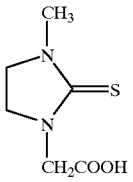

D-30.

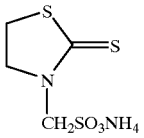

-continued

D-31.

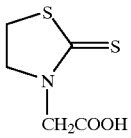

D-32.

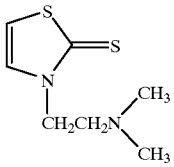

D-33.

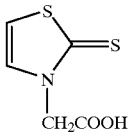

D-34.

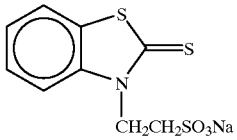

D-35.

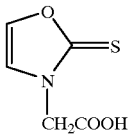

D-36.

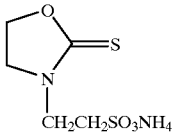

D-37.

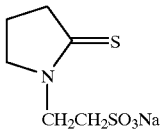

The compound represented by formula (D) for use in the present invention can be synthesized by known methods with reference being made, for example, to *Journal of Organic Chemistry* 24, 470–473 (1959); *Journal of Heterocyclic Chemistry* 4, 605–609 (1967); "Yakusi," 82, 36–45 (1962); JP-B-39-26203, JP-A-63-229449, and OLS No. 2,043,944.

Now, formula (E) for use in the present invention is described in detail.

In formula (E), preferably the aliphatic group represented by R is one having 1 to 30 carbon atoms, and particularly preferably a straight-chain, branched, or cyclic alkyl group, alkenyl group, alkynyl group, or aralkyl group having 1 to 20 carbon atoms. Examples of the alkyl group, the alkenyl group, the alkynyl group, and the aralkyl group are a methyl group, an ethyl group, an isopropyl group, a t-butyl group, an n-octyl group, an n-decyl group, an n-hexadecyl group, a cyclopropyl group, a cyclopentyl group, a cyclohexyl group, an ally group, a 2-butenyl group, a 3-pentenyl group, a propargyl group, a 3-pentynyl group, and a benzyl group.

The aryl group represented by R in formula (E) is preferably one having 6 to 30 carbon atoms, and particularly preferably a monocyclic or condensed ring aryl group having 6 to 20 carbon atoms, such as a phenyl group and a naphthyl group.

In formula (E), the heterocyclic group represented by R is preferably a 3- to 10-membered saturated or unsaturated heterocyclic group containing at least one of nitrogen atoms, oxygen atoms, and sulfur atoms. The heterocyclic group may be monocyclic or may form a condensed ring together with another aromatic ring. The heterocyclic group is more preferably a 5- or 6-membered aromatic heterocyclic group, such as a pyridyl group, an imidazolyl group, a quinolyl group, a benzimidazolyl group, a pyrimidyl group, a pyrazolyl group, an isoquinolyl group, a thiazolyl group, a thienyl group, a furyl group, and a benzothiazolyl group.

Further, each of the groups represented by R in formula (E) may be substituted. As the substituents, the following can be mentioned: a halogen atom (e.g. fluorine, chlorine, and bromine), an alkyl group (e.g. methyl, ethyl, n-propyl, isopropyl, t-butyl, n-octyl, cyclopentyl, and cyclohexyl), an alkenyl group (e.g. ally, 2-butenyl, and 3-pentenyl), an alkynyl group (e.g. propargyl and 3-pentynyl), an aralkyl group (e.g. benzyl and phenetyl), an aryl group (e.g. phenyl, naphthyl, and 4-methylphenyl), a heterocyclic group (e.g. pyridyl, furyl, imidazolyl, piperidyl, and morpholino), an alkoxy group (e.g. methoxy, ethoxy, and butoxy), an aryloxy group (e.g. phenoxy and 2-naphthyloxy), an amino group (e.g. unsubstituted amino, dimethylamino, ethylamino, and anilino), an acylamino group (e.g. acetylamino and benzoylamino), a ureido group (e.g. unsubstituted ureido, N-methylureido, and N-phenylureido), a urethane group (e.g. methoxycarbonylamino and phenoxycarbonylamino), a sulfonylamino group (e.g. methylsulfonylamino and phenylsulfonylmaino), a sulfamoyl group (e.g. unsubstituted sulfamoyl, N,N-dimethylsulfamoyl, and N-phenylsulfamoyl), a carbamoyl group (e.g. unsubstituted carbamoyl, N,N-diethylcarbamoyl, and N-phenylcarbamoyl), a sulfonyl group (e.g. mesyl and tosyl), a sulfinyl group (e.g. methylsulfinyl and phenylsulfinyl), an alkyloxycarbonyl group (e.g. methoxycarbonyl and ethoxycarbonyl), an aryloxycarbonyl group (e.g. phenoxycarbonyl), an acyl group (e.g. acetyl, benzoyl, formyl, and pivaloyl), an acyloxy group (e.g. acetoxy and benzoyloxy), a phosphoric acid amido group (e.g. N,N-diethylphosphoric acid amido), an alkylthio group (e.g. methylthio and ethylthio), an arylthio group (e.g. phenylthio), a cyano group, a sulfo group, a carboxyl group, a hydroxyl group, a mercapto group, a phosphono group, a nitro group, a sulfino group, an ammonio group (e.g. trimethylammonio), a phosphonio group, and a hydrazino group, each of which may be further substituted. When there are two or more substituents, they are the same or different. Preferable substituents are an unsubstituted amino group, a carboxyl group, a halogen atom, an alkyl group, a thiosulfonyl group, an ammonio group, a hydroxyl group, and an aryl group.

Examples of the cation group represented by M in formula (E) include an alkali metal ion (e.g. a sodium ion, a potassium ion, a lithium ion, and a cesium ion), an alkali earth metal ion (e.g. a calcium ion and a magnesium ion), an ammonium group (e.g. unsubstituted ammonium, methylammonium, trimethylammonium, tetremethylammonium, and dimethylbenzylammonium), and a guanidium group.

Preferably, in formula (E), R represents an aliphatic group or a heterocyclic group, and M represents a hydrogen atom, an alkali metal ion, or an ammonium group.

More preferably, in formula (E), R represents an aliphatic group having 1 to 6 carbon atoms, and M represents a sodium ion, a potassium ion, or an unsubstituted ammonium group.

Most preferably, in formula (E), R represents an alkyl group having 1 to 6 carbon atoms, and M represents a sodium ion or a potassium ion.

Specific examples of the compound represented by formula (E) for use in the present invention are shown below, which do not limit the present invention:

E-1.

$CH_3SO_2SNH_4$

E-2.

$CH_3SO_2SNa$

E-3.

$CH_3SO_2SK$

E-4.

$C_2H_5SO_2SNH_4$

E-5.

$C_2H_5SO_2SNa$

E-6.

$H_2NCH_2CH_2SO_2SNH_4$

E-7.

$H_2NCH_2CH_2SO_2SNa$

E-8.

$H_3N^+CH_2CH_2SO_2S^-$

E-9.

$HOCH_2CH_2SO_2SNa$

E-10.

$HOCH_2CH_2SO_2SNH_4$

E-11.

$HOOCCH_2CH_2SO_2SNa$

E-12.

$H_4NOOCCH_2CH_2SO_2SNH_4$

E-13.

$ClCH_2CH_2SO_2SNa$

E-14.

$NaSSO_2CH_2CH_2SO_2SNa$

E-15.

$H_2N(C{=}NH)NHCH_2CH_2SO_2SH$

E-16.

$CH_3CH(OH)SO_2SK$

E-17.

$CH_3CH(OH)SO_2SNH_4$

E-18.

$HOOC{-}CH(NH_2)CH_2SO_2SNa$

E-19.

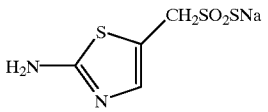

E-20.

$CH_3SO_2Li$

-continued

E-21.

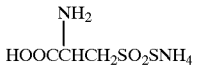

E-22.

$CH_3SO_2S^-N^+(CH_3)_4$

E-23.

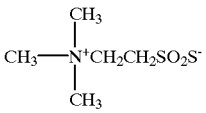

E-24.

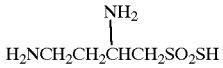

E-25.

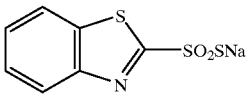

E-26.

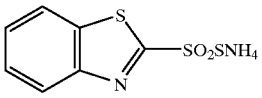

E-27.

$C_3H_7SO_2SNH_4$

E-28.

$C_3H_7SO_2SNa$

E-29.

$C_4H_9SO_2SNH_4$

E-30.

$C_6H_{13}SO_2SNa$

E-31.

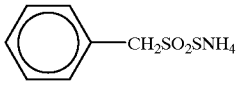

E-32.

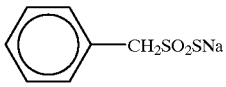

E-33.

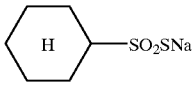

E-34.

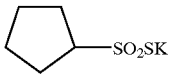

E-35.

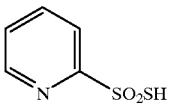

E-36.

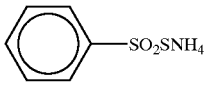

-continued

E-37.

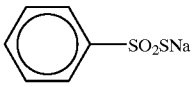

E-38.

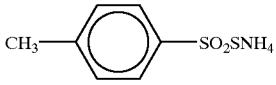

E-39.

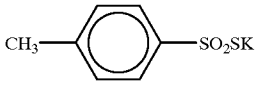

E-40.

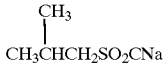

E-41.

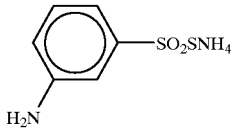

E-42.

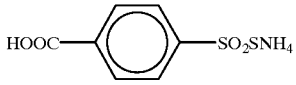

E-43.

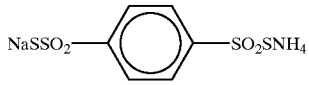

E-44.

$CH_2{=}CHCH_2SO_2Na$

The compound represented by formula (E) can be synthesized by reacting a sulfonyl chloride compound with a sulfide, such as an alkali metal sulfide and ammonium sulfide, or by reacting a sulfinic acid compound with elemental sulfur, and the synthesis of the compound of formula (E) has long been known. For example the compound represented by formula (E) can be synthesized with reference made to *Journal of Analytical Chemistry*, USSR, Vol. 20, 1701 (1950); German Patent No. 840,693 (1952), etc.

The amount of the compounds of formulae (A) to (E) for use in the present invention that are used in the bleach-fix bath is suitably generally $1\times10^{-5}$ to 10 mol/liter, and preferably $1\times10^{-3}$ to 3 mol/liter.

Herein, when the halogen composition of the silver halide emulsion in the light-sensitive material to be processed is silver iodobromide (iodine ≧2 mol % or more), preferably the amount is 0.5 to 2 mol/liter, and when the halogen composition is silver bromide, silver chlorobromide, or high-silver-chloride (silver chloride ≧80 mol % or more), preferably the amount is 0.3 to 1 mol/liter. The compound may be added directly into the tank solution, it may be supplied by being added to a replenisher, or it may be carried over from the preceding bath.

In the present invention, in addition to the compound for use in the present invention, as a fixing agent, a known fixing agent may be additionally used in the range in which the effect of the present invention is exhibited (for example, in an amount of 1/10 or less in terms of molar ratio). As that fixing agent, thiosulfates, thiocyanates, thioureas, large amounts of iodide salts, etc., can be mentioned.

Out of the compounds represented by one of formulae (A) to (E), the compounds represented by one of formulae (A), (B), and (D) are preferable, and the compounds represented by one of formulae (A-1), (B-1), and (D) are more preferable.

Further, preferably the bleach-fix solution in the present invention contains at least one compound represented by the following formula (a) or (b):

formula (a)

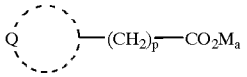

wherein Q represents a group of non-metal atoms required to form a heterocyclic ring, p is 0 or 1, and $M_a$ represents a hydrogen atom or a cation.

formula (b)

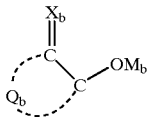

wherein $Q_b$ represents a group of non-metal atoms required to form a ring structure, $X_b$ represents an oxygen atom, a sulfur atom, or N—$R_b$, in which $R_b$ represents a hydrogen atom, an aliphatic hydrocarbon group, an aryl group, or a heterocyclic group, and $M_b$ represents a hydrogen atom or a cation.

First, the compound represented by formula (a) is described in detail. In passing, the number of carbon atoms stated below is the number of carbon atoms excluding the carbon atoms present in the substituent part.

The heterocyclic residue formed by Q is preferably a 3- to 10-membered, saturated or unsaturated heterocyclic residue containing at least one of N, O, and S atoms, which heterocyclic residue may be monocyclic or may form a condensed ring with another ring.

Preferably the heterocyclic residue is a 5- to 6-membered aromatic heterocyclic residue, more preferably a 5- to 6-membered aromatic heterocyclic residue containing a nitrogen atom, and further more preferably a 5 or 6-membered aromatic heterocyclic residue containing 1 to 2 nitrogen atoms.

Specific examples of the heterocyclic residue are, for example, 2-pyrrolidinyl, 3-pyrrolidinyl, 2-pyperidinyl, 3-piperidyl, 4-piperidyl, 2-piperazinyl, 2-morpholinyl, 3-morpholinyl, 2-thienyl, 2-furyl, 3-furyl, 2-pyrrolyl, 3-pyrrolyl, 2-imidazolyl, 4-imidazolyl, 3-pyrazolyl, 4-pyrazolyl, 2-pyridyl, 3-pyridyl, 4-pyridyl, 2-pyrazinyl, 3-pyridazinyl, 4-pydidazinyl, 3-(1,2,4-triazolyl), 4-(1,2,3-triazolyl), 2-(1,3,5-triazinyl), 3-(1,2,4-triazinyl), 5-(1,2,4-triazinyl), 6-(1,2,4-triazinyl), 2-indolyl, 3-indolyl, 4-indolyl, 5-indolyl, 6-indolyl, 7-indolyl, 3-indazolyl, 4-indazolyl, 5-indazolyl, 6-indazolyl, 7-indazolyl, 2-purinyl, 6-purinyl, 8-purinyl, 2-(1,3,4-thiadiazolyl), 2-(1,3,4-oxadiazolyl), 2-quinolyl, 3-quinolyl, 4-quinolyl, 5-quinolyl, 6-quinolyl, 7-quinolyl, 8-quinolyl, 1-phthalazinyl, 5-phthalazinyl, 6-phthalazinyl, 2-naphthyridinyl, 3-naphthyridinyl, 4-naphthyridinyl, 2-quinoxalinyl, 5-quinoxalinyl, 6-quinoxalinyl, 2-quinazolinyl, 4-quinazolinyl, 5-quinazolinyl, 6-quinazolinyl, 7-quinazolinyl, 8-quinazolinyl, 3-cinnolinyl, 4-cinnolinyl, 5-cinnolinyl, 6-cinnolinyl, 7-cinnolinyl, 8-cinnolinyl, 2-pteridinyl, 4-pteridinyl, 6-pteridinyl, 7-pteridinyl, 1-acridinyl, 2-acridinyl, 3-acridinyl, 4-acridinyl, 9-acridinyl, 2-(1,10-phenanthrolinyl), 3-(1,10-phenanthrolinyl), 4-(1,10-phenanthrolinyl), 5-(1,10-phenanthrolinyl), 1-phenazinyl, 2-phenazinyl, 5-tetrazolyl, 2-thiazolyl, 4-thiazolyl, 5-thiazolyl, 2-oxazolyl, 4-oxazolyl, 5-oxazolyl, 2-thiazolidyl, 4-thiazolidyl, and 5-thiazolidinyl.

Preferably the heterocyclic residue is 2-pyrrolyl, 2-imidazolyl, 4-imidazolyl, 3-pyrazolyl, 2-pyridyl, 2-pyrazinyl, 3-pyridazinyl, 3-(1,2,4-triazolyl), 4-(1,2,3-triazolyl), 2-(1,3,5-triazinyl), 3-(1,2,4-triazinyl), 5-(1,2,4-triazinyl), 6-(1,2,4-triazinyl), 2-indolyl, 3-indazolyl, 7-indazolyl, 2-purinyl, 6-purinyl, 8-purinyl, 2-(1,3,4-thiadiazolyl), 2-(1,3,4-oxadiazolyl), 2-quinolyl, 8-quinolyl, 1-phthalazinyl, 2-quinoxalinyl, 5-quinoxalinyl, 2-quinazolinyl, 4-quinazolinyl, 8-quinazolinyl, 3-cinnolinyl, 8-cinnolinyl, 2-(1,10-phenanthrolinyl), 5-tetrazolyl, 2-thiazolyl, 4-thiazolyl, 2-oxazolyl, or 4-oxazolyl; more preferably 2-imidazolyl, 4-imidazolyl, 3-pyrazolyl, 2-pyridyl, 2-pyrazinyl, 2-indolyl, 3-indazolyl, 7-indazolyl, 2-(1,3,4-thiadiazolyl), 2-(1,3,4-oxadiazolyl), 2-quinolyl, 8-quinolyl, 2-thiazolyl, 4-thiazolyl, 2-oxazolyl, or 4-oxazolyl; further more preferably 2-imidazolyl, 4-imidazolyl, 2-pyridyl, 2-quinolyl, or 8-quinolyl; particularly preferably 2-imidazolyl, 4-imidazolyl, 2-pyridyl, or 2-quinolyl; and most preferably 2-pyridyl.

The heterocyclic residue may have, in addition to $(CH_2)_pCO_2Ma$, another substituent, and examples of the substituent include an alkyl group (preferably an alkyl group having 1 to 12 carbon atoms, more preferably 1 to 6 carbon atoms, and particularly preferably 1 to 3 carbon atoms, such as methyl and ethyl), an aralkyl group (preferably an aralkyl group having 7 to 20 carbon atoms, more preferably 7 to 15 carbon atoms, and particularly preferably 7 to 11 carbon atoms, such as phenylmethyl and phenylethyl), an alkenyl group (preferably an alkenyl group having 2 to 12 carbon atoms, more preferably 2 to 6 carbon atoms, and particularly preferably 2 to 4 carbon atoms, such as allyl), an alkynyl group (preferably an alkynyl group having 2 to 12 carbon atoms, more preferably 2 to 6 carbon atoms, and particularly preferably 2 to 4 carbon atoms, such as propargyl), an aryl group (preferably an aryl group having 6 to 20 carbon atoms, more preferably 6 to 15 carbon atoms, and particularly preferably 6 to 10 carbon atoms, such as phenyl and p-methylphenyl), an amino group (preferably an amino group having 0 to 20 carbon atoms, more preferably 0 to 10 carbon atoms, and particularly preferably 0 to 6 carbon atoms, such as amino, methylamino, dimethylamino, and diethylamino), an alkoxy group (preferably an alkoxy group having 1 to 8 carbon atoms, more preferably 1 to 6 carbon atoms, and particularly preferably 1 to 4 carbon atoms, such as methoxy and ethoxy), an aryloxy group (preferably an aryloxy group having 6 to 12 carbon atoms, more preferably 6 to 10 carbon atoms, and particularly preferably 6 to 8 carbon atoms, such as phenyloxy), an acyl group (preferably an acyl group having 1 to 12 carbon atoms, more preferably 2 to 10 carbon atoms, and particularly preferably 2 to 8 carbon atoms, such as acetyl), an alkoxycarbonyl group (preferably an alkoxycarbonyl group having 2 to 12 carbon atoms, more preferably 2 to 10 carbon atoms, and particularly preferably 2 to 8 carbon atoms, such as methoxycarbonyl), an acyloxy group (preferably an acyloxy group having 1 to 12 carbon atoms, more preferably 2 to 10 carbon atoms, and particularly preferably 2 to 8 carbon atoms, such as acetoxy), an acylamino group (preferably an acylamino having 1 to 10 carbon atoms, more preferably 2 to 6 carbon atoms, and particularly preferably 2 to 4 carbon atoms, such as acetylamino), a sulfonylamino group (preferably a sulfonylamino group having 1 to 10 carbon atoms, more preferably 1 to 6 carbon atoms, and particularly preferably 1 to 4 carbon atoms, such as methanesulfonylamino), a sulfamoyl group (preferably a sulfamoyl group having 0 to 10 carbon atoms, more preferably 0 to 6 carbon atoms, and particularly preferably 0 to 4 carbon atoms, such as sulfamoyl and methylsulfamoyl), a carbamoyl group (preferably a carbamoyl group having 1 to 10 carbon atoms, more preferably 1 to 6 carbon atoms, and particularly preferably 1 to 4 carbon atoms, such as carbamoyl and methylcarbamoyl), an alkylthio group (preferably an alkylthio group having 1 to 8 carbon atoms, more preferably 1 to 6 carbon atoms, and particularly preferably 1 to 4 carbon atoms, such as methylthio and ethylthio), an arylthio group (preferably an arylthio group having 6 to 20 carbon atoms, more preferably 6 to 10 carbon atoms, and particularly preferably 6 to 8 carbon atoms, such as phenylthio), a sulfonyl group (preferably a sulfonyl group having 1 to 8 carbon atoms, more preferably 1 to 6 carbon atoms, and particularly preferably 1 to 4 carbon atoms, such as methanesulfonyl), a sulfinyl group (preferably a sulfinyl group having 1 to 8 carbon atoms, more preferably 1 to 6 carbon atoms, and particularly preferably 1 to 4 carbon atoms, such as methanesulfinyl), a ureido group, a hydroxyl group, a halogen atom (e.g. fluorine, chlorine, bromine, and iodine), a cyano group, a sulfo group, a carboxyl group, a nitro group, a hydroxamic acid group, a mercapto group, and a heterocyclic group (e.g. Imidazolyl and pyridyl).

These substituents may be further substituted. If there are two or more substituents, they are the same or different. Preferable substituents are an alkyl group, an amino group, an alkoxy group, a carboxyl group, a hydroxyl group, a halogen atom, a cyano group, a nitro group, and a mercapto group; more preferably an alkyl group, an amino group, an alkoxy group, a carboxyl group, a hydroxyl group, and a halogen atom; further more preferably an amino group, a carboxyl group, a hydroxyl group; and particularly preferably a carboxyl group.

p is 0 or 1, and preferably 0.

The cation represented by Ma includes organic cations and inorganic cations, such as an alkali metal ion (e.g. $Li^+$, $Na^+$, $K^+$, and $Cs^+$), an alkali earth metal ion (e.g. $Ca^{+2}$ and $Mg^{+2}$), an ammonium (e.g. ammonium and tetraethylammonium), pyridinium, and phosphonium (e.g. tetrabutylphosphonium and tetraphenylphosphonium).

Out of the compounds represented by formula (a), compounds represented by the following formula (a-a) are preferable:

formula (a-a)

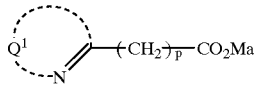

wherein p and Ma have the same meanings as those in formula (a), and $Q^1$ represents a group of non-metal atoms required to form a nitrogen-containing heterocyclic ring.

The nitrogen-containing heterocyclic residue formed by $Q^1$ is preferably a 3- to 10-membered saturated or unsaturated heterocyclic residue containing at least one nitrogen atom, which may be monocyclic or may form a condensed ring with another ring.

Preferably the nitrogen-containing heterocyclic residue is a 5- to 6-membered nitrogen-containing aromatic heterocyclic residue, and more preferably a 5- to 6-membered nitrogen-containing aromatic heterocyclic residue containing 1 to 2 nitrogen atoms.

Specific examples of the nitrogen-containing heterocyclic residue are 2-pyrrolidinyl, 3-pyrrolidinyl, 2-piperidinyl, 3-piperidyl, 4-piperidyl, 2-piperazinyl, 2-morpholinyl, 3-morpholinyl, 2-pyrrolyl, 3-pyrrolyl, 2-imidazolyl, 4-imidazolyl, 3-pyrazolyl, 4-pyrazolyl, 2-pyridyl, 3-pyridyl, 4-pyridyl, 2-pyrazinyl, 3-pyridazinyl, 4-pyridazinyl, 3-(1,2,4-triazolyl), 4-(1,2,3-triazolyl), 2-(1,3,5-triazinyl), 3-(1,2,4-triazinyl), 5-(1,2,4-triazinyl), 6-(1,2,4-triazinyl), 2-indolyl, 3-indolyl, 4-indolyl, 5-indolyl, 6-indolyl, 7-indolyl, 3-indazolyl, 4-indazolyl, 5-indazolyl, 6-indazolyl, 7-indazolyl, 2-purinyl, 6-purinyl, 8-purinyl, 2-(1,3,4-thiadiazolyl), 2-(1,3,4-oxadiazolyl), 2-quinolyl, 3-quinolyl, 4-quinolyl, 5-quinolyl, 6-quinolyl, 7-quinolyl, 8-quinolyl, 1-phthalazinyl, 5-phthalazinyl, 6-phthalazinyl, 2-naphthyridinyl, 3-naphthyridinyl, 4-naphthyridinyl, 2-quinoxalinyl, 5-quinoxalinyl, 6-quinoxalinyl, 2-quinazolinyl, 4-quinazolinyl, 5-quinazolinyl, 6-quinazolinyl, 7-quinazolinyl, 8-quinazolinyl, 3-cinnolinyl, 4-cinnolinyl, 5-cinnolinyl, 6-cinnolinyl, 7-cinnolinyl, 8-cinnolinyl, 2-pteridinyl, 4-pteridinyl, 6-pteridinyl, 7-pteridinyl, 1-acridinyl, 2-acridinyl, 3-acridinyl, 4-acridinyl, 9-acridinyl, 2-(1,10-phenanthrolinyl), 3-(1,10-phenanthrolinyl), 4-(1,10-phenanthrolinyl), 5-(1,10-phenanthrolinyl), 1-phenazinyl, 2-phenazinyl, 5-tetrazolyl, 2-thiazolyl, 4-thiazolyl, 5-thiazolyl, 2-oxazolyl, 4-oxazolyl, 5-oxazolyl, 2-thiazolidinyl, 4-thiazolidyl, and 5-thiazolidinyl; and preferably the nitrogen-containing heterocyclic residue is 2-pyrrolyl, 2-imidazolyl, 4-imidazolyl, 3-pyrazolyl, 2-pyridyl, 2-pyrazinyl, 3-pyridazinyl, 3-(1,2,4-triazolyl), 4-(1,2,3-triazolyl), 2-(1,3,5-triazinyl), 3-(1,2,4-triazinyl), 5-(1,2,4-triazinyl), 6-(1,2,4-triazinyl), 2-indolyl, 3-indazolyl, 7-indazolyl, 2-purinyl, 6-purinyl, 8-purinyl, 2-(1,3,4-thiadiazolyl), 2-(1,3,4-oxadiazolyl), 2-quinolyl, 8-quinolyl, 1-phthalazinyl, 2-quinoxalinyl, 5-quinoxalinyl, 2-quinazolinyl, 4-quinazolinyl, 8-quinazolinyl, 3-cinnolinyl, 8-cinnolinyl, 2-(1,10-phenanthrolinyl), 5-tetrazolyl, 2-thiazolyl, 4-thiazolyl, 2-oxazolyl, or 4-oxazolyl; more preferably 2-imidazolyl, 4-imidazolyl, 3-pyrazolyl, 2-pyridyl, 2-pyrazinyl, 2-indolyl, 3-indazolyl, 7-indazolyl, 2-(1,3,4-thiadiazolyl), 2-(1,3,4-oxadiazolyl), 2-quinolyl, 8-quinolyl, 2-thiazolyl, 4-thiazolyl, 2-oxazolyl, or 4-oxazolyl; further more preferably 2-imidazolyl, 4-imidazolyl, 2-pyridyl, 2-quinolyl, or 8-quinolyl; particularly preferably 2-imidazolyl, 4-imidazolyl, 2-pyridyl, or 2-quinolyl, and most preferably 2-pyridyl.

The nitrogen-containing heterocyclic residue may have, in addition to $(CH_2)_pCO_2Ma$, another substituent, and examples of the substituent include those substituents of the heterocyclic group formed by Q in formula (a), and preferable substituents are also those preferable substituents of the heterocyclic group formed by Q in formula (a).

p and Ma have the same meanings as those of formula (a), and their preferable ranges are also the same as those of formula (a). Out of the compounds represented by formula (a-a), preferable ones are those represented by the following formula (a-b):

formula (a-b)

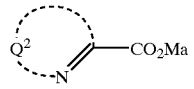

wherein Ma has the same meaning as that of formula (a), $Q^2$ represents a group of atoms required to form a 5- or 6-membered nitrogen-containing heterocycle, which may be substituted by an alkyl group, an amino group, an alkoxy group, a carboxyl group, a hydroxyl group, a halogen atom, a cyano group, a nitro group, or a mercapto group.

Out of the compounds represented by formula (a-b), more preferable ones are those represented by the following formula (a-c):

Formula (a-c)

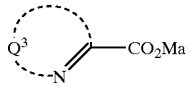

wherein Ma has the same meaning as that of formula (a), $Q^3$ represent a group of atoms required to form a pyridine ring or an imidazole ring, which may be substituted by an alkyl group, an amino group, an alkoxy group, a carboxyl group, a hydroxyl group, a halogen atom, a cyano group, a nitro group, or a mercapto group.

Specific examples of the compound represented by formula (a) are shown below, which do not limit the present invention:

a-1

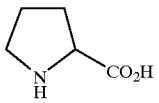

a-2

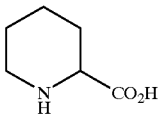

a-3

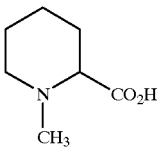

a-4

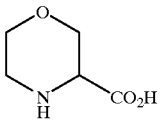

a-5

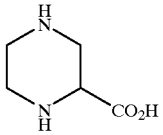

a-6

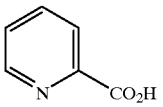

a-7

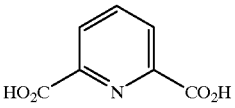

-continued a-8

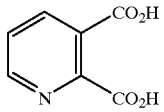

a-9

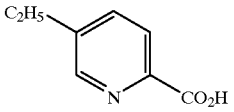

a-10

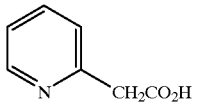

a-11

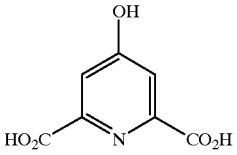

a-12

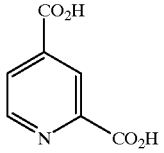

a-13

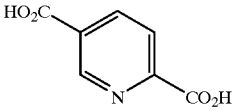

a-14

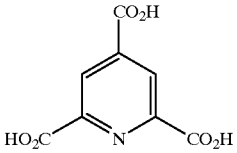

a-15

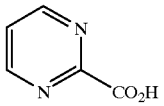

a-16

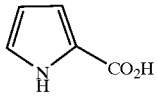

a-17

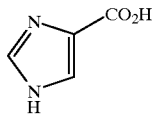

-continued
a-18
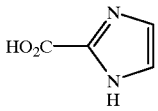
a-19
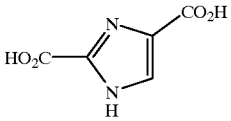
a-20
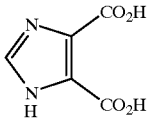
a-21
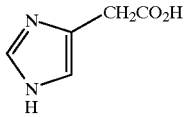
a-22
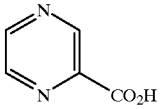
a-23
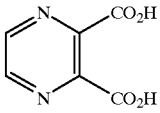
a-24
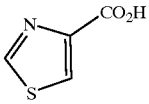
a-25
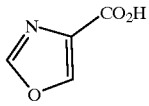
a-26
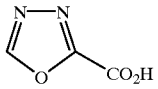
a-27
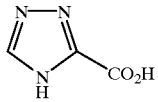
a-28
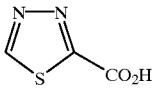
a-29
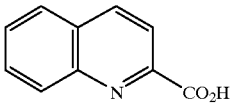
-continued
a-30
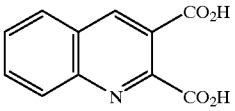
a-31
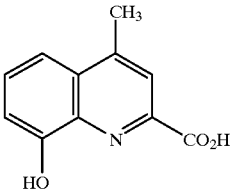
a-32
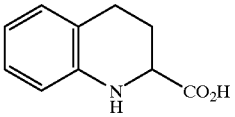
a-33
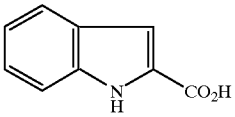
a-34
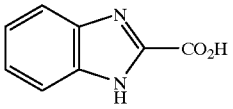
a-35
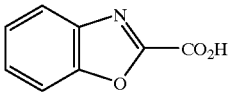
a-36
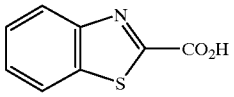
a-37
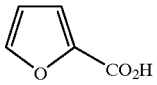
a-38
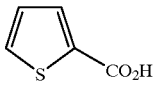
a-39
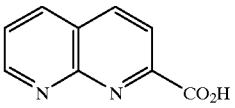
a-40
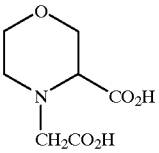

-continued
a-41
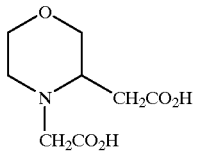
a-42
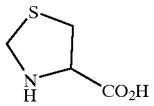
a-43
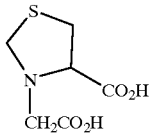
a-44
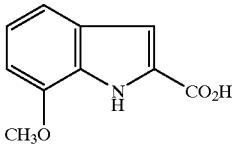
a-45
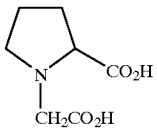
a-46
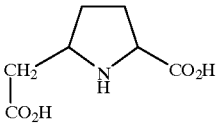
a-47
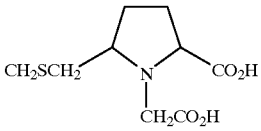
a-48
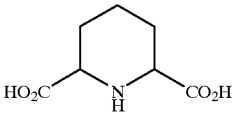
a-49
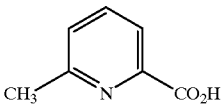
a-50
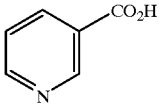
-continued
a-51
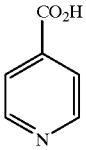
a-52
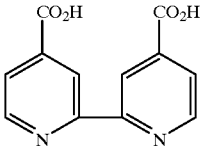
a-53
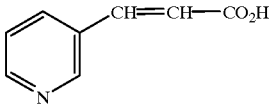
a-54
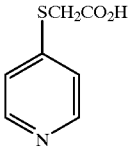
a-55
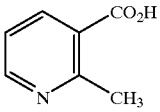
a-56
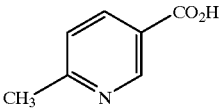
a-57
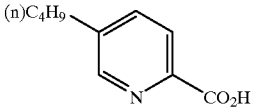
a-58
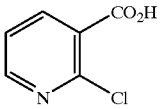
a-59
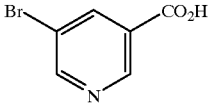
a-60
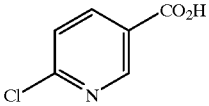
a-61
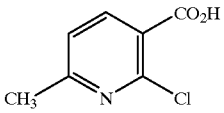

-continued
a-62
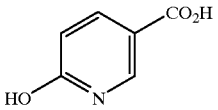
a-63
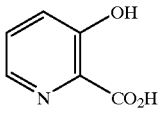
a-64
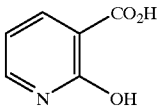
a-65
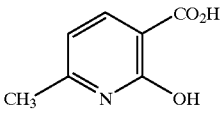
a-66
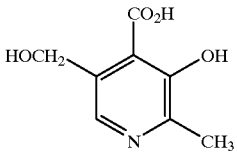
a-67
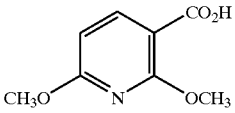
a-68
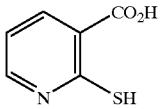
a-69
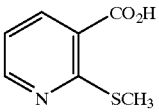
a-70
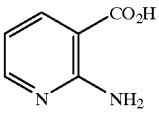
a-71
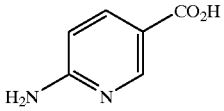
a-72
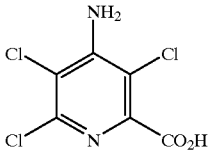
-continued
a-73
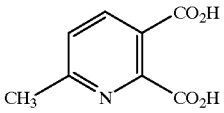
a-74
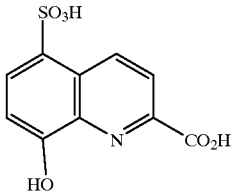
a-75
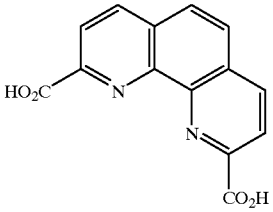
a-76
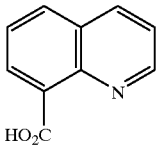
a-77
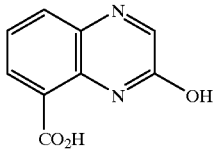
a-78
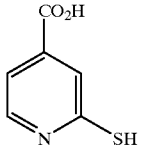
a-79
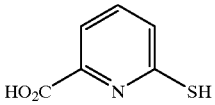
a-80
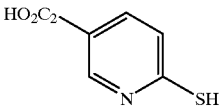
a-81
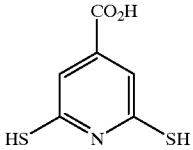
The above compounds may be used in the form of ammonium salts, alkali metal salts, or the like.
The compound represented by formula (a) can be synthesized in accordance with methods described, for example, in

*Organic Syntheses Collective Volume* 3, page 740, and the compound can also be one that is commercially available.

Out of the above exemplified compounds, preferable ones are compounds of (a-6), (a-7), (a-8), (a-13), (a-14), (a-20), (a-22), (a-29), and (a-49), with particular preference given to compound (a-7).

Next, the compound represented by formula (b) is described in detail.

The ring structure formed by $Q_b$ is preferably a 4- to 10-membered saturated or unsaturated ring containing at least one of C, N, O, or S atoms, which may be monocyclic or may form a condensed ring with another ring. Preferably the ring structure formed by $Q_b$ is a 5-membered to 7-membered unsaturated ring, and more preferably a 5- or 6-membered unsaturated ring.

Specific examples of the ring structure formed by $Q_b$ are cyclobutane, cyclobutene, cyclopentane, cyclopentene, cyclohexane, cyclohexene, cycloheptane, cycloheptene, cyclopentadiene, 1,3-cyclohexadiene, 1,4-cyclohexadiene, 1,3-cycloheptadiene, 1,5-cycloheptadiene, 1,3,5-cycloheptatriene, 2H-pyran, 4H-pyran, 2H-chromene, 4H-chromene, 2H-pyrrole, 3H-pyrrole, 2-pyrroline, 3-pyrazoline, 3H-indole, 4H-quinolizine, 2H-furo[3,2-b]pyran, 2,3-dihydrofuran, 2,5-dihydrofuran, 3,4-dihydro-2H-pyran, 5,6-dihydro-2H-pyran, 5H-thiophene, 1,2-dihydropyridine, 1,4-dihydropyridine, 2H-thiopyran, 4H-thiopyran, 3,4-dihydro-2H-thiopyran, and 5,6-dihydro-2H-thiopyran; and preferably the ring structure formed by $Q_b$ is cyclopentene, cyclohexene, 2H-pyran, 4H-pyran, 2H-chromene, 4H-chromene, 1,2-dihydropyridine, or 1,4-dihyropyridine; more preferably 2H-pyran, 4H-pyran, 1,2-dihydropyridine, or 1,4-dihydropyridine; further more preferably 2H-pyran or 4H-pyran, and particularly preferably 4H-pyran.

The ring formed by $Q_b$ may be substituted, and examples of the substituent include an alkyl group (preferably having 1 to 8 carbon atoms, more preferably 1 to 6 carbon atoms, and particularly preferably 1 to 4 carbon atoms, such as methyl and ethyl), an alkenyl group (preferably having 2 to 8 carbon atoms, more preferably 2 to 6 carbon atoms, and particularly preferably 2 to 4 carbon atoms, such as vinyl and allyl), an alkynyl group (preferably having 2 to 8 carbon atoms, more preferably 2 to 6 carbon atoms, and particularly preferably 2 to 4 carbon atoms, such as propargyl), an aryl group (preferably having 6 to 12 carbon atoms, more preferably 6 to 10 carbon atoms, and particularly preferably 6 to 8 carbon atoms, such as phenyl and p-methylphenyl), an alkoxy group (preferably having 1 to 8 carbon atoms, more preferably 1 to 6 carbon atoms, and particularly preferably 1 to 4 carbon atoms, such as methoxy and ethoxy), an aryloxy group (preferably having 6 to 12 carbon atoms, more preferably 6 to 10 carbon atoms, and particularly preferably 6 to 8 carbon atoms, such as phenyloxy), an acyl group (preferably having 1 to 12 carbon atoms, more preferably 2 to 10 carbon atoms, and particularly preferably 2 to 8 carbon atoms, such as acetyl), an alkoxycarbonyl group (preferably having 2 to 12 carbon atoms, more preferably 2 to 10 carbon atoms, and particularly preferably 2 to 8 carbon atoms, such as methoxycarbonyl), an acyloxy group (preferably having 1 to 12 carbon atoms, more preferably 2 to 10 carbon atoms, and particularly preferably 2 to 8 carbon atoms, such as acetoxy), an acylamino group (preferably having 1 to 10 carbon atoms, more preferably 2 to 6 carbon atoms, and particularly preferably 2 to 4 carbon atoms, such as acetylamino), a sulfonylamino group (preferably having 1 to 10 carbon atoms, more preferably 1 to 6 carbon atoms, and particularly preferably 1 to 4 carbon atoms, such as methanesulfonylamino), a sulfamoyl group (preferably having 0 to 10 carbon atoms, more preferably 0 to 6 carbon atoms, and particularly preferably 0 to 4 carbon atoms, such as sulfamoyl and methylsulfamoyl), a carbamoyl group (preferably having 1 to 10 carbon atoms, more preferably 1 to 6 carbon atoms, and particularly preferably 1 to 4 carbon atoms, such as carbamoyl and methylcarbamoyl), an alkylthio group (preferably having 1 to 8 carbon atoms, more preferably 1 to 6 carbon atoms, and particularly preferably 1 to 4 carbon atoms, such as methylthio and ethylthio), a sulfonyl group (preferably having 1 to 8 carbon atoms, more preferably 1 to 6 carbon atoms, and particularly preferably 1 to 4 carbon atoms, such as methanesulfonyl), a sulfinyl group (preferably having 1 to 8 carbon atoms, more preferably 1 to 6 carbon atoms, and particularly preferably 1 to 4 carbon atoms, such as methanesulfinyl), a hydroxyl group, a halogen atom (e.g. fluorine, chlorine, bromine, and iodine), a cyano group, a sulfo group, a carboxyl group, a nitro group, and a heterocyclic group (e.g. imidazolyl and pyridyl). These substituents may be further substituted. If there are two or more substituents, they are the same or different. Preferable substituents are a substituted or unsubstituted alkyl group, a hydroxyl group, and a carboxyl group, and more preferably a methyl group, an ethyl group, a hydroxymethyl group, a hydroxyethyl group, and a carboxyl group.

$X_b$ represents an oxygen atom, a sulfur atom, or N—$R_b$, in which $R_b$ represents a hydrogen atom, an aliphatic hydrocarbon group, an aryl group, or a heterocyclic group.

The aliphatic hydrocarbon group represented by $R_b$ is preferably a straight-chain, branched, or cyclic alkyl group (preferably having 1 to 12 carbon atoms, more preferably 1 to 10 carbon atoms, and further more preferably 1 to 8 carbon atoms), alkenyl group (preferably having 2 to 12 carbon atoms, more preferably 2 to 10 carbon atoms, and further more preferably 2 to 7 carbon atoms), or alkynyl group (preferably having 2 to 12 carbon atoms, more preferably 2 to 10 carbon atoms, and further more preferably 2 to 7 carbon atoms), each of which may be substituted.

Examples of the substituent include those mentioned as examples of the substituent that may be possessed by the ring formed by $Q_b$. Preferably as the substituent of the aliphatic carboxylic hydrocarbon group represented by $R_b$, can be mentioned an alkoxy group, a carboxyl group, a hydroxyl group, and a sulfo group, and more preferably a carboxyl group and a hydroxyl group.

Preferably as the aliphatic hydrocarbon group represented by $R_b$, can be mentioned an alkyl group, more preferably a chain alkyl group, further more preferably methyl, ethyl, carboxymethyl, 1-carboxyethyl, 2-carboxyethyl, hydroxymethyl, 2-hydroxyethyl, methoxymethyl, and sulfomethyl, and particularly preferably methyl, ethyl, and hydroxymethyl.

Preferably as the aryl group represented by $R_b$, can be mentioned a monocyclic or dicyclic aryl group having 6 to 20 carbon atoms (e.g. phenyl and naphthyl), more preferably an aryl group having 6 to 15 carbon atoms, and further more preferably an aryl group having 6 to 10 carbon atoms.

The aryl group represented by $R_b$ may be substituted, and examples of the substituent include those mentioned as examples of the substituent that may be possessed by the ring formed by $Q_b$. Preferably as the substituent of the aryl group represented by $R_b$, can be mentioned an alkyl group, an alkoxy group, a carboxyl group, a hydroxyl group, and a sulfo group, and more preferably an alkyl group, an alkoxy group, a carboxyl group, and a hydroxyl group.

Specific examples of the aryl group represented by $R_b$ are phenyl, 4-methylphenyl, 2-carboxyphenyl, 4-carboxyphenyl, and 4-methoxyphenyl.

The heterocyclic group represented by $R_b$ is preferably a 3- to 10-membered saturated or unsaturated heterocyclic group containing at least one of nitrogen atoms, oxygen atoms, and sulfur atoms, which may be monocyclic or may form a condensed ring together with another ring.

The heterocyclic group is preferably a 5- to 6-membered heterocyclic group, more preferably a 5- to 6-membered nitrogen-containing heterocyclic group, and further more preferably a 5- to 6-membered heterocyclic group containing 1 to 2 nitrogen atoms.

Specific examples of the heterocyclic group are thienyl, furyl, pyranyl, pyrrolyl, imidazolyl, pyrazolyl, isothiazolyl, isooxazolyl, thiazolyl, oxazolyl, 1,2,3-triazolyl, 1,2,4-triazolyl, 1,3,4-oxadiazolyl, 1,3,4-thiadiazolyl, pyridyl, pyrazinyl, pyrimidinyl, pyridazinyl, indorizinyl, isoindolyl, 3H-indolyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, carbazolyl, isochromanyl, chromanyl, pyrrolinyl, imidazolidinyl, imidazolinyl, pyrazolidinyl, pyrazolinyl, piperidyl, piperazinyl, indolinyl, isoindolinyl, quinuclidinyl, morpholinyl, tetrazolyl, benzimidazolyl, benzoxazolyl, benzthiazolyl, and benztriazolyl, and preferably morpholyl, pyrrolidinyl, piperidyl, imidazolyl, and pyridyl.

The heterocyclic group represented by $R_b$ may be substituted, and as examples of the substituent, those mentioned as examples of the substituent that may be possessed by the ring formed by $Q_b$ can be mentioned. Preferably the substituent of the heterocyclic group represented by $R_b$ is an alkyl group, an alkoxy group, a carboxyl group, a hydroxyl group, or a sulfo group, and more preferably an alkyl group, an alkoxy group, a carboxyl group, or a hydroxyl group.

Preferably $X_b$ is an oxygen atom or a sulfur atom, and more preferably an oxygen atom.

The cation represented by $M_b$ represents an organic or inorganic cation, such as an alkali metal (e.g. $Li^+$, $Na^+$, $K^+$, and $Cs^+$), an alkali earth metal (e.g. $Mg^{2+}$ and $Ca^{2+}$), an ammonium (e.g. ammonium, trimethylammonium, triethylammonium, tetramethylammonium, tetraethylammonium, tetrabutylammonium, and 1,2-ethanediammonium), pyridinium, imidazolium, and phosphonium (e.g. tetrabutylphosphonium). Preferably $M_b$ is a hydrogen atom, an alkali metal, or ammonium, and more preferably a hydrogen atom.

Out of the compounds represented by formula (b), preferable compounds are those represented by formula (b-a):

formula (b-a)

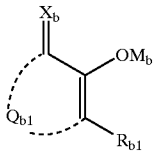

wherein $X_b$ and $M_b$ have the same meanings as those in formula (b), and preferable groups thereof are the same as those of formula (b); $Q_{b1}$ represents a group of non-metal atoms required to form a ring structure, and $R_{b1}$ represents a hydrogen atom, a carboxyl group, an aliphatic hydrocarbon group, an aryl group, or a heterocyclic group.

The ring structure formed by $Q_{b1}$ is preferably a 4- to 10-membered unsaturated ring having at least one of C, N, O, or S, which may be monocyclic or may form a condensed ring with another ring. Preferably the ring structure formed by $Q_b$ is a 5- to 7-membered unsaturated ring, and more preferably a 5- or 6-membered unsaturated ring.

Specific examples of the ring structure formed by $Q_{b1}$ are cyclobutene, cyclopentene, cyclohexene, cycloheptene, cyclopentadiene, 1,3-cyclohexadiene, 1,4-cyclohexadiene, 1,3-cycloheptadiene, 1,5-cycloheptadiene, 1,3,5-cycloheptatriene, 2H-pyran, 4H-pyran, 2H-chromene, 4H-chromene, 2H-pyrrole, 3H-pyrrole, 2-pyrroline, 3-pyrazoline, 3H-indole, 4H-quinolizine, 2H-furo[3,2-b]pyran, 2,3-dihydrofuran, 2,5-dihydrofuran, 3,4-dihydro-2H-pyran, 5,6-dihydro-2H-pyran, 5H-thiophene, 1,2-dihydropyridine, 1,4-dihydropyridine, 2H-thiopyran, 4H-thiopyran, 3,4-dihydro-2H-thiopyran, and 5,6-dihydro-2H-thiopyran; and preferably the ring structure formed by $Q_{b1}$ is cyclopentene, cyclohexene, 2H-pyran, 4H-pyran, 2H-chromene, 4H-chromene, 1,2-dihydropyridine, or 1,4-dihyropyridine; more preferably 2H-pyran, 4H-pyran, 1,2-dihydropyridine, or 1,4-dihydropyridine; further more preferably 2H-pyran or 4H-pyran, and particularly preferably 4H-pyran.

The ring formed by $Q_{b1}$ may be substituted. The substituent used can be, for example, those of the ring formed by $Q_b$.

The aliphatic hydrocarbon group, the aryl group, and the heterocyclic group represented by $R_{b1}$ have the same meanings as those of $R_b$ of formula (b), and preferable groups thereof are also the same as those of $R_b$ of formula (b).

Preferably $R_{b1}$ is a hydrogen atom or an alkyl group having 1 to 8 carbon atoms, more preferably a hydrogen atom, methyl, ethyl, 1-carboxyethyl, 2-carboxyethyl, hydroxymethyl, or 2-hydroxyethyl, and particularly preferably a hydrogen atom, methyl, ethyl, or hydroxymethyl.

Out of the compounds represented by formula (b-a), preferable compounds are those represented by formula (b-b):

formula (b-b)

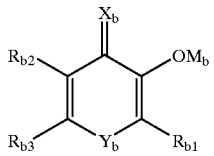

wherein $X_b$, $M_b$, and $R_{b1}$ have the same meanings as those of formula (b-a), and preferable groups thereof are the same as those of formula (b-a); $R_{b2}$ and $R_{b3}$ each have the same meanings as that of $R_{b1}$ of formula (b-a), and preferable groups thereof are the same as those of $R_{b1}$ of formula (b-a); $R_{b2}$ and $R_{b3}$ may bond together to form a ring; $Y_b$ represents an oxygen atom, a sulfur atom, SO, $SO_2$, or N—$R_y$, in which $R_y$ has the same meaning as that of $R_b$ in formula (b), and preferable ones thereof are the same as those of $R_b$ in formula (b), with preference given to an oxygen atom, a sulfur atom or N—$R_y$ and further preferably an oxygen atom.

Out of the compounds represented by formula (b-b), more preferable ones are compounds represented by formula (b-c):

formula (b-c)

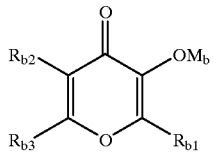

wherein $M_b$, $R_{b1}$, $R_{b2}$, and $R_{b3}$ have the same meanings as those of formula (b-b), and preferable groups thereof are the same as those of formula (b-b).

Out of the compounds represented by formula (b), preferable ones are those having 4 to 20 carbon atoms in all, and more preferable ones are those having 5 to 14 carbon atoms in all.

b-1
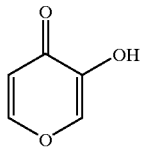
b-2
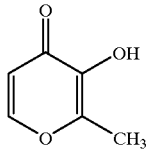
b-3
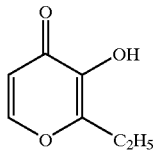
b-4
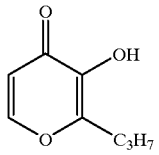
b-5
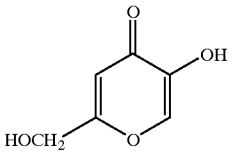
b-6
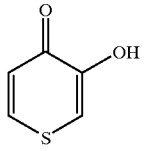
b-7
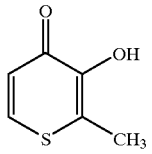
b-8
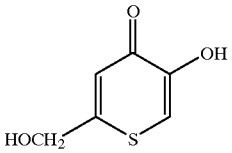
b-9
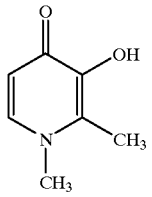
-continued
b-10
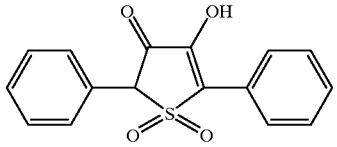
b-11
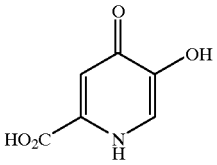
b-12
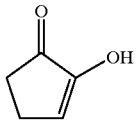
b-13
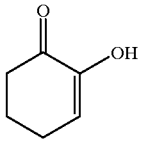
b-14
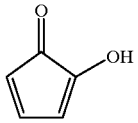
b-15
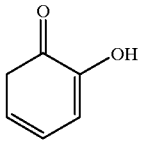
b-16
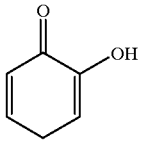
b-17
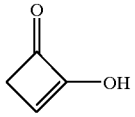
b-18
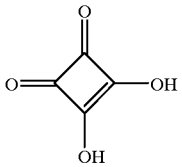
b-19
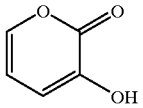

-continued
b-20
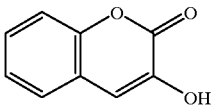
b-21
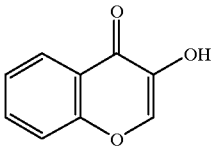
b-22
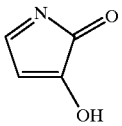
b-23
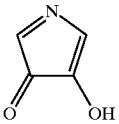
b-24
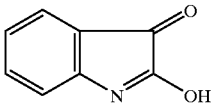
b-25
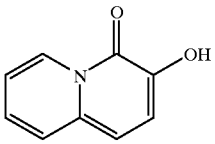
b-26
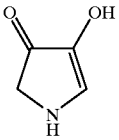
b-27
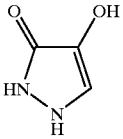
b-28
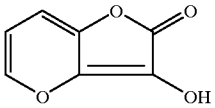
b-29
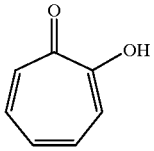
-continued
b-30
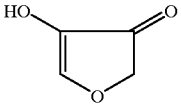
b-31
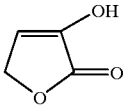
b-32
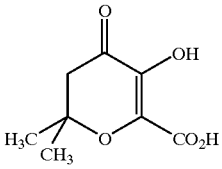
b-33
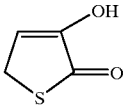
b-34
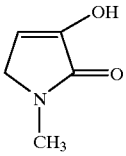
b-35
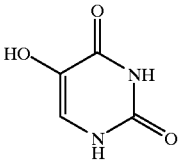
b-36
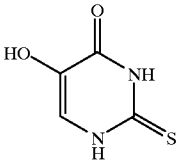
b-37
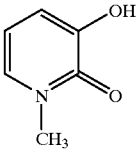
b-38
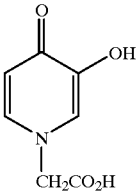

-continued b-39

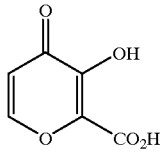

b-40

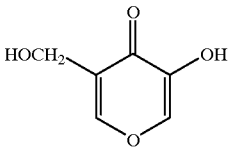

b-41

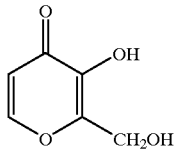

b-42

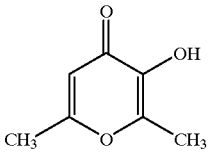

b-43

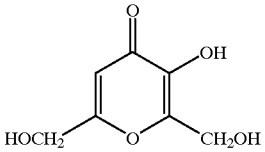

b-44

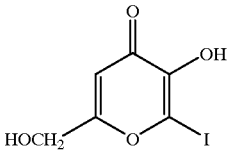

b-45

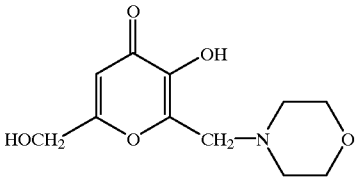

b-46

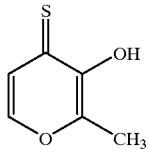

b-47

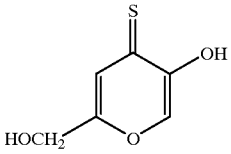

-continued b-48

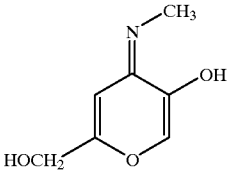

b-49

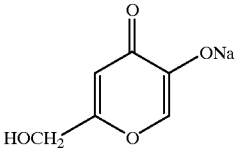

b-50

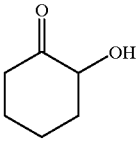

Additionally, the above compounds may be in the form of their conjugated isomers, if possible.

As the compound represented by formula (b) for use in the present invention, a commercially available one may be used, or it can be synthesized in accordance with methods described, for example, in "*Journal of the American Chemical Society*," Vol. 67, page 2276 (1945), ibid Vol. 68, page 2744 (1946), and ibid Vol. 69, page 2908 (1947).

Out of the above exemplified compounds, preferable ones are (b-1), (b-2), (b-3), (b-5), (b-21), (b-39), (b-40), (b-41), (b-42), and (b-43), and more preferable ones are (b-2), (b-3), and (b-5).

In the present invention, preferably the compound represented by formula (a) or (b) is contained in an amount of 0.001 to 0.3 mol, more preferably 0.005 to 0.2 mol, and particularly preferably 0.01 to 0.15 mol, per liter of the bleach-fix solution. Further, in the present invention, the compounds represented by formula (a) or (b) may be used singly or as a combination of two or more.

Now, the color-forming reducing agent used in the present invention is described. Generally a color-developing agent used in a silver halide color photographic light-sensitive material reduces the silver halide color photographic light-sensitive material imagewise directly or through another electron transferring agent, to produce the oxidation product of the color-developing agent, in proportion to the exposure amount. The oxidation product further reacts with a coupler, to form a dye. Generally, in this color photographic system, a p-phenylenediamine-series developing agent is contained in a developing solution, and the color-developing agent permeates the light-sensitive material in the developing process, so that the development progresses. That is, because the color-developing agent is susceptible to air oxidation, to be decomposed, the color-developing agent is supplied in the developing process in a fresh form all the time.

However, since the color-developing agent, that is the color-forming reducing agent, used in the present invention is contained in the light-sensitive material, the color-forming reducing agent is required to have such a seemingly incompatible feature that the preservation stability before and after the developing process is excellent and a high development activity is exhibited in the developing process. That is, to use a p-phenylenediamine-series developing agent as it is, which is usually used in the processing of photographic light-sensitive materials, is impossible (because of the preservation stability). On the other hand, a p-phenylenediamine-series developing agent that is designed to increase the oxidation-reduction potential for the purpose of satisfying the preservation stability, cannot exhibit a satisfactory development activity during the processing. As one proposed means of solving this problem, there is a means of using, as a color-forming reducing agent, a compound having a development activity into which a group capable of coupling split-off during the color developing process has been introduced. This color-forming reducing agent can be represented by the following formula (d-1):

$$(L)_n—D \qquad \text{formula (d-1).}$$

In formula (d-1), L represents an electron-attracting group capable of coupling split-off during the development processing, D represents a compound residue formed by removing n hydrogen atoms from a compound HnD having a development activity, and n is an integer of 1 to 3.

The color-forming reducing agent represented by formula (d-1) preferably has a structure represented by the following formula (d-2):

$$L^1L^2N—(NH)_p—(X{=}Y)_q—Z \qquad \text{formula (d-2)}$$

In formula (d-2), $L^1$ and $L^2$ each represent a hydrogen atom or an electron-attracting group capable of coupling split-off during the color development processing, with the proviso that $L^1$ and $L^2$ are not hydrogen atoms respectively simultaneously; X and Y each independently represent methine or azomethine; Z represents a hydrogen atom, a hydroxyl group, an amino group, or —$NHL^3$, in which $L^3$ represents an electron attracting group; p is an integer of 0 or 1, q is an integer of 1 to 3, and any two of $L^1$, $L^2$, X, Y, and Z may bond together to form a ring.

Preferable color-forming reducing agents represented by formula (d-2) are described in detail below. In formula (d-2), as the electron-attracting group represented by $L^1$ and $L^2$, an acyl group, a sulfinyl group, a sulfonyl group, and a phosphoryl group are preferable, with particular preference given to an acyl group and a sulfonyl group. Although $L^1$ and $L^2$ are released in the color-developing process, they may be released after or before the developing agent represented by formula (d-2) is oxidized. However, because it is preferable that the development does not progress in an unexposed part (suppression of fogging), and in order to prevent the development active species produced in the development processing from remaining unreacted in the light-sensitive material and causing colored matters (to suppress staining), preferably the developing agent used in the present invention causes development of a silver halide imagewise under basic condition, and the resulting oxidation product of the developing agent couples with a coupler to release $L^1$ and $L^2$, to form a dye. $L^1$ and $L^2$ may be released in the form of anions or radicals and may be released by the action of a nucleophilic species or a base (e.g. water, a hydroxide ion, hydrogen peroxide, a sulfite ion, and hydroxylamine) in the developing solution. Particularly in the latter case, by adding a nucleophilic species positively to the developing solution, the release of $L^1$ or $L^2$ can be accelerated, or when a compound for accelerating silver development (particularly preferably hydrogen peroxide) is added, the nucleophilicity thereof can be used to accelerate the release of $L^1$ or $L^2$.

In formula (d-2), $(X{=}Y)_q$ represents a π electron conjugated system with carbon atoms or nitrogen atoms, particularly preferably X and Y bond together to form a ring, preferably q is 2 or 3, and preferably the number of nitrogen atoms contained is 0 to 3. When $(X{=}Y)_q$ forms a ring, preferably the number of ring members is 5 or 6; as a constitutional atom of the ring, a hetero atom may be contained, and preferably the hetero atom is a nitrogen atom, an oxygen atom, or a sulfur atom, and particularly preferably a nitrogen atom. Further, $(X{=}Y)_q$ may have a condensed ring, and as the condensed ring, a benzene ring is preferable.

When p is 0, X bonded to $L^1L^2N$ can be either a carbon atom or a nitrogen atom, and when p is 1, X bonded to NH is preferably a carbon atom.

In formula (d-2), when p is 0, Z is preferably a hydroxyl group, an amino group, or $NHL^3$, and when p is 1, Z is preferably a hydrogen atom or $NHL^3$. When Z is represented by $NHL^3$, $L^3$ is preferably an acyl group, a sulfinyl group, a sulfonyl group, or a phosphoryl, and particularly preferably an acyl group or a sulfonyl group.

The color-forming reducing agent represented by formula (d-2) is preferably introduced into the light-sensitive material by a method in which the color-forming reducing agent is dissolved in a high-boiling organic solvent, and then it is dispersed and is applied, that is the so-called oil-protect system. Therefore preferably the color-forming reducing agent has a relatively large lipophilic group, generally called a ballast group, so that it can be easily dissolved in a high-boiling organic solvent and can be retained stably in the light-sensitive material. Thus, preferably this ballast group has one or more straight-chain or branched somewhat large alkyl groups, and preferably the total number of carbon atoms of these alkyl groups is 3 to 32, more preferably 6 to 22, and particularly preferably 8 to 18. The substitution position of the ballasting group may be on any of $L^1$, $L^2$, (X=Y), and Z, with preference given to $L^1$ or $L^2$.

The color-forming reducing agent represented by formula (d-2) may be substituted, so as to give a preferable pKa (acid dissociation constant) corresponding to the pH of the development processing solution to be used, and in order to adjust the absorption wavelength of the dye to be formed, the release speed of $L^1$ or $L^2$, the speed of coupling with a coupler, or the oxidation potential to the intended range. Examples of the substituent can be mentioned a halogen atom, a cyano group, a nitro group, an amino group, a carboxyl group, a sulfo group, an acyl group, an acylamino group, a carbamoyl group, a sulfonyl group, a sulfonylamino group, a sulfamoyl group, an alkyl group, an aryl group, an alkoxy group, a heterocyclic group, and an aryloxy group.

In the present invention, out of the color-forming reducing agents represented by formula (d-2), particularly preferable ones are those represented by the following formula (CH):

$$R^{11}—NHNH—X—R^{12} \qquad \text{formula (CH)}$$

wherein $R^{11}$ represents an aryl group or a heterocyclic group, $R^{12}$ represents an alkyl group, an alkenyl group, an alkynyl group, an aryl group, or a heterocyclic group, and X represents —$SO_2$—, —CO—, —COCO—, —CO—O—, —CO—$N(R^{13})$—, —COCO—O—, —COCO—N—$(R^{13})$—, or —$SO_2$—$N(R^{13})$—, in which $R^{13}$ represents a hydrogen atom or a group represented by $R^{12}$ that is mentioned above.

The color-forming reducing agent represented by formula (CH) used in the present invention is a compound characterized in that the compound undergoes, in an alkali solution, a reaction directly with an exposed silver halide and is oxidized, or an oxidation-reduction reaction with an auxiliary developing agent oxidized with an exposed silver halide and is oxidized. The compound is also characterized in that the resultant oxidation product further reacts with a dye-forming coupler, to form a dye.

The structure of the color-forming reducing agent represented by formula (CH) is described in detail below.

In formula (CH), $R^{11}$ represents an aryl group or heterocyclic group, which may be substituted. The aryl group represented by $R^{11}$ has preferably 6 to 14 carbon atoms, and examples are phenyl and naphthyl. The heterocyclic group represented by $R^{11}$ is preferably a saturated or unsaturated 5-membered, 6-membered, or 7-membered heterocyclic ring containing at least one of nitrogen, oxygen, sulfur, and selenium, to which a benzene ring or a heterocyclic ring may be condensed. Examples of the heterocyclic ring represented by $R^{11}$ are furanyl, thienyl, oxazolyl, thiazolyl, imidazolyl, triazolyl, pyrrolidinyl, benzoxazolyl, benzthiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl, and benzooxepinyl.

Examples of the substituent possessed by $R^{11}$ include, for example, an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group, and an azo group.

$R^{12}$ represents an alkyl group, an alkenyl group, an alkynyl group, an aryl group, or a heterocyclic group, each of which may be substituted.

The alkyl group represented by $R^{12}$ is a straight-chain, branched, or cyclic alkyl group having preferably 1 to 16 carbon atoms, such as methyl, ethyl, hexyl, dodecyl, 2-octyl, t-butyl, cyclopentyl, and cylooctyl. The akenyl group represented by $R^{12}$ is a chain or cyclic alkenyl group having preferably 2 to 16 carbon atoms, such as vinyl, 1-octenyl, and cyclohexenyl.

The alkynyl group represented by $R^{12}$ is an alkynyl group having preferably 2 to 16 carbon atoms, such as 1-butynyl and phenylethynyl. The aryl group and the heterocyclic group represented by $R^{12}$ include those mentioned for $R^{11}$. The substituent possessed by $R^{12}$ includes those mentioned for the substituent of $R^{11}$.

X represents —$SO_2$—, —CO—, —COCO—, —CO—O—, —CON($R^{13}$)—, —COCO—O—, —COCO—N($R^{13}$)— or —$SO_2$—N($R^{13}$)—, in which $R^{13}$ represents a hydrogen atom or a group represented by $R^{12}$ that is defined above.

Among those groups, —CO—, —CON($R^{13}$)—, and —CO—O— are preferable, and —CON($R^{13}$)— is particularly preferable for giving the particularly excellent color-forming property.

Out of the compounds represented by formula (CH), the compounds represented by formula (CH2) or (CH3) are preferable, the compounds represented by formula (CH4) or (CH5) are more preferable, the compounds represented by formula (CH6) or (CH7) are further more preferable.

formula (CH2)

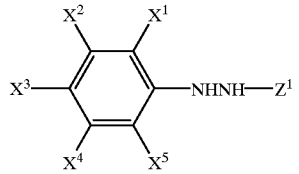

formula (CH3)

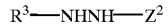

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

formula (CH4)

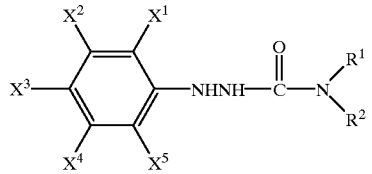

formula (CH5)

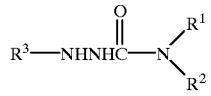

wherein $R^1$ and $R^2$ each represent a hydrogen atom or a substituent; $X^1$, $X^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

formula (CH6)

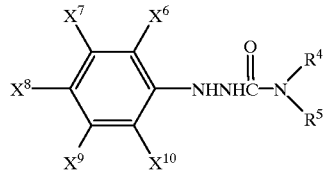

formula (CH7)

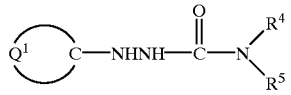

wherein $R^4$ and $R^5$ each represent a hydrogen atom or a substituent; and $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the sum of the Hammett substituent constant σp values of $X^6$, $X^8$, and $X^{10}$ and the Hammett substituent constant σm values of $X^7$ and $X^9$ is 1.20 or more but 3.80 or below. $Q^1$ represents a group of nonmetal atoms required to form a nitrogen-containing 5-membered to 8-membered heterocyclic ring together with the C.

The compounds represented by formulae (CH2) to (CH7) are described below in detail.

In formulae (CH2) and (CH3), $Z^1$ represents an acyl group, a carbamoyl group, an alkoxycarbonyl group, or an aryloxycarbonyl group, and $Z^2$ represents a carbamoyl group, an alkoxycarbonyl group, or an aryloxycarbonyl group. The acyl group preferably has 1 to 50 carbon atoms, and more preferably 2 to 40 carbon atoms. Specific examples include an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl) propanoyl group.

With respect to the case wherein $Z^1$ and $Z^2$ each represent a carbamoyl group, a description is made in detail in formulae (CH4) to (CH7).

Preferably the alkoxycarbonyl group and the aryloxycarbonyl group have 2 to 50 carbon atoms, and more preferably 2 to 40 carbon atoms. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 2-dodecyloxyphenoxycarbonyl group.

$X^1$, $X^2$, $X^3$, $X^4$, and $X^5$ each represent a hydrogen atom or a substituent. Examples of the substituent include a straight-chain or branched, chain or cyclic alkyl group having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl, and dodecyl); a straight-chain or branched, chain or cyclic alkenyl group having 2 to 50 carbon atoms (e.g. vinyl, 1-methylvinyl, and cyclohexen-1-yl); an alkynyl group having 2 to 50 carbon atoms in all (e.g. ethynyl and 1-propinyl), an aryl group having 6 to 50 carbon atoms (e.g. phenyl, naphthyl, and anthryl), an acyloxy group having 1 to 50 carbon atoms (e.g. acetoxy, tetradecanoyloxy, and benzoyloxy), a carbamoyloxy group having 1 to 50 carbon atoms (e.g. N,N-dimethylcarbamoyloxy), a carbonamido group having 1 to 50 carbon atoms (e.g. formamido, N-methylacetamido, acetamido, N-methylformamido, and benzamido), a sulfonamido group having 1 to 50 carbon atoms (e.g. methanesulfonamido, dodecansulfonamido, benzenesulfonamido, and p-toluenesulfonamido), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, and N-methyl-N-(4-methoxyphenyl) sulfamoyl), an alkoxy group having 1 to 50 carbon atoms (e.g. methoxy, propoxy, isopropoxy, octyloxy, t-octyloxy, dodecyloxy, and 2-( 2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl, and 2-hexyldecylsulfonyl), an arylsulfonyl group having 6 to 50 carbon atoms (e.g. benzenesulfonyl, p-toluenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anilino, and morpholino), a cyano group, a nitro group, a carboxyl group, a hydroxyl group, a sulfo group, a mercapto group, an alkylsulfinyl group having 1 to 50 carbon atoms (e.g. methanesulfinyl and octanesulfinyl), an arylsulfinyl having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio and naphthylthio), a ureido group having 1 to 50 carbon atoms (e.g. 3-methylureido, 3,3-dimethylureido, and 1,3-diphenylureido), a heterocyclic group having 2 to 50 carbon atoms (e.g. a 3-membered to 12-membered monocyclic ring or condensed ring having at least one hetero atom, such as nitrogen, oxygen, and sulfur, for example, 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), an acyl group having 1 to 50 carbon atoms (e.g. acetyl, benzoyl, and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl, and triphenylsilyl), and a halogen atom (e.g. a fluorine atom, a chlorine atom, and a bromine atom). The above substituents may be further substituted with a substituent, and examples of such a substituent include those mentioned above. Further, $X^1$, $X^2$, $X^3$, $X^4$, and $X^5$ may bond together to form a condensed ring. Preferably the condensed ring is a 5-membered to 7-membered ring, and more preferably a 5-membered to 6-membered ring.

The number of carbon atoms of the substituent is preferably 50 or below, more preferably 42 or below, and most preferably 34 or below, and there is preferably 1 or more carbon atom(s).

With respect to $X^1$, $X^2$, $X^3$, $X^4$, and $X^5$ in formulae (CH2) and (CH4), the sum of the Hammett substituent constant σp values of $X^1$, $X^3$, and $X^5$ and the Hammett substituent constant σm values of $X^2$ and $X^4$ is 0.80 or more but 3.80 or below. $X^6$, $X^7$, $X^8$, $X^9$, and $X^{10}$ in formula (CH6) each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, each of which may have a substituent and may bond together to form a condensed ring. Specific examples of $X^6$ through $X^{10}$ are the same as those described for $X^1$, $X^2$, $X^3$, $X^4$, and $X^5$. In formula (CH6), the sum of the Hammett substituent constant σp values of $X^6$, $X^8$, and $X^{10}$ and the Hammett substituent constant σm values of $X^7$ and $X^9$ is 1.20 or more but 3.80 or below, preferably 1.50 or more but 3.80 or below, and most preferably 1.70 or more but 3.80 or below.

Herein, if the sum of the σp values and the σm values is less than 0.80, the problem arises that the color formation is unsatisfactory, while if the sum of the σp values and the σm values is over 3.80, the synthesis and availability of the compounds themselves become difficult.

Parenthetically, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

$R^1$ and $R^2$ in formulae (CH4) and (CH5), and $R^4$ and $R^5$ in formulae (CH6) and (CH7), each represent a hydrogen atom or a substituent, and examples of the substituent are the same as those described for $X^1$, $X^2$, $X^3$, $X^4$, and $X^5$; preferably each represents a hydrogen atom, a substituted or unsubstituted alkyl group having 1 to 50 carbon atoms, a substituted or unsubstituted aryl group having 6 to 50 carbon atoms, or a substituted or unsubstituted heterocyclic group having 1 to 50 carbon atoms, and more preferably at least one of $R^1$ and $R^2$, and at least one of $R^4$ and $R^5$, are each a hydrogen atom.

In formulae (CH3) and (CH5), $R^3$ represents a heterocyclic group. Herein, a preferable heterocyclic group has 1 to 50 carbon atoms, and the heterocyclic group contains at least one hetero atom, such as a nitrogen atom, an oxygen atom, and a sulfur atom, and further the heterocyclic group is a saturated or unsaturated 3-membered to 12-membered (preferably 3-membered to 8-membered) monocyclic or condensed ring. Specific examples of the heterocyclic ring are furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole, and quinoxaline. These heterocyclic groups may have a substituent, and preferably they have one or more electron-attracting groups. Herein, the term "an electron-attracting group" means one wherein the Hammett σp value is a positive value.

When the color-forming reducing agent for use in the present invention is built in a light-sensitive material, preferably at least one of $Z^1$, $Z^2$, $R^1$ to $R^5$, and $X^1$ to $X^{10}$, has a ballasting group. Herein, a "ballasting group" means a group, having 5 to 50, preferably 8 to 40 carbon atoms, which makes the color-forming reducing agent that has a ballasting group, easily-soluble in a high-boiling organic solvent, and which makes the color-forming reducing agent immobilized.

Now, novel color-forming reducing agents used in the present invention are described specifically, but the scope of the present invention is not limited to them.

CH-1

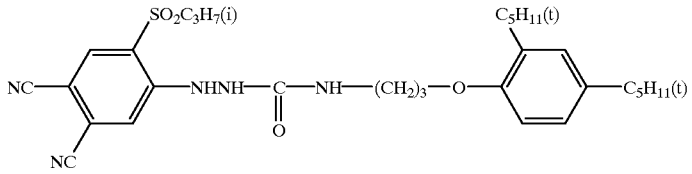

CH-2

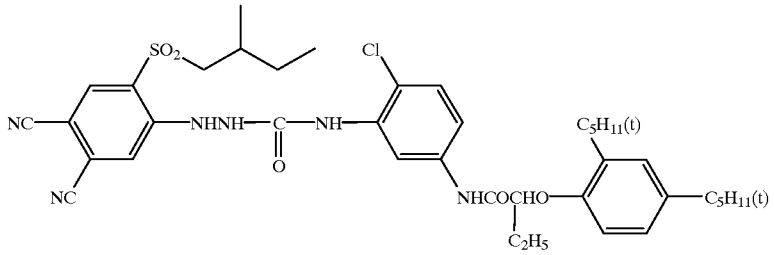

CH-3

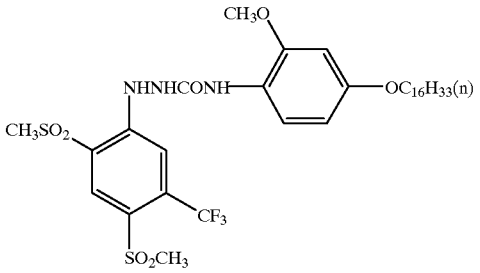

CH-4

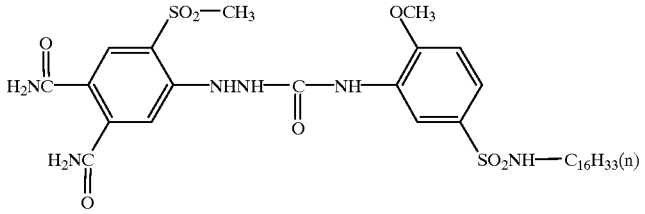

-continued
CH-5
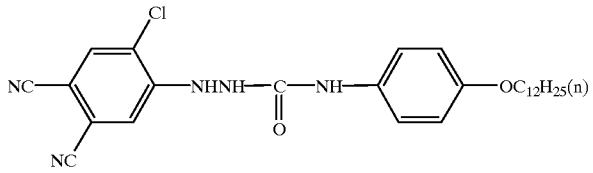
CH-6
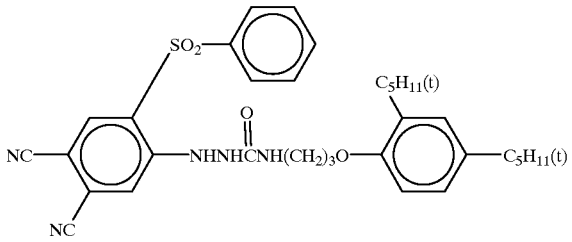
CH-7
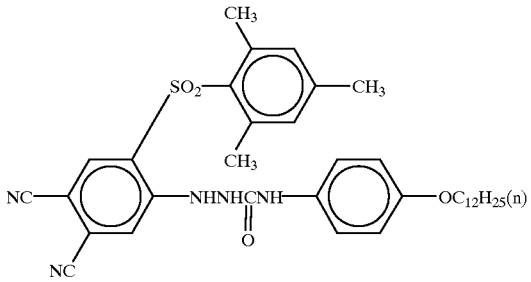
CH-8
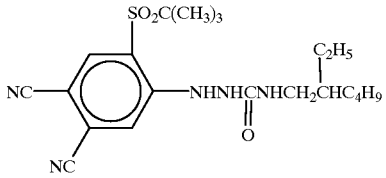
CH-9
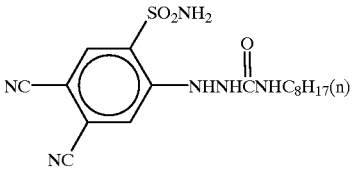
CH-10
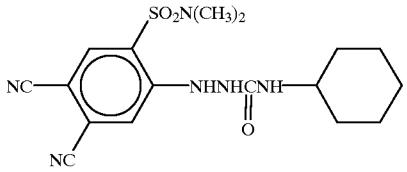
CH-11
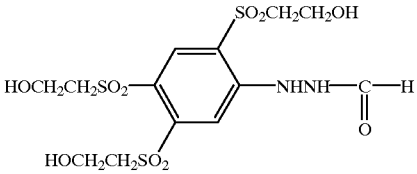
CH-12
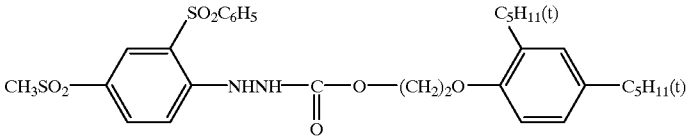
CH-13
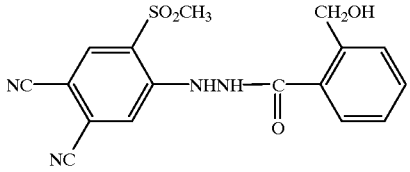
CH-14
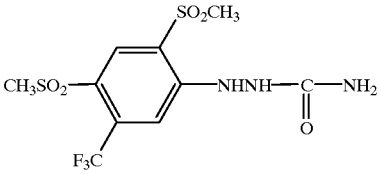

-continued
CH-15
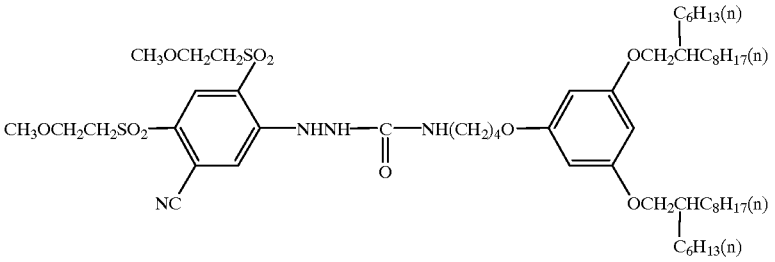
CH-16
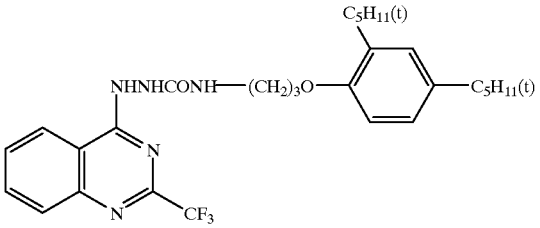
CH-17
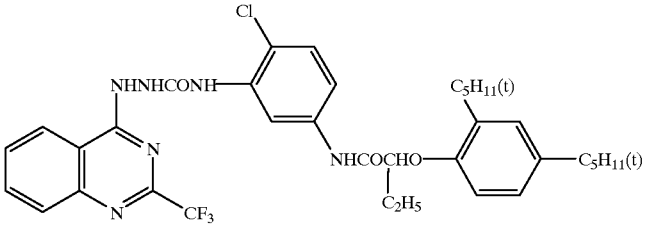
CH-18
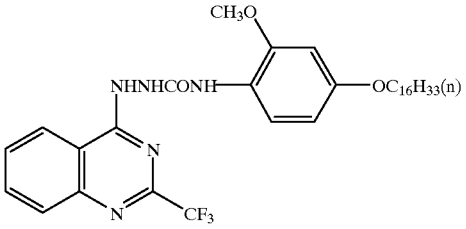
CH-19
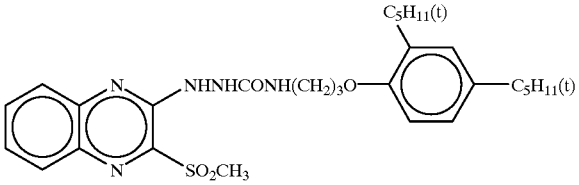
CH-20
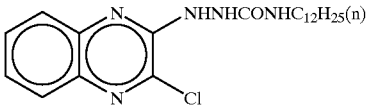
CH-21
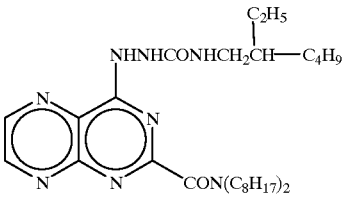

-continued
CH-22
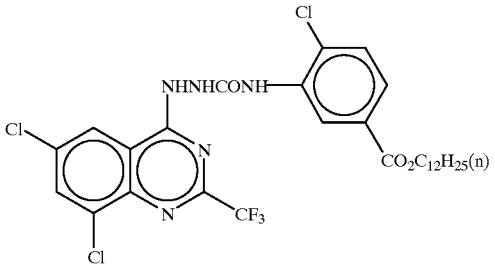
CH-23
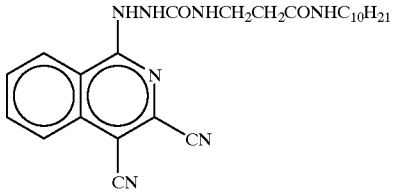
CH-24
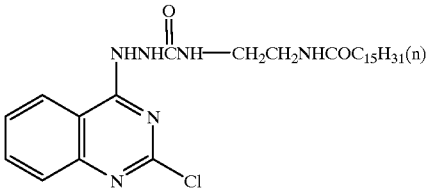
CH-25
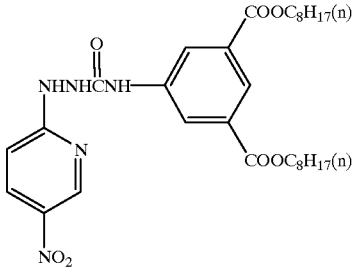
CH-26
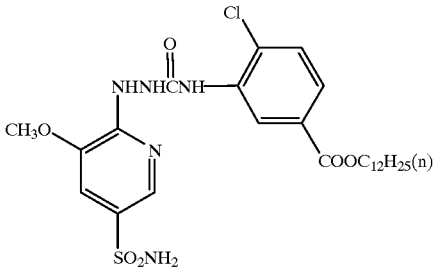
CH-27
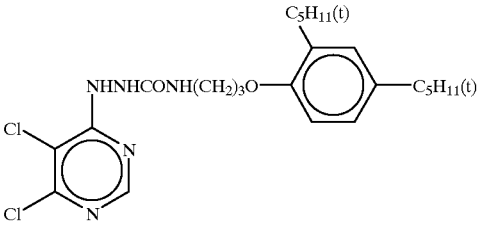
CH-28
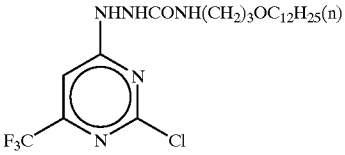
CH-29
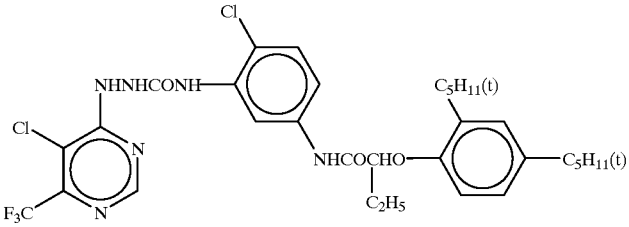
CH-30
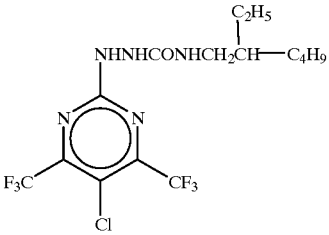

-continued
CH-31
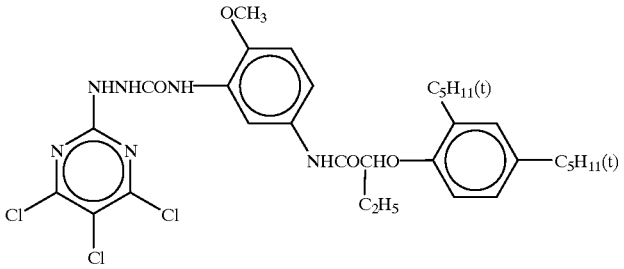
CH-32
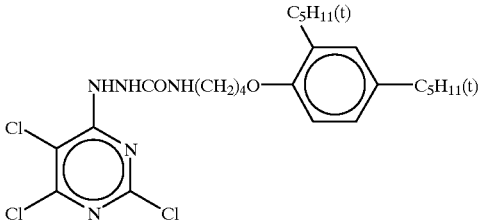
CH-33
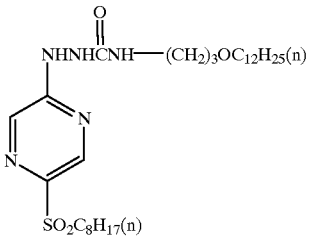
CH-34
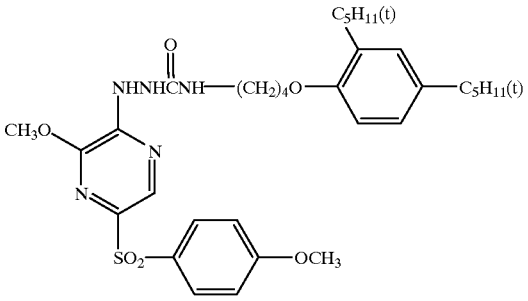
CH-35
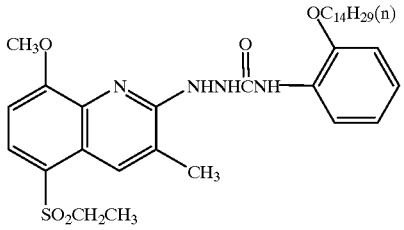
CH-36
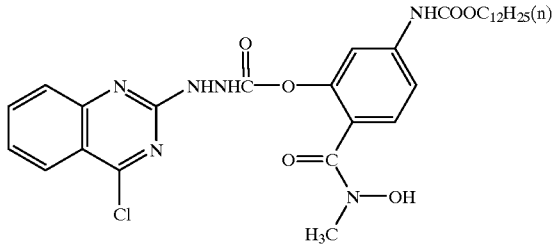

-continued
CH-37
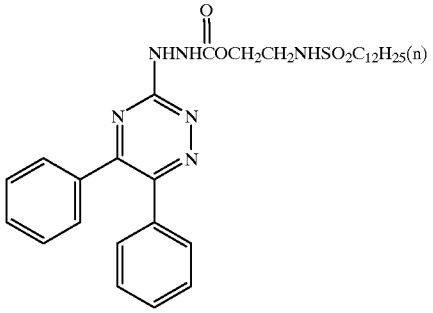
CH-38
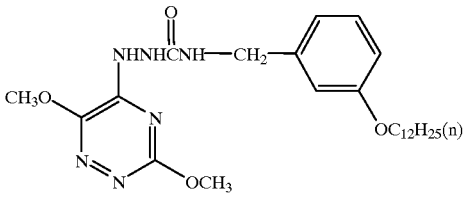
CH-39
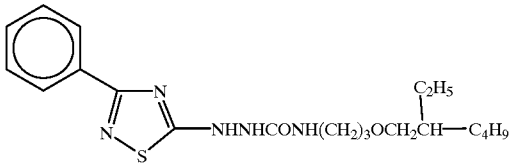
CH-40
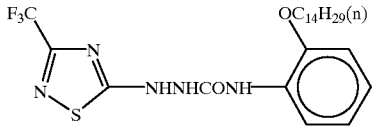
CH-41
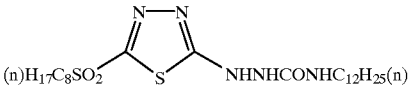
CH-42
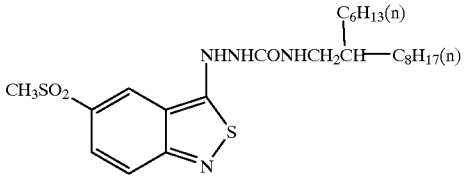
CH-43
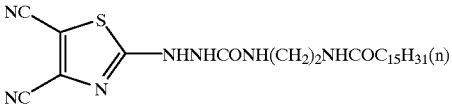
CH-44
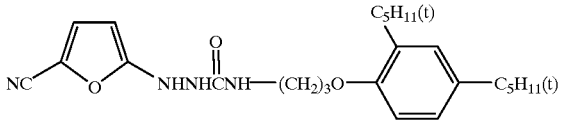
CH-45
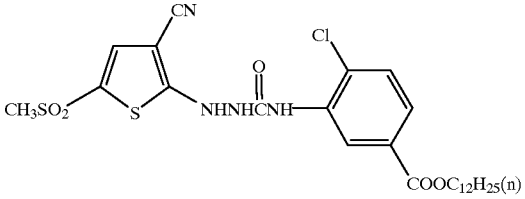
CH-46
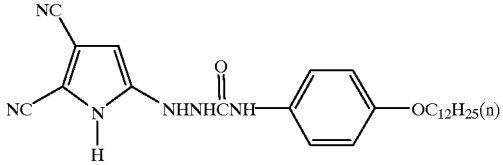
CH-47
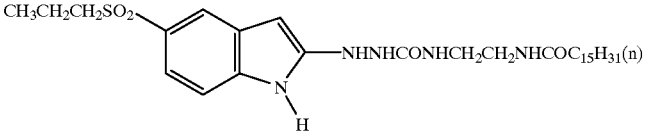
CH-48
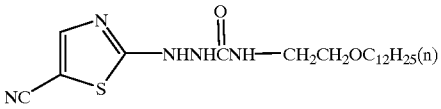
CH-49
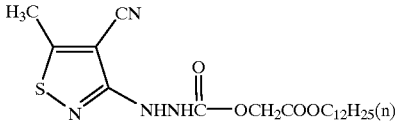
CH-50
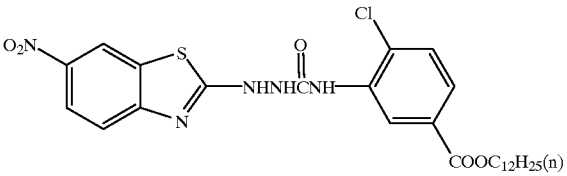

-continued
CH-51
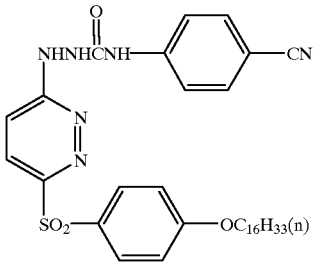
CH-52
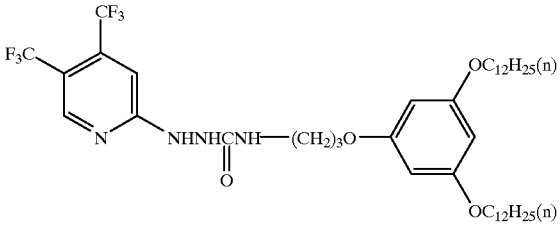
CH-53
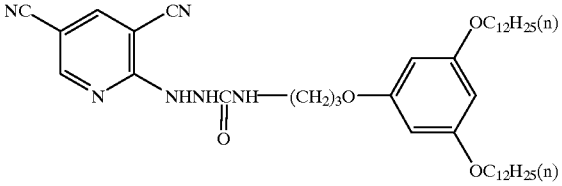
CH-54
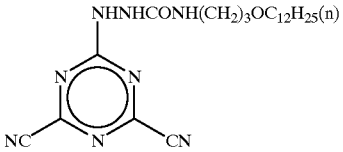
CH-55
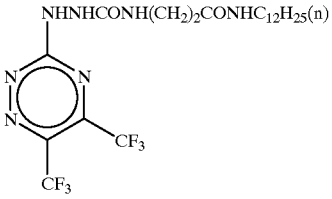
CH-56
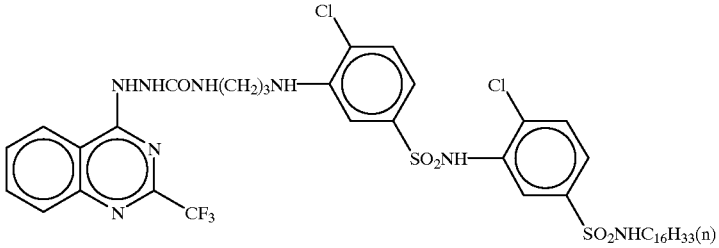
CH-57
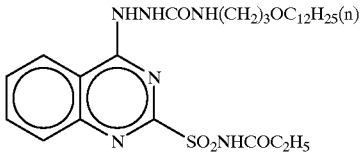
CH-58
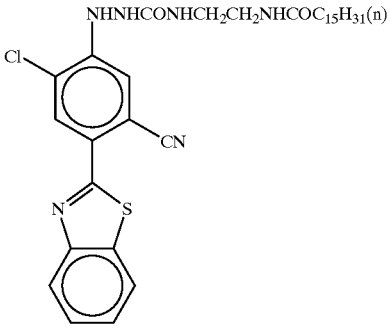
CH-59
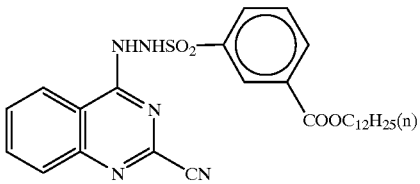
CH-60
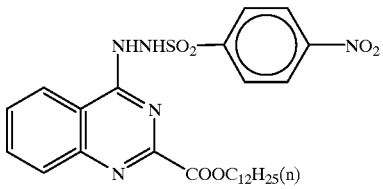

-continued
CH-61
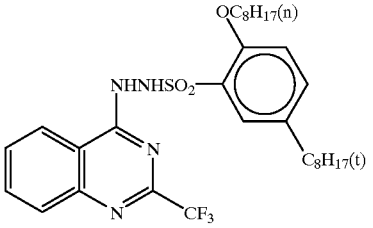
CH-62
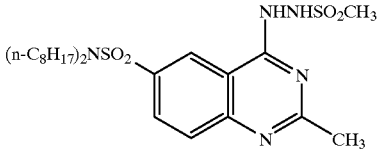
CH-63
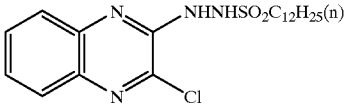
CH-64
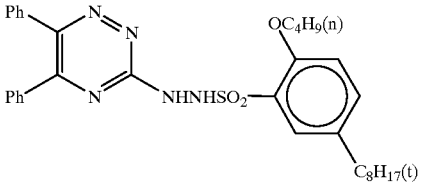
CH-65
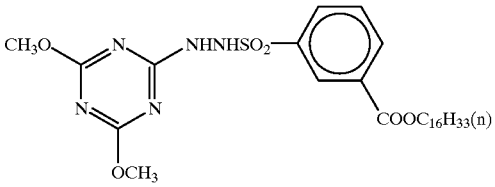
CH-66
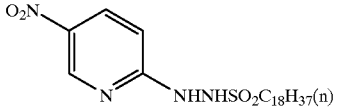
CH-67
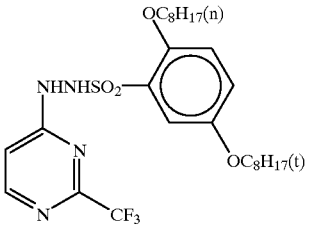
CH-68
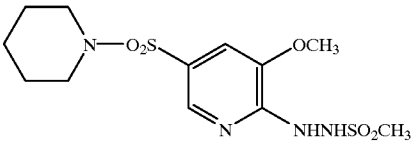
CH-69
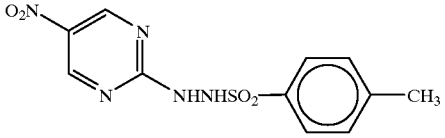
CH-70
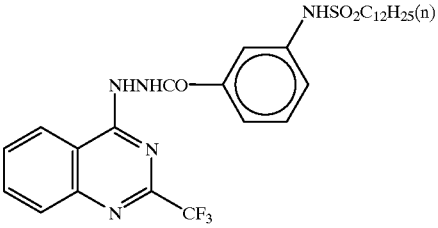
CH-71
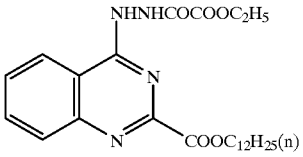
CH-72
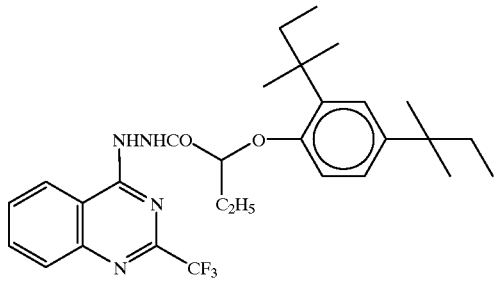
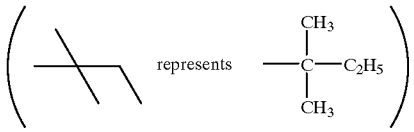

-continued
CH-73
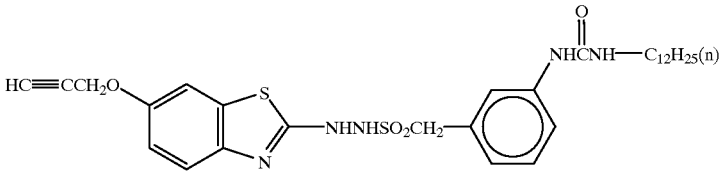
CH-74
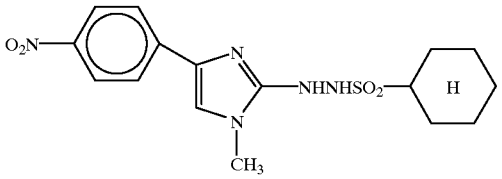
CH-75
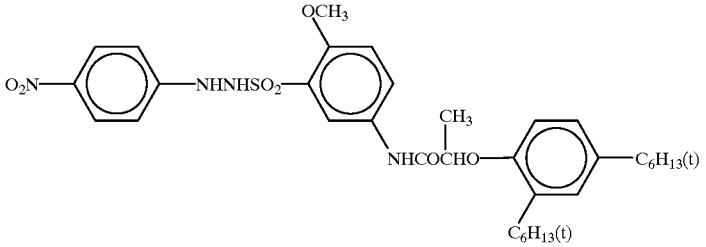
CH-76
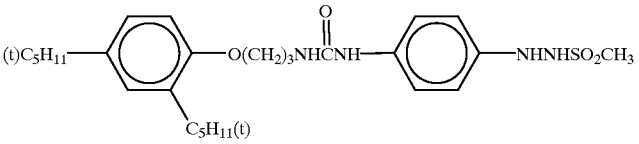
CH-77
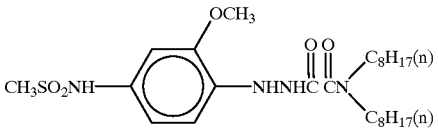
CH-78
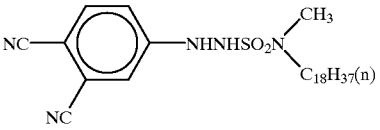
CH-79
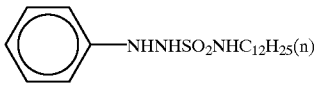
CH-80
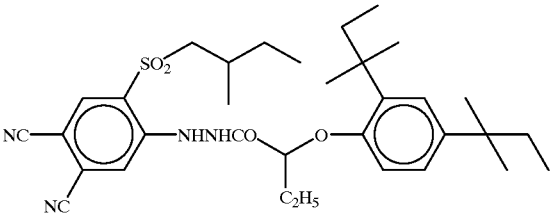
CH-81
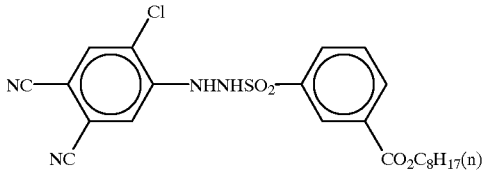
CH-82
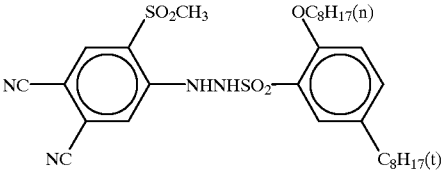

-continued

CH-83

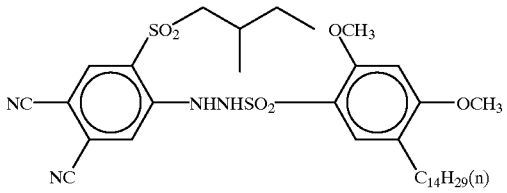

As couplers contained in a light-sensitive material that are preferably used in the present invention, compounds having structures described by the following formulae (1) to (12) are mentioned. They are compounds collectively generally referred to as active methylenes, pyrazolones, pyrazoloazoles, phenols, naphthols, and pyrrolotriazoles, respectively, which are compounds known in the art.

(1)

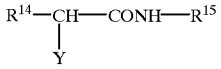

(2)

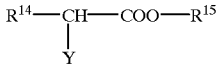

(3)

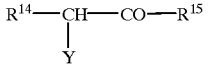

(4)

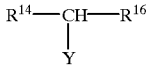

(5)

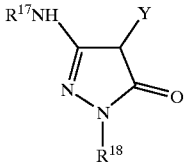

(6)

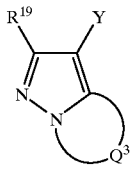

(7)

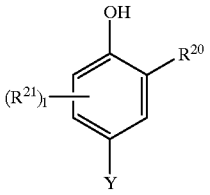

CH-84

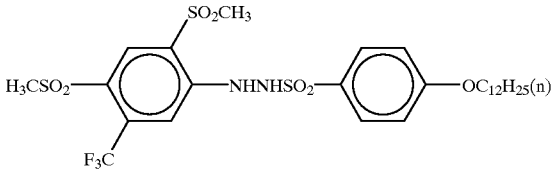

-continued (8)

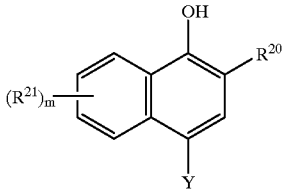

(9)

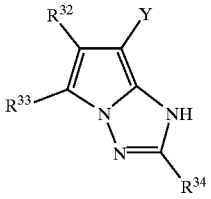

(10)

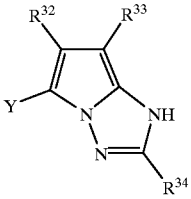

(11)

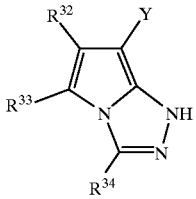

(12)

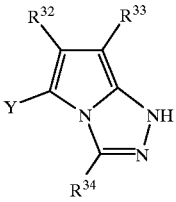

Formulae (1) to (4) represent couplers that are called active methylene couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for $X^1$ to $X^5$.

In formulae (1) to (4), Y represents a hydrogen atom or a group capable of coupling split-off by coupling reaction with the oxidation product of the color-forming reducing agent. Examples of Y are a heterocyclic group (a saturated or unsaturated 5-membered to 7-membered monocyclic or condensed ring having as a hetero atom at least one nitrogen atom, oxygen atom, sulfur atom, or the like, e.g. succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenylcarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamido group (e.g. methanesulfonamido and benzenesulfonamido), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), an arylazo group (e.g. phenylazo and naphthylazo), and a carbamoylamino group (e.g. N-methylcarbamoylamino).

Y may be substituted, and examples of the substituent that may be possessed by Y include those mentioned for $X^1$ to $X^5$.

Preferably Y represents a halogen atom, an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$, may bond together to form a ring.

Formula (5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidophenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom. Y has the same meaning as defined above.

Preferably $R^{18}$ represents a substituted phenyl group, such as a 2,4,6-trichiorophenyl group, a 2,5-dichlorophenyl group, and a 2-chlorophenyl group.

Formula (6) represents a coupler that is called a pyrazoloazole coupler, and, in the formula, $R^{19}$ represents a hydrogen atom or a substituent. $Q^3$ represents a group of nonmetal atoms required to form a 5-membered azole ring having 2 to 4 nitrogen atoms, which azole ring may have a substituent (including a condensed ring).

Preferable pyrazoloazole couplers represented by formula (6), in view of spectral absorption characteristics of the color-formed dyes, are imidazo[(1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A-61-65245; pyrazoloazole couplers containing a sulfonamido group in the molecule, as described in JP-A-61-65245; pyrazoloazole couplers having an alkoxyphenylsulfonamido ballasting group, as described in JP-A-61-147254; pyrazolotriazole couplers having an alkoxy group or an aryloxy group at the 6-position, as described in JP-A-62-209457 or 63-307453; and pyrazolotriazole couplers having a carbonamido group in the molecule, as described in JP-A-2-201443. Y has the same meaning as defined above.

Formulae (7) and (8) represent couplers that are respectively called phenol couplers and naphthol couplers, and in the formulae $R^{20}$ represents a hydrogen atom or a group selected from the group consisting of $—CONR^2R^{23}$, $—SO_2NR^{22}R^{23}$, $—NHCOR^{22}$, $—NHCONR^{22}R^{23}$, and $—NHSO_2NR^{22}R^{23}$. $R^{22}$ and $R^{23}$ each represent a hydrogen atom or a substituent. In formulae (7) and (8), $R^{21}$ represents a substituent, l is an integer selected from 0 to 2, and m is an integer selected from 0 to 4. When l and m are 2 or more, $R^{21}$'s may be different. The substituents of $R^{21}$ to $R^{23}$ include those mentioned above as examples for $X^1$ to $X^5$ of formula (CH2) or (CH4). Y has the same meaning as defined above.

Preferable examples of the phenol couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3,329,729, and JP-A-59-166956; and 2-phenylureido-5-acylaminophenol couplers described, for example, in U.S. Pat. Nos. 3,446,622, 4,333,999, 4,451,559, and 4,427,767. Y has the same meaning as defined above.

Preferable examples of the naphthol couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889. Y has the same meaning as defined above.

Formulas (9) to (12) are couplers called pyrrolotriazoles, and $R^{32}$, $R^{33}$, and $R^{34}$ each represent a hydrogen atom or a substituent. Y has the same meaning as defined above. Examples of the substituent of $R^{32}$, $R^{33}$, and $R^{34}$ include those mentioned for $X^1$, $X^2$, $X^3$, $X^4$, and $X^5$. Preferable examples of the pyrrolotriazole couplers represented by formulae (9) to (12) include those wherein at least one of $R^{32}$ and $R^{33}$ is an electron-attracting group, which specific couplers are described in EP-A-488 248(A1), 491 197(A1), and 545,300. Y has the same meaning as defined above.

Further, a fused-ring phenol, an imidazole, a pyrrole, a 3-hydroxypyridine, an active methylene except the above, an active methine, a 5,5-ring-fused heterocyclic, and a 5,6-ring-fused heterocyclic coupler, can be used.

As the fused phenol couplers, those described, for example, in U.S. Pat. Nos. 4,327,173, 4,564,586, and 4,904,575, can be used.

As the imidazole couplers, those described, for example, in U.S. Pat. Nos. 4,818,672 and 5,051,347, can be used.

As the 3-hydroxypyridine couplers, those described, for example, in JP-A-1-315736, can be used.

As the active methylene and active methine couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in EP-556 700, can be used.

In the present invention, in addition to the above couplers, use can be made of couplers described, for example, in West Germany patent Nos. 3 819 051A and 3 823 049, U.S. Pat. Nos. 4,840,883, 5,024,930, 5,051,347, and 4,481,268, EP-A-304 856(A2), 329 036, 354 549(A2), 374 781(A2), 379 110(A2), and 386 930(A1), and JP-A-63-141055, 1-32260, 1-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

Specific examples of the couplers that can be used in the present invention are shown below, but, of course, the present invention is not limited to them:

(C-1)

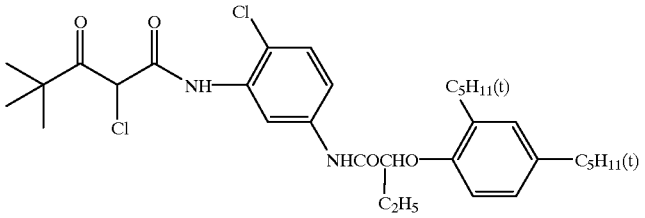

(C-2)

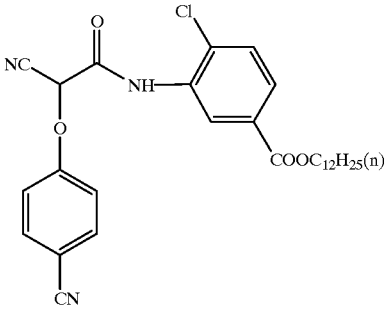

(C-3)

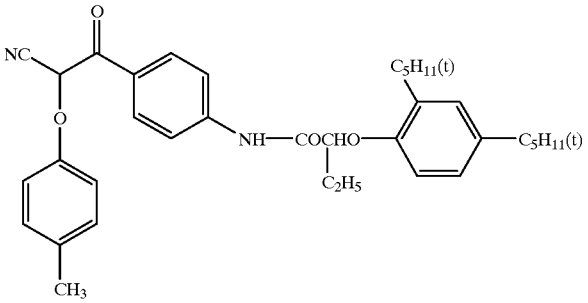

-continued
(C-4)
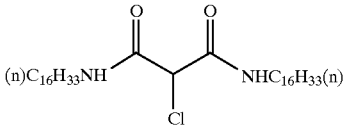
(C-5)
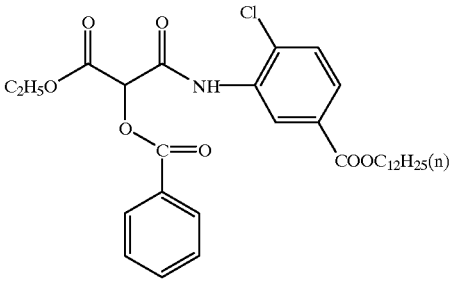
(C-6)
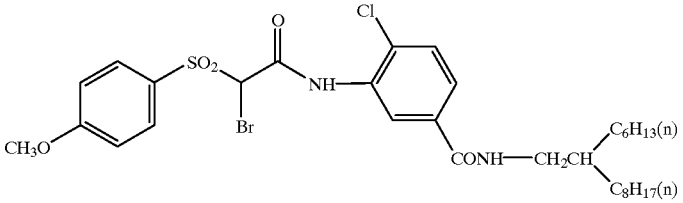
(C-7)
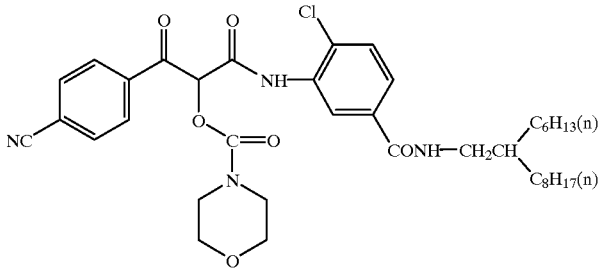
(C-8)
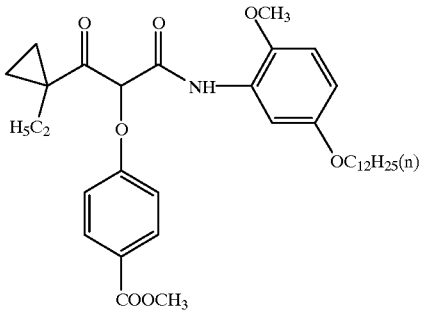
(C-9)
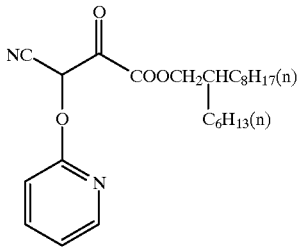
(C-10)
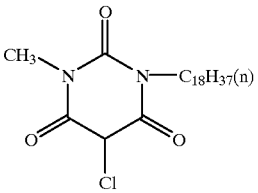
(C-11)
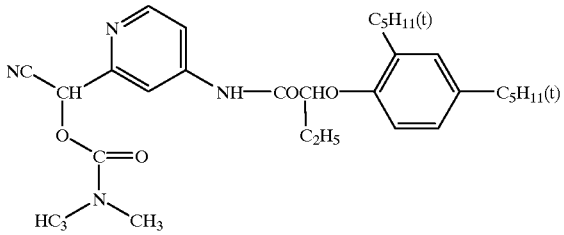
(C-12)
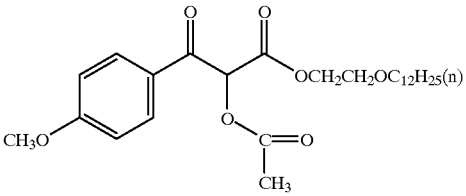
(C-13)
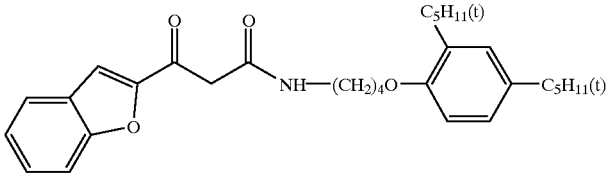
(C-14)
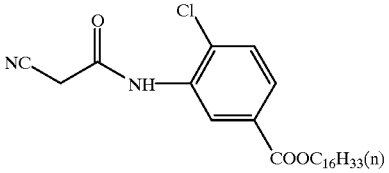

-continued
(C-15)
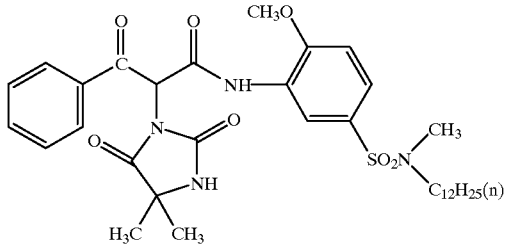
(C-16)
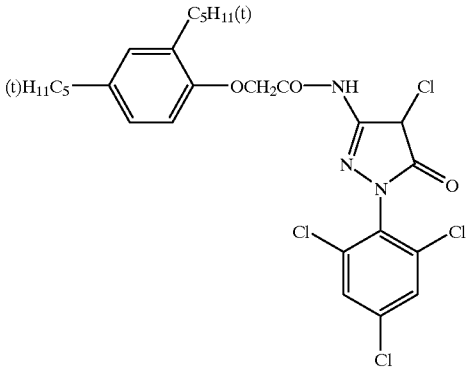
(C-17)
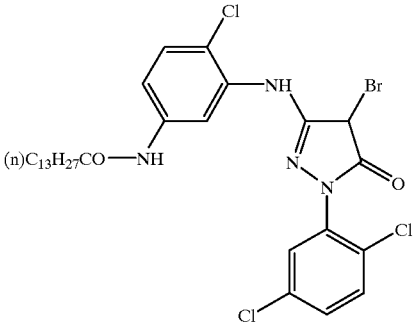
(C-18)
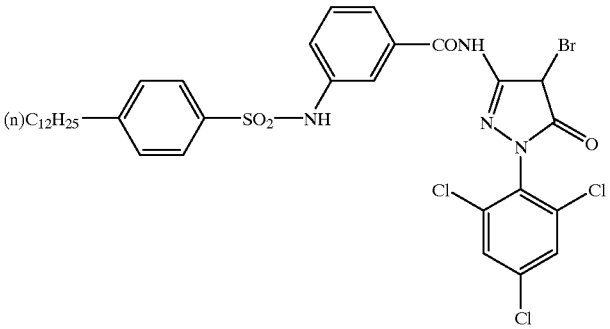
(C-19)
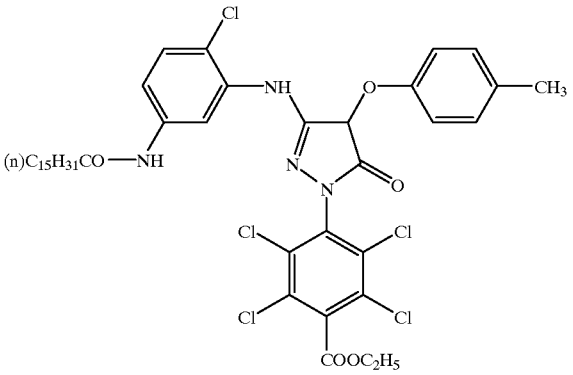
(C-20)
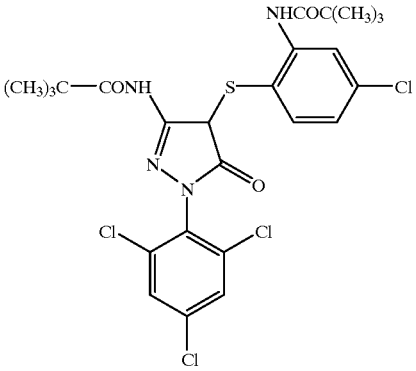

-continued
(C-21)
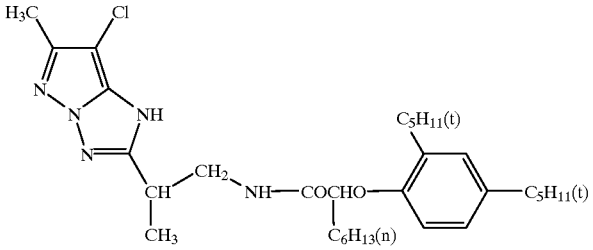
(C-22)
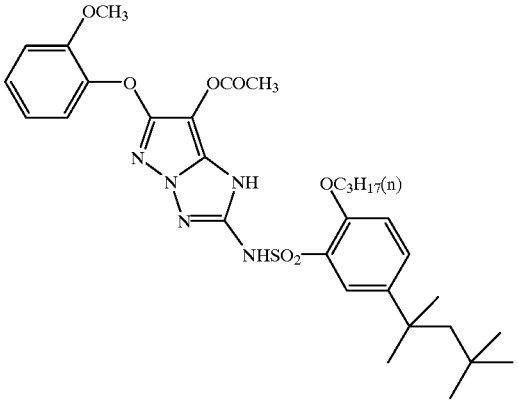
(C-23)
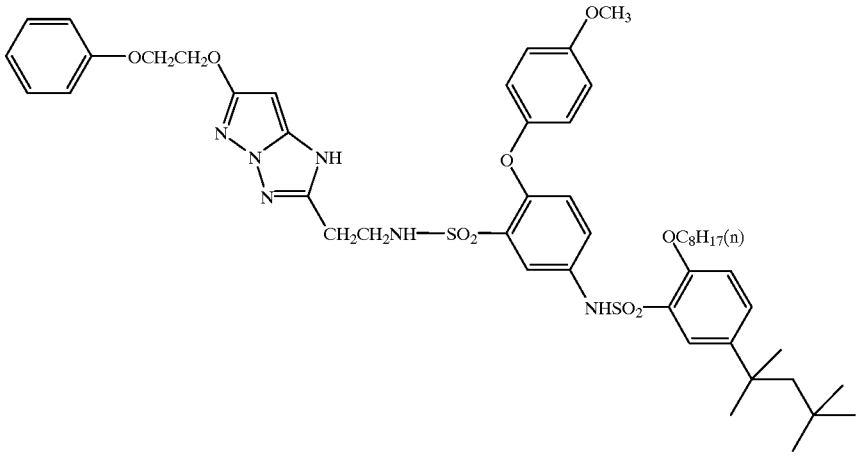
(C-24)
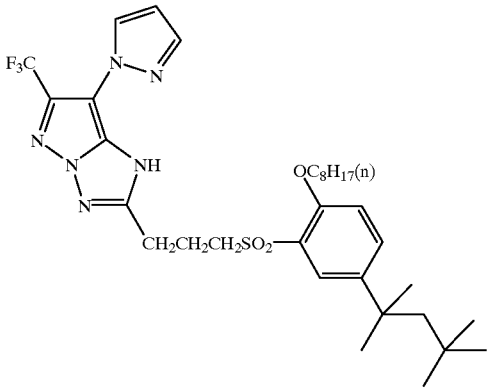
(C-25)
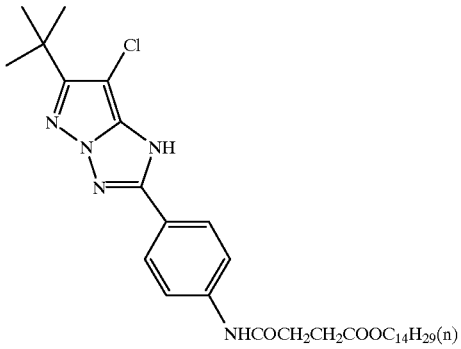

-continued
(C-26)
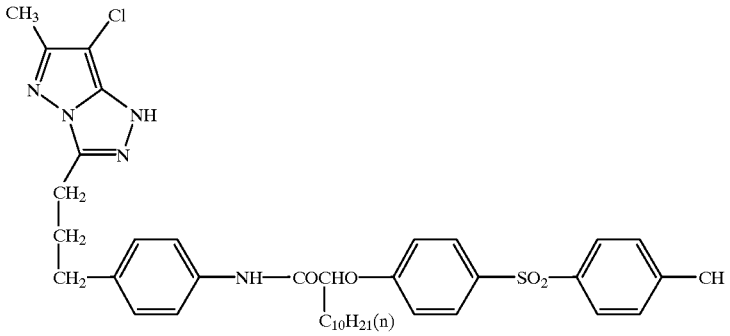
(C-27)
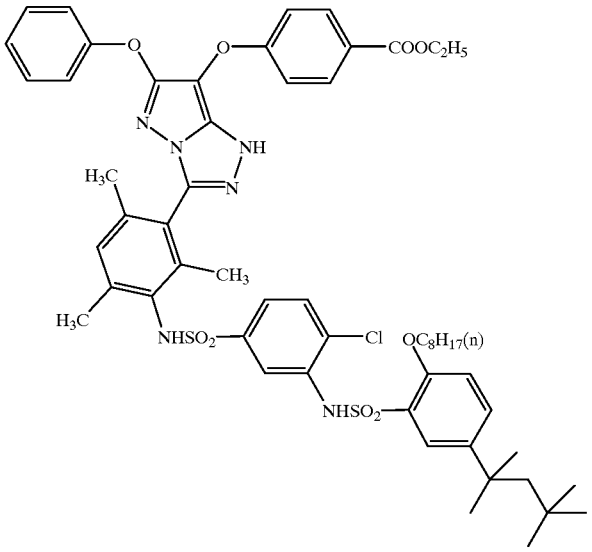
(C-28)
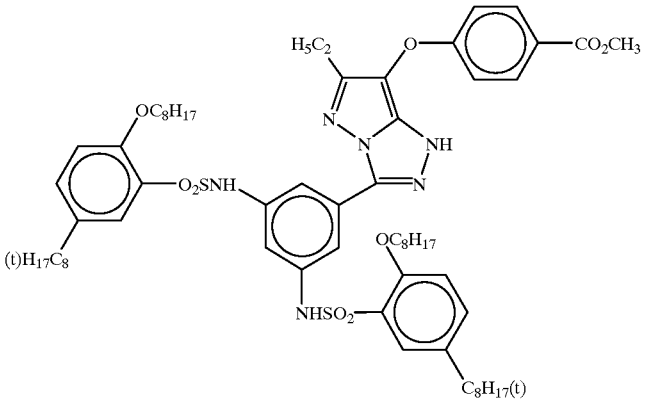

-continued
(C-29)
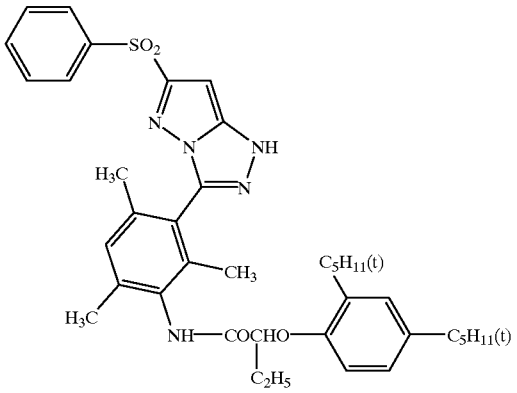
(C-30)
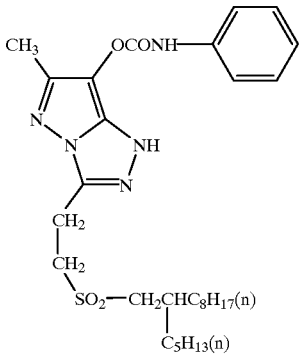
(C-31)
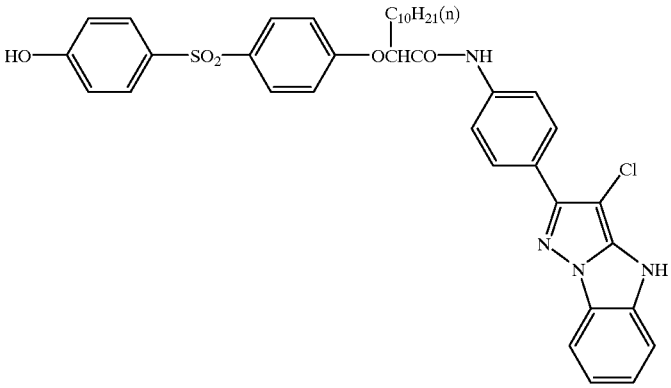
(C-32)
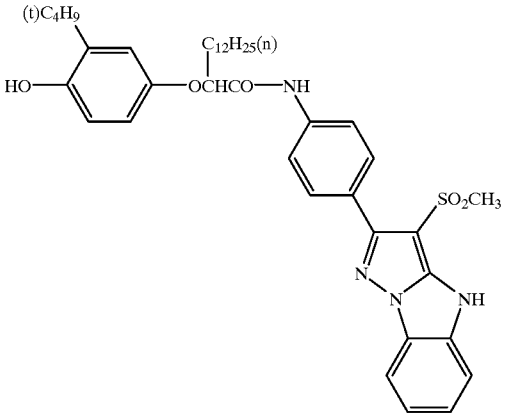
(C-33)
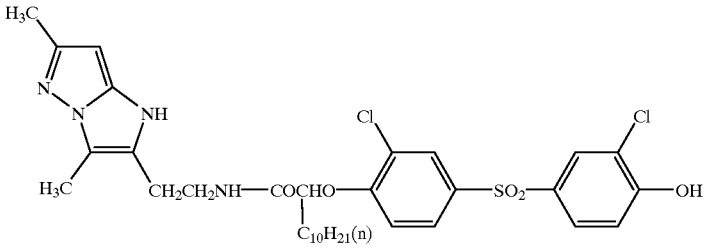

-continued
(C-34)
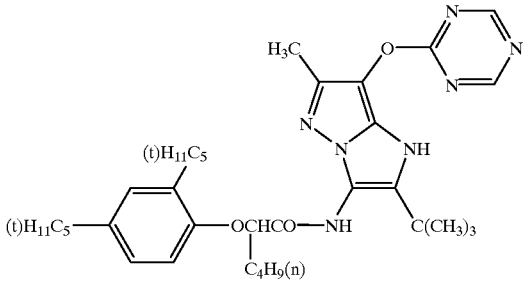
(C-35)
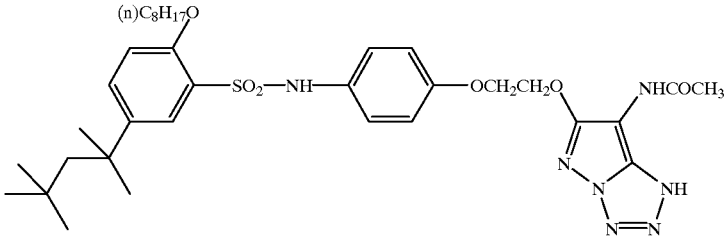
(C-36)
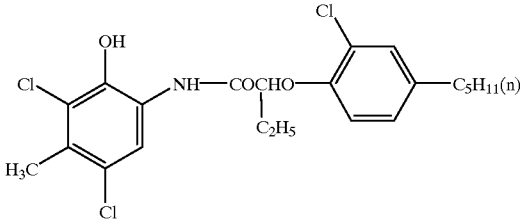
(C-37)
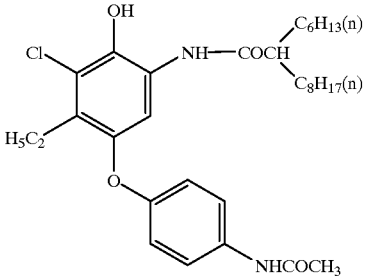
(C-38)
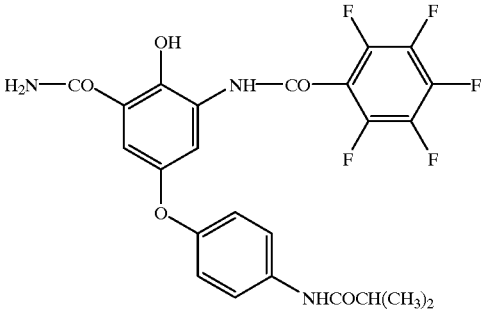
(C-39)
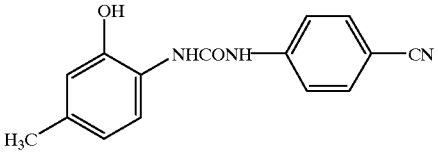
(C-40)
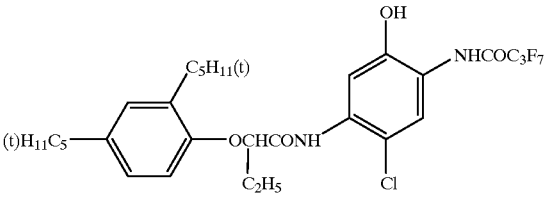

-continued
(C-41)
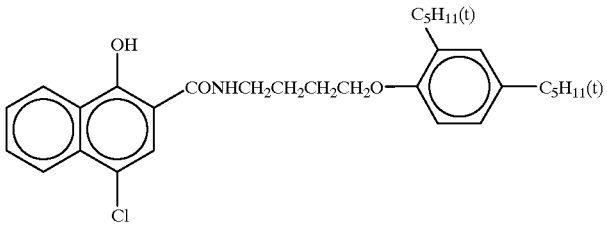
(C-42)
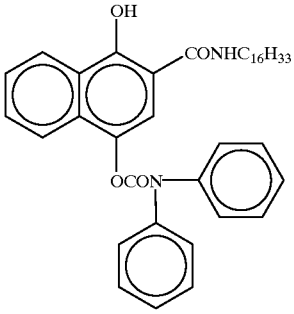
(C-43)
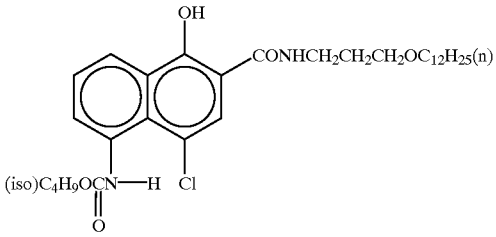
(C-44)
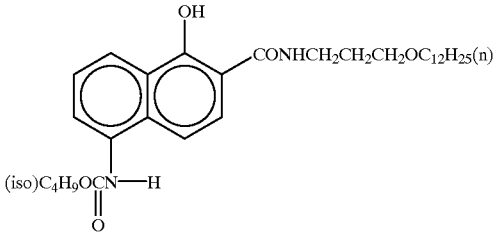
(C-45)
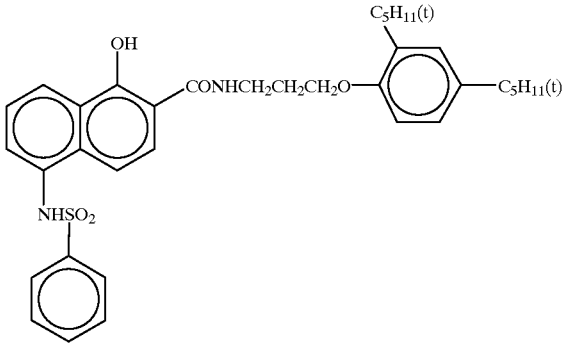
(C-46)
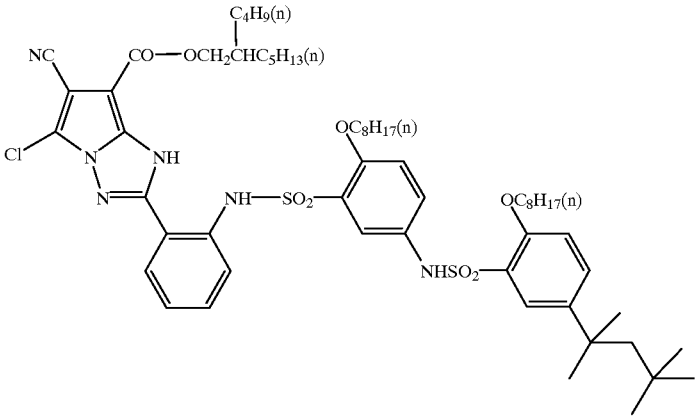

-continued
(C-47)
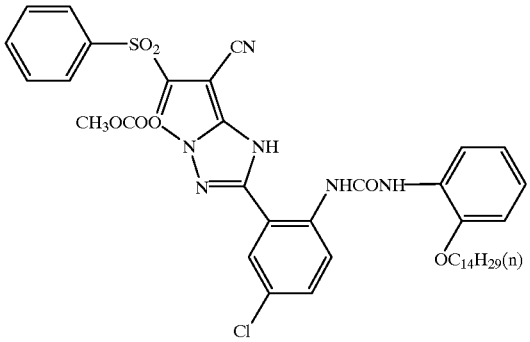
(C-48)
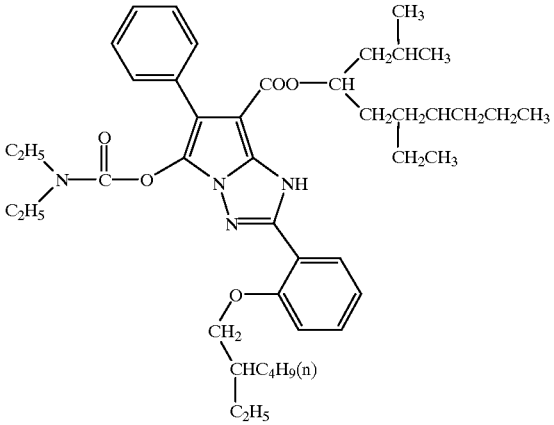
(C-49)
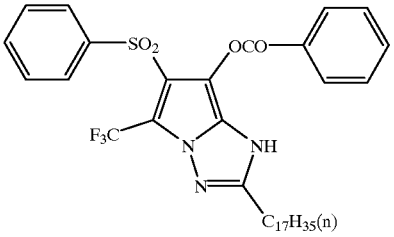
(C-50)
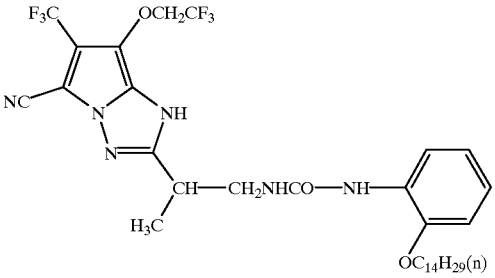
(C-51)
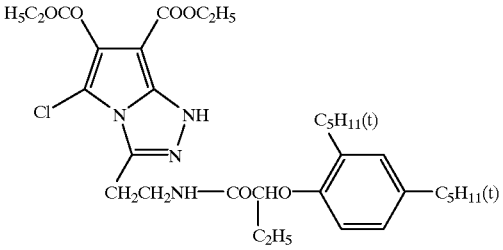
(C-52)
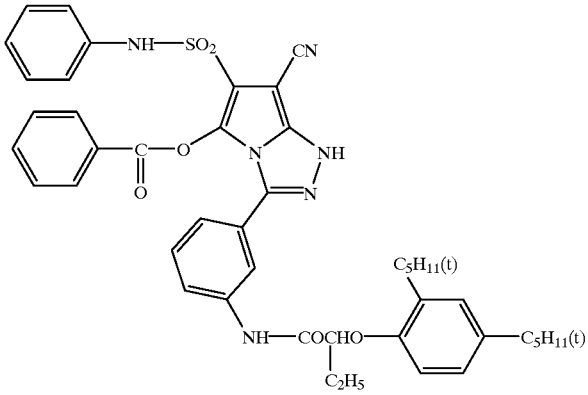
(C-53)
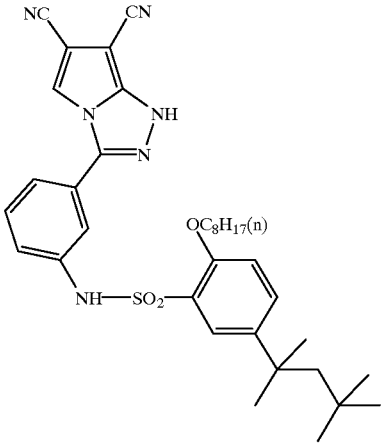

-continued
(C-54)
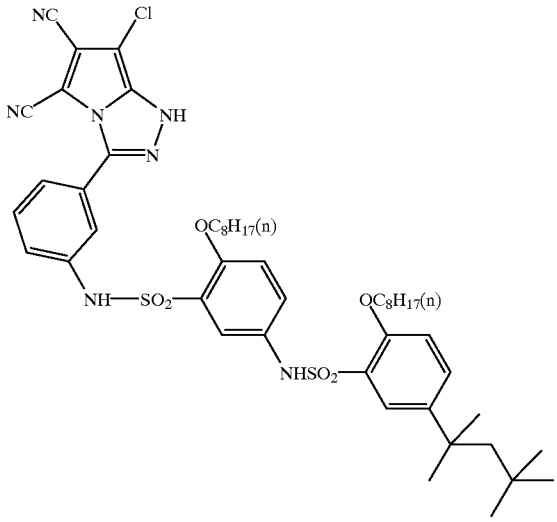
(C-55)
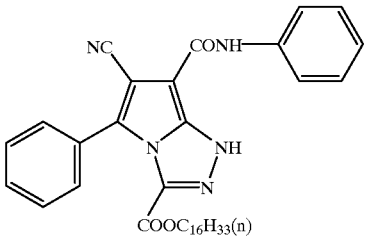
(C-56)
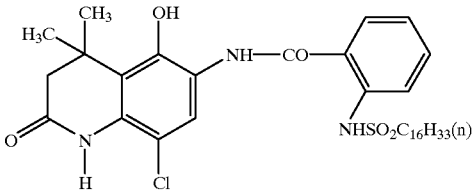
(C-57)
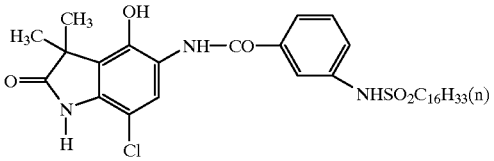
(C-58)
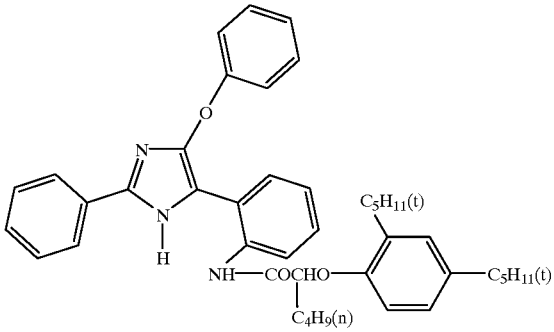
(C-59)
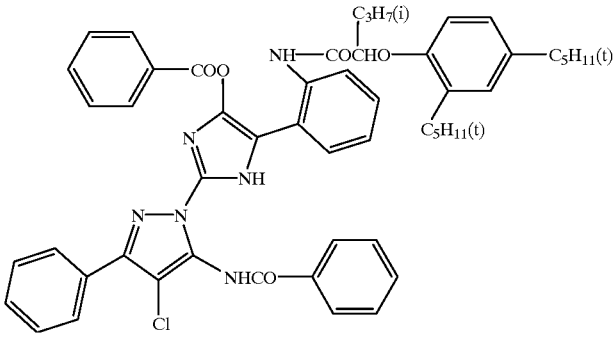

-continued
(C-60)
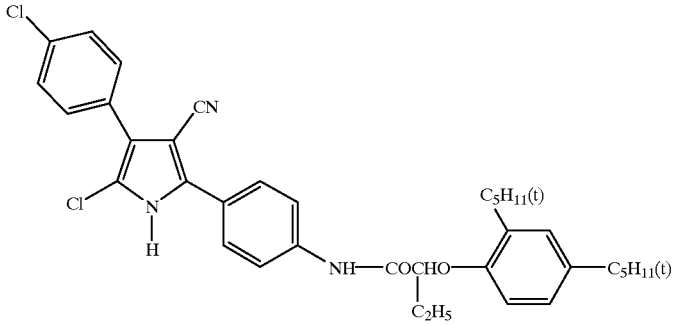
(C-61)
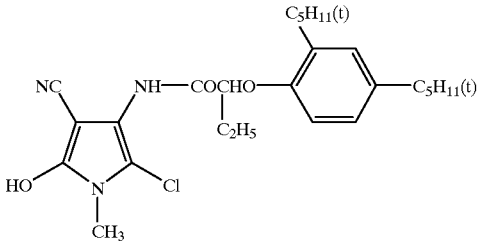
(C-62)
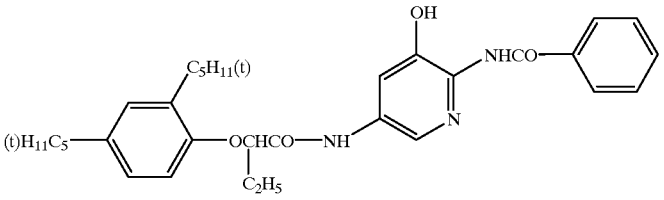
(C-63)
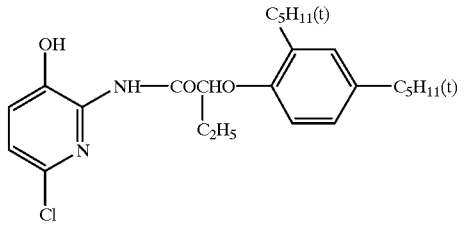
(C-64)
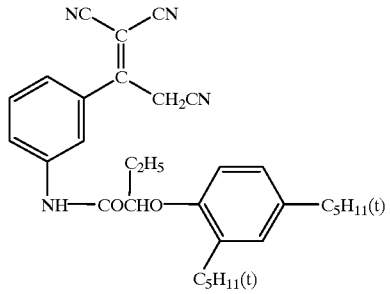
(C-65)
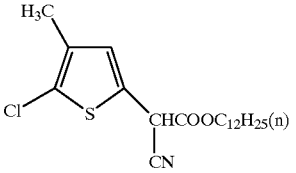

-continued
(C-66)
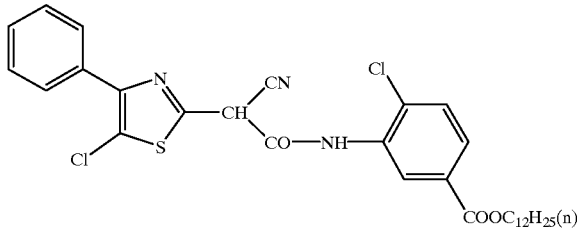
(C-67)
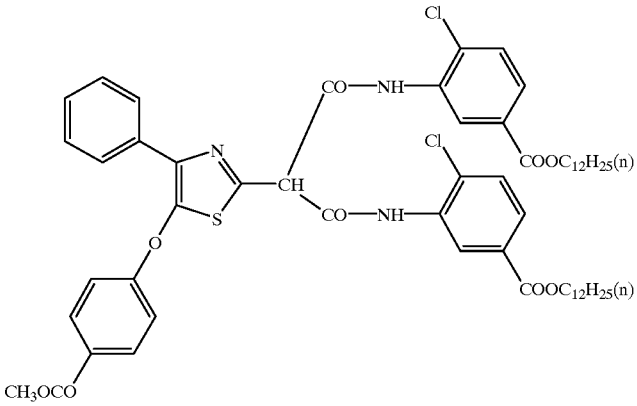
(C-68)
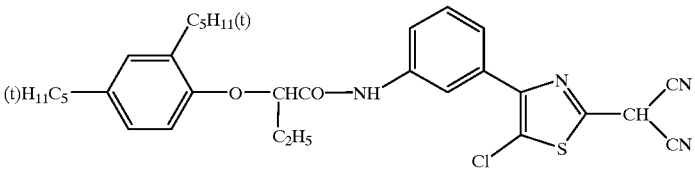
(C-69)
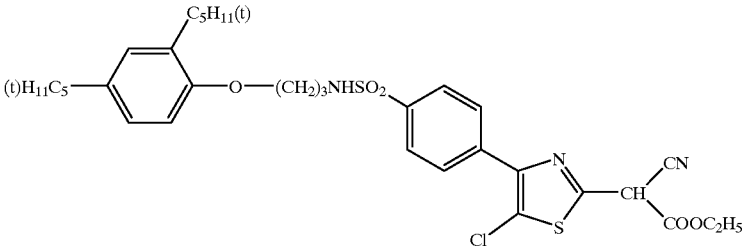
(C-70)
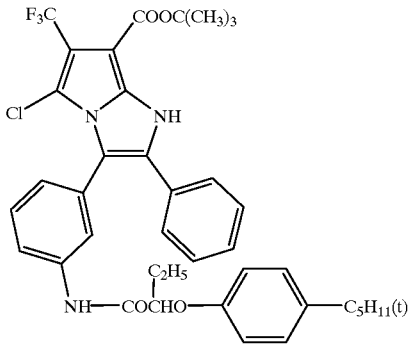

-continued
(C-71)
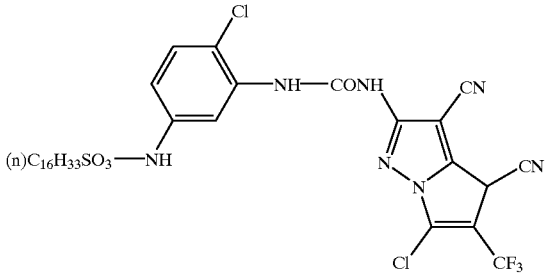
(C-72)
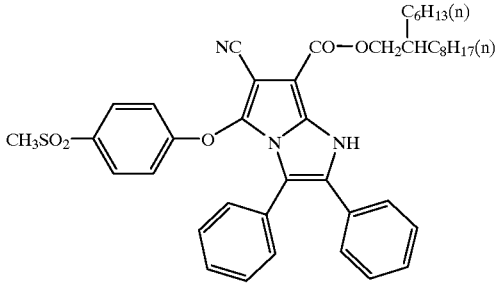
(C-73)
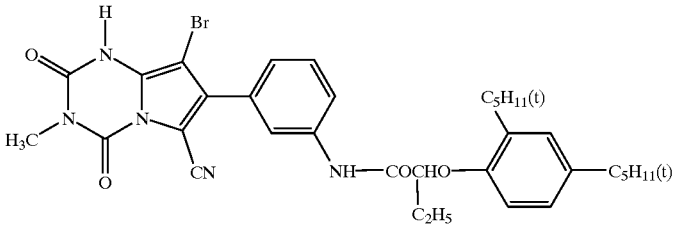
(C-74)
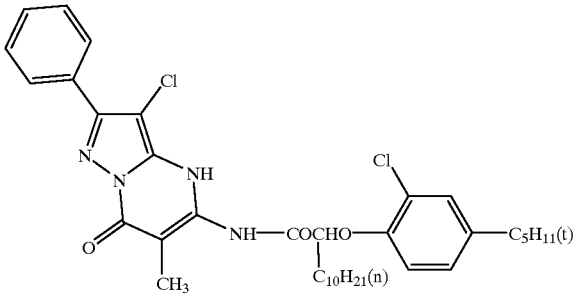
(C-75)
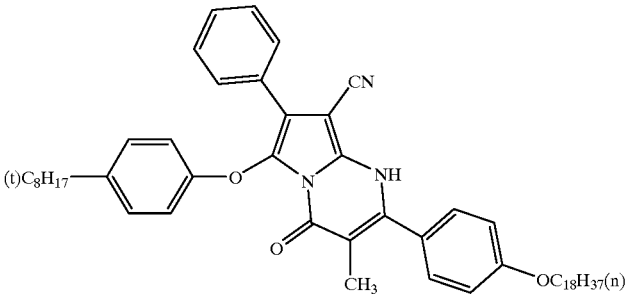
(C-76)
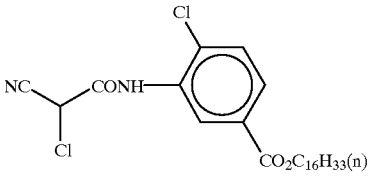
(C-77)
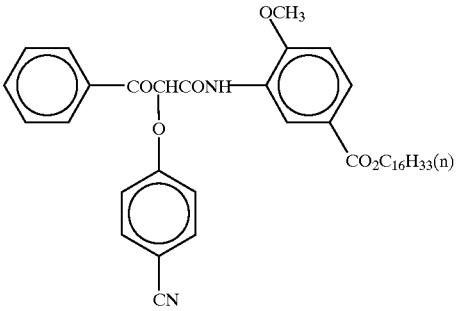

-continued (C-78)

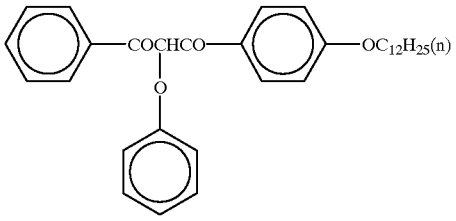

(C-79)

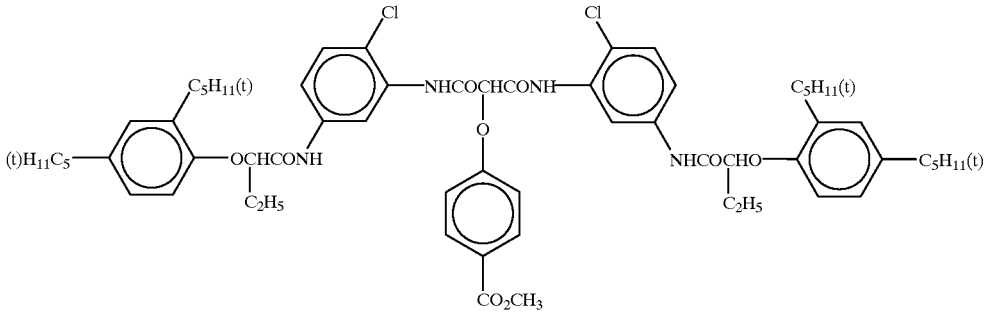

(C-80)

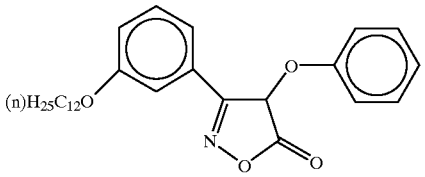

In the present invention, the color-forming reducing agent is preferably used in an amount of 0.01 mmol/$m^2$ to 10 mmol/$m^2$ in one color-forming layer, in order to obtain satisfactory color density. More preferably the amount to be used is 0.05 mmol/$m^2$ to 5 mmol/$m^2$, and particularly preferably 0.1 mmol/$m^2$ to 1 mmol/$m^2$ A preferable amount of the coupler to be used in the color-forming layer in which the color-forming reducing agent according to the present invention is used, is 0.05 to 20 times, more preferably 0.1 to 10 times, and particularly preferably 0.2 to 5 times, the amount of the color-forming reducing agent in terms of mol.

The color light-sensitive material for use in the present invention basically comprises photographic constitutional layers including at least one hydrophilic colloidal layer coated on a support, and a light-sensitive silver halide, a dye-forming coupler (a coupler for forming a dye), and a color-forming reducing agent are contained in one or more photographic constituent layers.

The dye-forming coupler and the color-forming reducing agent used in the present invention are added to an identical layer, in the most typical embodiment, but they can be added divisionally into separate layers, as long as they can react with each other. These ingredients are preferably added to a silver halide emulsion layer or a layer adjacent therewith in the light-sensitive material, and particularly preferably they are added together to an identical silver halide emulsion layer.

The color-forming reducing agent and the coupler for use in the present invention can be introduced into the light-sensitive material by various known dispersion methods. Preferably the oil-in-water dispersion method is used, in which they are dissolved in a high-boiling organic solvent (and, if necessary, together with a low-boiling organic solvent), the solution is emulsified and dispersed in an aqueous gelatin solution, and the emulsified dispersion is added to a silver halide emulsion. The high-boiling organic solvent to be used in the present invention can be a compound nonmiscible with water, and having a melting point of 100° C. or below and a boiling point of 140° C. or over, that is a good solvent for the color-forming reducing agents and couplers. The melting point of the high-boiling organic solvent is preferably 80° C. or below. The boiling point of the high-boiling organic solvent is preferably 160° C. or over, and more preferably 170° C. or over. Details of these high-boiling organic solvents are described in JP-A-62-215272, page 137, right lower column, to page 144, right upper column. In the present invention, when the high-boiling organic solvent is used, the amount of the high-boiling organic solvent to be used may be any amount, but preferably the amount is such that the weight ratio of the high-boiling organic solvent to the color-forming reducing agent is from 20 or less:1, more preferably from 0.02 to 5:1, and particularly preferably from 0.2 to 4:1.

Further, in the present invention, known polymer dispersion methods can be used. Specific examples of steps, effects, and latexes for impregnation of the latex dispersion method, which is one polymer dispersion method, are described, for example, in U.S. Pat. No. 4,199,363, West Germany Patent Application (OLS) Nos. 2,541,274 and 2,541,230, JP-B-53-41091, and European Patent Publication No. 029104. As more preferable method, a dispersion method using a water-insoluble and organic solvent-soluble polymer is described in PCT International Publication No. WO 88/00723.

The average particle size of the lipophilic fine particles containing the color-forming reducing agent for use in the present invention is not particularly limited, but, in view of the color-forming property, the average particle size is preferably 0.05 to 0.3 μm, and more preferably 0.05 to 0.2 μm.

To make the average particle size of lipophilic fine particles small is generally accomplished, for example, by choosing a type of surface-active agent, by increasing the amount of the surface-active agent to be used, by elevating the viscosity of the hydrophilic colloid solution, by lowering the viscosity of the lipophilic organic layer, through use of an additional low-boiling organic solvent, by increasing the rotational frequency of the stirring blades of an emulsifying apparatus, to increase the shearing force, or by prolonging the emulsifying time.

The particle size of lipophilic fine particles can be measured by an apparatus, such as a Nanosizer (trade name, manufactured by British Coulter Co.).

In the present invention, when the dye that is produced from the color-forming reducing agent and the dye-forming coupler is a diffusible dye, preferably a mordant is added to the light-sensitive material. If the present invention is applied to such a mode, it is not required to dip the material in an alkali to form color, and therefore image stability after processing is remarkably improved. Although the mordant for the use in the present invention can be used in any layer, if the mordant is added to a layer containing the color-forming reducing agent for use in the present invention, the stability of the color-forming reducing agent is deteriorated. Therefore preferably the mordant is used in a layer that does not contain the color-forming reducing agent. Further, the dye that is produced from a color-forming reducing agent and a coupler diffuses into the gelatin film that has been swelled during the processing, to dye the mordant. Therefore, in order to obtain good sharpness, the shorter the diffusion distance is, the more preferred it is. Accordingly, the layer to which the mordant is added is preferably a layer adjacent to the layer containing the color-forming reducing agent.

Further, in this case, since the dye that is produced from the color-forming reducing agent and the coupler for use in the present invention is a water-soluble dye, there is a possibility that the dye may flow out into the processing solution. Therefore, to prevent this, preferably the layer to which the mordant is added, is situated on the same side on the base and opposite to (more remote from the base than) the layer containing the color-forming reducing agent. However, when a barrier layer, as described in JP-A-7-168335, is provided on the same side on the base and opposite to (more remote from the base than) a layer in which the mordant is added, also preferably the layer in which the mordant is added, is situated on the same side of the base as and nearer to the base than the layer containing the color-forming reducing agent.

The mordant for use in the present invention may also be added to several layers, and in particular, when several layers contain the color-forming reducing agent, also preferably the mordant is added to each layer adjacent thereto.

The coupler that forms a diffusible dye may be any coupler that results in a diffusible dye formed by coupling with the color-forming reducing agent for use in the present invention, the resultant diffusible dye being capable of reaching the mordant. Preferably the coupler is a coupler that results in a diffusible dye having one or more dissociable groups with a pKa (an acid dissociation constant) of 12 or less, more preferably 8 or less, and particularly preferably 6 or less. Preferably the molecular weight of the diffusible dye that will be formed is 200 or more but 2,000 or less. Further, preferably the ratio (the molecular weight of the dye that will be formed/the number of dissociable groups with a pKa of 12 or less) is 100 or more but 2,000 or less, and more preferably 100 or more but 1,000 or less. Herein the value of pKa is the value measured by using, as a solvent, dimethylformamide/water (1:1).

The coupler that forms a diffusible dye is preferably one that results in a diffusible dye formed by coupling with the color-forming reducing agent for use in the present invention, the resultant diffusible dye being dissolvable in an alkali solution having a pH of 11 in an amount of $1\times10^{-6}$ mol/liter or more, more preferably $1\times10^{-5}$ mol/liter or more, and particularly preferably $1\times10^{-4}$ mol/liter or more, at 25° C. Further, the coupler that forms a diffusible dye is preferably one that results in a diffusible dye formed by coupling with the color-forming reducing agent for use in the present invention, the resultant diffusible dye having a diffusion constant of $1\times10^{-8}$ $m^2/s^{-1}$ or more, more preferably $1\times10^{-7}$ $m^2/s^{-1}$ or more, and particularly preferably $1\times10^{-6}$ $m^2/s^{-1}$ or more, at 25° C. when dissolved in an alkali solution of pH 11, at a concentration of $10^{-4}$ mol/liter.

The mordant that can be used in the present invention can be suitably chosen from among mordants that are usually used, and among them, in particular, polymer mordants are preferable. Herein, by polymer mordant is meant polymers having a tertiary amino group, polymers having a nitrogen-containing heterocyclic moiety, polymers containing a quaternary cation group thereof, etc.

Preferable specific examples of homopolymers and copolymers containing vinyl monomer units with a tertiary imidazole group are described, for example, in U.S. Pat. Nos. 4,282,305, 4,115,124, and 3,148,061 and JP-A-60-118834, 60-122941, 62-244043, and 62-244036.

Preferable specific examples of homopolymers and copolymers containing vinyl monomer units with a quaternary imidazolium salt are described, for example, in GB-2 056 101, 2 093 041, and 1 594 961, U.S. Pat. Nos. 4,124,386, 4,115,124, and 4,450,224, and JP-A-48-28325.

Further, preferable specific examples of homopolymers and copolymers having vinyl monomer units with a quaternary ammonium salt are described, for example, in U.S. Pat. Nos. 3,709,690, 3,898,088, and 3,958,995, and JP-A-60-57836, 60-60643, 60-122940, 60-122942, and 60-235134.

Further, vinylpyridine polymers and vinylpyridinium cation polymers, as disclosed, for example, in U.S. Pat. Nos. 2,548,564, 2,484,430, 3,148,161, and 3,756,814; polymer mordants capable of being crosslinked to gelatin or the like, as disclosed, for example, in U.S. Pat. Nos. 3,625,694, 3,859,096, and 4,128,538, and GB-1 277 453; aqueous sol-type mordants, as disclosed, for example, in U.S. Pat. Nos. 3,958,995, 2,721,852, and 2,798,063, and JP-A-54-115228, 54-145529, and 54-26027; water-insoluble mordants, as disclosed in U.S. Pat. No. 3,898,088; reactive mordants capable of covalent bonding to dyes, as disclosed in U.S. Pat. No. 4,168,976 (JP-A-54-137333); and mordants disclosed in U.S. Pat. No. 3,709,690, 3,788,855, 3,642,482, 3,488,706, 3,557,066, and 3,271,147, and JP-A-50-71332, 53-30328, 52-155528, 53-125, and 53-1024, can all be mentioned.

Still further, mordants described in U.S. Pat. Nos. 2,675,316 and 2,882,156 can be mentioned.

The molecular weight of the polymer mordants for use in the present invention is suitably generally 1,000 to 1,000,000, and particularly preferably 10,000 to 200,000.

The above polymer mordants are used generally by mixing them with a hydrophilic colloid. As the hydrophilic colloid, a hydrophilic colloid and/or a highly hygroscopic polymer can be used, and gelatin is most typically used. The mixing ratio of the polymer mordant to the hydrophilic colloid, and the coating amount of the polymer mordant, can be determined easily by those skilled in the art in accordance with the amount of the dye to be mordanted, the type and composition of the polymer mordant, and the image formation process to be used. Suitably the mordant/hydrophilic colloid ratio is generally from 20/80 to 80/20 (by weight), and the coating amount of the mordant is suitably generally 0.2 to 15 g/m$^2$, and preferably 0.5 to 8 g/m$^2$, for use.

In the present invention, preferably an auxiliary developing agent or a precursor thereof can be used in the light-sensitive material. These compounds are explained below.

The auxiliary developing agent used in the present invention is a compound that has an action to promote electric movement from the color-forming reducing agent to silver halides in the development step of silver halide particles. Preferably the auxiliary developing agent is a compound that can cause development of silver halide particles exposed to light, and the oxidization product of the compound can oxidize a color-forming reducing agent (hereinafter referred to as cross oxidation).

As the auxiliary developing agent for use in the present invention, pyrazolidones, dihydroxybenzenes, reductones, or aminophenols can be used preferably, with pyrazolidones being used particularly preferably. Preferably that the diffusibility of these compounds in a hydrophilic colloidal layer is low, and, for example, the solubility to water (25° C.) is preferably 0.1% or below, more preferably 0.05% or below, and particularly preferably 0.01% or below.

The precursor of the auxiliary developing agent used in the present invention is a compound that is present stably in the light-sensitive material, but it rapidly releases the auxiliary developing agent after it has been treated by a treating solution. Also in a case of using the compound, preferably the diffusibility in the hydrophilic colloidal layer is low. For example, the solubility to water (25° C.) is preferably 0.1% or below, more preferably 0.05% or below, and particularly preferably 0.01% or below. There is no particular restriction on the solubility of the auxiliary developing agent released from the precursor, but preferably the solubility of the auxiliary developing agent itself is low.

Specific example of the auxiliary developing agent and its precursor are shown below, but, of cause, the compounds for use in the present invention are not limited to them.

(ETA-1)

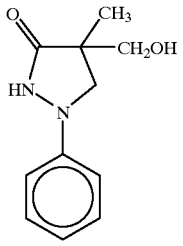

(ETA-2)

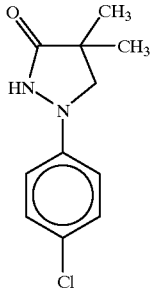

-continued (ETA-3)

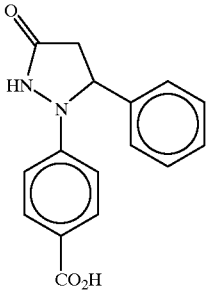

(ETA-4)

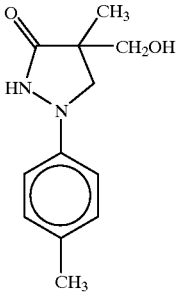

(ETA-5)

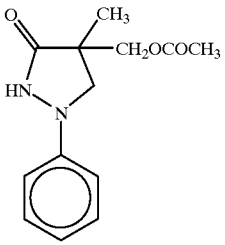

(ETA-6)

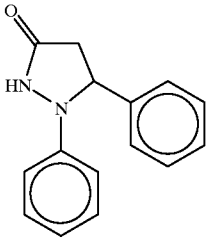

(ETA-7)

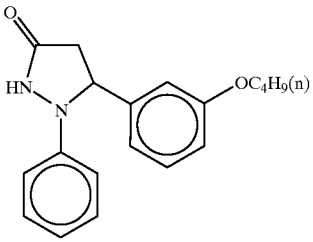

-continued
(ETA-8)
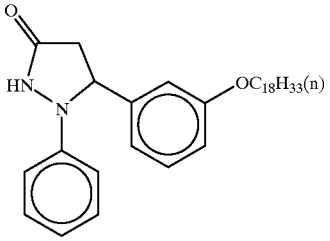
(ETA-9)
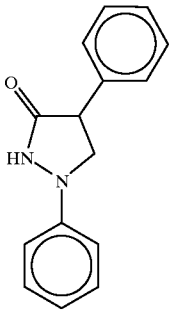
(ETA-10)
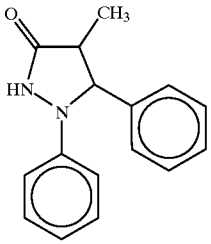
(ETA-11)
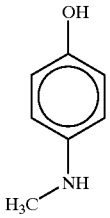
(ETA-12)
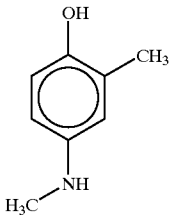
(ETA-13)
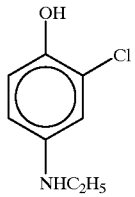
-continued
(ETA-14)
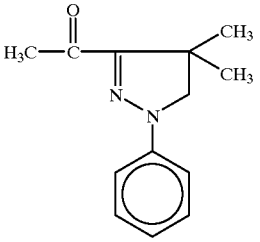
(ETA-15)
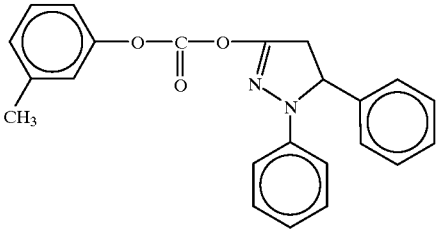
(ETA-16)
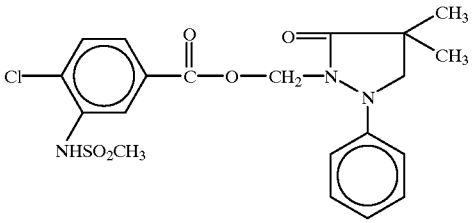
(ETA-17)
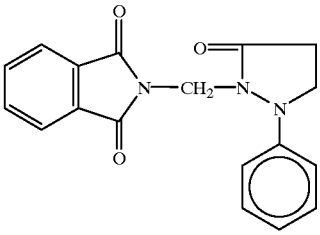
(ETA-18)
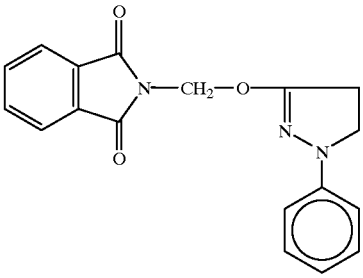
(ETA-19)
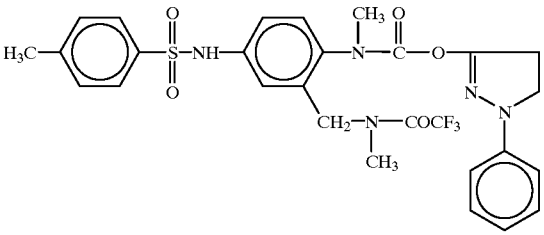

-continued (ETA-20)

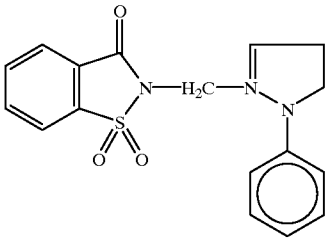

The above compound may be added to any of the light-sensitive layer, an intermediate layer, an undercoat layer, and a protective layer of a light-sensitive material, and preferably it is added to and used in a non-light-sensitive layer when an auxiliary developing agent is contained in the light-sensitive material.

The methods of incorporating the compound into the light-sensitive material include, for example, a method of dissolving the compound in a water-miscible organic solvent, such as methanol, and directly adding this to a hydrophilic colloidal layer; a method of forming an aqueous solution or a colloidal dispersion of the compound, with a surface-active agent also contained, and adding the same; a method of dissolving the compound into a solvent or oil substantially immiscible with water, and then dispersing the solution into water or a hydrophilic colloid, and then adding the same; or a method of adding the compound, in a state of a dispersion of fine solid particles. The known methods may be applied singly or in combination. A method of preparing a dispersion of solid fine-particles is described in detail on page 20 in JP-A-2-235044.

The amount of the compound to be added in a light sensitive material is generally 1 mol % to 200 mol %, preferably 5 mol % to 100 mol %, and more preferably 10 mol % to 50 mol %, based on the color-forming reducing agent.

As the support to be used in the present invention, any support can be used if it is a transmissible support or reflective support, on which a photographic emulsion layer can be coated, such as glass, paper, and plastic film. As the plastic film to be used in the present invention, for example, polyester films made, for example, of polyethylene terephthalates, polyethylene naphthalates, cellulose triacetate, or cellulose nitrate; polyamide films, polycarbonate films, and polystyrene films can be used.

"The reflective support" that can be used in the present invention refers to a support that increases the reflecting properties to make bright the dye image formed in the silver halide emulsion layer. Such a reflective support includes a support coated with a hydrophobic resin containing a light-reflecting substance, such as titanium oxide, zinc oxide, calcium oxide, and calcium sulfate, dispersed therein, or a support made of a hydrophobic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in EP-0 507 489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% by weight or more, and more preferably 14% by weight or more. Preferably the light-reflecting white pigment is kneaded well in the presence of a surface-active agent, and the surface of the pigment particles is preferably treated with a dihydric to tetrehydric alcohol.

In the present invention, a support having the second kind diffuse reflective surface can also be used, preferably. "The second kind diffuse reflectivity" means diffuse reflectivity obtained by making a specular surface uneven, to form finely divided specular surfaces facing different directions. The unevenness of the second kind diffuse reflective surface has a three-dimensional average coarseness of generally 0.1 to 2 $\mu$m, and preferably 0.1 to 1.2 $\mu$m, for the center surface. Details about such a support are described in JP-A-2-239244.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of three layers of a green-sensitive layer, a red-sensitive layer, and an infrared-sensitive layer, and the like can be coated on the above support. The photosensitive layers can be is arranged in various orders known generally for color light-sensitive materials. Further, each of these light-sensitive layers can be divided into two or more layers if necessary.

In the light-sensitive material, photographic constitutional layers comprising the above photosensitive layers and various non-photosensitive layers, such as a protective layer, an underlayer, an intermediate layer, an antihalation layer, and a backing layer, can be provided. Further, in order to improve the color separation, various filter dyes can be added to the photographic constitutional layer.

As a binder or a protective colloid that can be used in the light-sensitive material according to the present invention, a gelatin is advantageously used, and other hydrophilic colloids can be used alone or in combination with a gelatin. The calcium content of gelatin is preferably 800 ppm or less, and more preferably 200 ppm or less. The iron content of gelatin is preferably 5 ppm or less, and more preferably 3 ppm or less. Further, in order to prevent the proliferation of various molds and bacteria that will proliferate in a hydrophilic colloid layer to deteriorate an image, preferably mildew-proofing agents, as described in JP-A-63-271247, are added.

When the light-sensitive material for use in the present invention is subjected to printer exposure, it is preferable to use a band stop filter described in U.S. Pat. No. 4,880,726, by which light color-mixing can be removed, to noticeably improve color reproduction.

The light-sensitive material for use in the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the light-sensitive material for use in the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers be developed. In that event, the necessity that each of at least two layers has a spectral sensitivity maximum at 670 nm or over becomes lower.

In such scanning exposure, the time for which the silver halide in the light-sensitive material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture element size is exposed with the density of the picture element being 400 dpi, preferably the exposure time is $10^{-4}$ sec or less, more preferably $10^{-6}$ sec or less.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, a so-called high-silver-chloride grains having the silver chloride content of 90 mol % or more are desirable. Further, if the development is to be restrained moderately, it is preferable to contain silver iodide. The preferable silver iodide content varies depending on the intended light-sensitive material.

In the high-silver-chloride emulsion used in the present invention, preferably there is provided a silver bromide localized phase having a layered structure or a non-layered structure in each silver halide grain and/or on each silver halide grain surface. The halogen composition of the localized phase has a silver bromide content of preferably at least 10 mol %, and more preferably over 20 mol %.

Further, for the purpose of lowering the replenishing rate of the development processing solution, it is also effective to increase the silver chloride content of the silver halide emulsion further. In such a case, an emulsion of almost pure silver chloride, having a silver halide content, for example, of 98 to 100 mol %, is also preferably used.

The silver halide emulsion for use in the present invention preferably has in its grains a distribution or a structure with respect to the halogen composition. Typical examples thereof are disclosed, for example, in JP-B-43-13162, JP-A-61-215540, 60-222845, 60-143331, 61-75337, and 60-222844.

In the silver halide grains used in the present invention, in accordance with the purpose, any of regular crystals having no twin plane, those described in "Shashin Kogyo no Kiso, Ginen Shashin-hen", edited by Nihon Shashin-gakkai (Corona Co.), page 163 (1979), parallel multiple twins having two or more parallel twin planes, and nonparallel multiple twins having two or more nonparallel twin planes, can be chosen and used. An example in which grains different in shape are mixed is disclosed in U.S. Pat. No. 4,865,964. In the case of regular crystals, cubes having (100) planes, octahedrons having (111) planes, and dodecahedral grains having (110) planes, as disclosed in JP-B-55-42737 and JP-A-60-222842, can be used. Further, (hlm) plane grains, as reported in "Journal of Imaging Science", Vol. 30, page 247 (1986), can be chosen and used in accordance with the purpose. Grains having two or more planes in one grain, such as tetradecahedral grains having (100) and (111) planes in one grain, grains having (100) and (110) planes in one grain, or grains having (111) and (110) planes in one grain, can also be chosen and used in accordance with the purpose.

The value obtained by dividing the diameter of the projected area, which is assumed to be a circle, by the thickness of the grain, is called an aspect ratio, which defines the shape of tabular grains. Tabular grains having an aspect ratio of greater than 1 can be used in the present invention. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,797,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to limit the shape of the tabular grains so that the thickness of the grains be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A-63-163451, are also preferable.

In accordance with the purpose, it is preferable to choose grains having no dislocation lines, grains having several dislocation lines, or grains having many dislocation lines. Dislocation introduced straight in a special direction in the crystal orientation of grains, or curved dislocation, can be chosen, and it is possible to choose from, for example, dislocation introduced throughout grains, dislocation introduced in a particular part of grains, and dislocation introduced limitedly to a particular part such as fringes of grains. In addition to the case of introduction of dislocation lines into tabular grains, also preferable is the case of introduction of dislocation lines into regular crystalline grains or irregular grains, represented by potato grains.

The silver halide emulsion used in the present invention may be subjected to a treatment for making grains round, as disclosed, for example, in EP-B-96 727(B1) and 64 412 (B1), or it may be improved in the surface, as disclosed in West German Patent No. 2,306,447C2 and JP-A-60-221320.

Generally, the grain surface has a flat structure, but it is also preferable in some cases to make the grain surface uneven intentionally. Examples are described, for example, in JP-A-58-106532 and 60-221320, and U.S. Pat. No. 4,643, 966.

The grain size of the emulsion used in the present invention can be evaluated, for example, by the diameter of the projected area equivalent to (assumed to be) a circle using an electron microscope; by the diameter of the grain volume equivalent to (assumed to be) a sphere, calculated from the projected area and the grain thickness; or by the diameter of a volume equivalent to a sphere, using the Coulter Counter method. A selection can be made in the wide range that is from ultrafine grains having a sphere-equivalent diameter of 0.01 microns or below to coarse grains having a sphere-equivalent diameter of 10 microns or more. Preferably grains of 0.1 microns or more but 3 microns or below are used as photosensitive silver halide grains.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the diameter of the projected area of the grain equivalent to a circle, or the deviation coefficient of the diameters of the grain volume equivalent to a sphere, can be used. If a monodisperse emulsion is used, it is preferable to use an emulsion having such a size distribution that the deviation coefficient is 25% or below, more preferably 20% or below, and further more preferably 15% or below.

Further, in order to allow the light-sensitive material to satisfy the intended gradation, in an emulsion layer having substantially the same color sensitivity, two or more monodisperse silver halide emulsions different in grain size can be mixed and applied to the same layer or can be applied as overlaid layers. Further, two or more polydisperse silver halide emulsions can be used as a mixture; or they can be used to form overlaid layers; or a combination of a monodisperse emulsion and a polydisperse emulsion can be used as a mixture; or the combination can be used to form overlaid layers.

As a protective colloid and as a binder of other hydrophilic colloid layers that are used when the emulsion according to the present invention is prepared, gelatin is used advantageously, but another hydrophilic colloid can also be used.

Use can be made of, for example, a gelatin derivative, a graft polymer of gelatin with another polymer, a protein, such as albumin and casein; a cellulose derivative, such as hydroxyethyl cellulose, carboxymethyl cellulose, and cellulose sulfates; a saccharide derivative, such as sodium alginate, a starch derivative; and many synthetic hydrophilic polymers, including homopolymers and copolymers, such as a polyvinyl alcohol, a polyvinyl alcohol partial acetal, a poly-N-vinylpyrrolidone, a polyacrylic acid, a polymethacrylic acid, a polyacrylamide, a polyvinylimidazole, and a polyvinylpyrazole.

As the gelatin, in addition to lime-processed gelatin, acid-processed gelatin, and enzyme-processed gelatin described in Bull. Soc. Sci. Photo. Japan, No. 16, page 30 (1966), can be used. Further a hydrolyzate or enzymolyzate of gelatin can also be used. For the preparation of tabular grains, it is preferable to use a low-molecular-weight gelatin described in JP-A-1-158426.

When the silver halide emulsion for use in the present invention is prepared, in accordance with the purpose, it is preferable to allow a salt of a metal ion to be present, for example, at the time when grains are formed, in the step of desalting, at the time when the chemical sensitization is carried out, or before the application. When the grains are doped, the addition is preferably carried out at the time when the grains are formed; or after the formation of the grains but before the completion of the chemical sensitization, when the surface of the grains is modified or when the salt of a metal ion is used as a chemical sensitizer. As to the doping of grains, selection can be made from a case in which the whole grains are doped, one in which only the core parts of the grains are doped, one in which only the shell parts of the grains are doped, one in which only the epitaxial parts of the grains are doped, and one in which only the substrate grains are doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a sulfate, a phosphate, a hydroxide, a six-coordinate complex, and a four-coordinate complex. Examples include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can preferably be selected from halogen, $H_2O$, cyano, cyanate, thiocyanate, nitrosyl, thionitrosyl, oxo, and carbonyl. With respect to these metal compounds, only one can be used, but two or more can also be used in combination.

In some cases, a method wherein a chalcogen compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The silver halide grains used in the present invention can be subjected to at least one of sulfur sensitization, selenium sensitization, tellurium sensitization (these three are called chalcogen sensitization, collectively), noble metal sensitization, and reduction sensitization, in any step of the production for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion used in the present invention, the location at which chemical sensitizing nuclei are situated can be selected in accordance with the purpose.

In the sulfur sensitization, an unstable sulfur compound is used, and specifically, known sulfur-containing compounds, such as thiosulfates (e.g. hypo), thioureas (e.g.

diphenylthiourea, triethylthiourea, and allylthiourea), rhodanines, mercaptos, thioamides, thiohydantoins, 4-oxo-oxazolidin-2-thions, di- or poly-sulfides, polythionates, and elemental sulfur, can be used. In many cases, sulfur sensitization is used in combination with noble metal sensitization.

In the selenium sensitization, known unstable selenium compounds are used, such as those described, for example, in U.S. Pat. Nos. 3,297,446 and 3,297,447, specific such selenium compounds are colloidal metal selenium, selenoureas (e.g. N,N-dimethylselenourea and tetramethylselenourea), selenoketones (e.g. selenoacetone), selenoamides (e.g. selenoacetamide), selenocarboxylic acids and esters, isoselenocyanates, selenides (e.g. diethylselenides and triphenylphosphine selenide), and selenophosphates (e.g. tri-p-tolylselenophosphate). In some cases, preferably the selenium sensitization is used in combination with one or both of sulfur sensitization and noble metal sensitization.

As the tellurium sensitizing agent used in the present invention, compounds described, for example, in CA-800 958, GB-1 295 462 and 1 396 696, and Japanese patent application Nos. 2-333819 and 3-131598 can be used.

In the noble metal sensitization, a salt of a noble metal, such as gold, platinum, palladium, and iridium, can be used, and specifically gold sensitization, palladium sensitization, and a combination thereof are particularly preferable. In the case of gold sensitization, a known compound, such as chloroauric acid, potassium chloroaurate, potassium auriothiocyanate, gold sulfide, and gold selenide, can be used. The palladium compound means salts of divalent or tetravalent palladium salt. A preferable palladium compound is represented by $R_2PdX_6$ or $R_2PdX_4$, wherein R represents a hydrogen atom, an alkali metal atom, or an ammonium radical; and X represents a halogen atom, i.e. a chlorine atom, a bromine atom, or an iodine atom.

Preferably that the silver halide emulsion is subjected to reduction sensitization during the formation of the grains, after the formation of the grains but before the chemical sensitization, or during or after the chemical sensitization.

The chemical sensitization can be carried out in the presence of a so-called chemical sensitization auxiliary. As a useful chemical sensitization auxiliary, a compound can be used that is known to suppress fogging and to increase the sensitivity in the process of chemical sensitization, such as azaindene, azapyridazine, and azapyrimidine.

Preferably an oxidizing agent for silver is added during the process of the production of the emulsion. The oxidizing agent for silver refers to a compound that acts on metal silver to convert it to silver ions. Particularly useful is a compound that converts quite fine silver grains, which are concomitantly produced during the formation of silver halide grains and during the chemical sensitization, to silver ions.

Use of a combination of the above reduction sensitization with the oxidizing agent for silver is a preferable mode.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (e.g. 1-phenyl-5-mercaptotetrazole, 1-(5-methylureidophenyl)-5-mercaptotetrazole), mercaptopyrimidines, mercaptotriazines; thioketo compounds, such as oxazolinthione; and azaindenes, such as triazaindenes, tetraazaindenes (particularly 4-hydroxy-6-methyl-1,3,3a,7-tetraazaindene), and pentaazaindenes.

Preferably, the photographic emulsion to be used in the present invention is spectrally sensitized with methine dyes and the like. Dyes that can be used include cyanine dyes, merocyanine dyes, composite cyanin dyes, composite merocyanine dyes, halopolar cyanine dyes, hemicyanine dyes, styryl dyes, and hemioxonol dyes. Particularly useful dyes are those belonging to cyanine dyes, merocyanine dyes, and composite merocyanine dyes. In these dyes, any of nuclei generally used in cyanine dyes as base heterocyclic nuclei can be applied.

To the light-sensitive material used in the present invention, may be added the above-mentioned various additives, and also other various additives in accordance with the purpose.

These additives are described in more detail in Research Disclosure, Item 17643 (December 1978); Research Disclosure, Item 18176 (November 1979); and Research Disclosure, Item 307105 (November 1989), and the particular parts are given below in a table.

| | Type of additive | RD17643 | RD18716 | RD307105 |
|---|---|---|---|---|
| 1 | Chemical sensitizers | page 23 | page 648, right column | page 996 |
| 2 | Sensitivity increasers | | ditto | |
| 3 | Spectral sensitizers, Super sensitizers | pages 23–24 | page 648, right column to page 649, right column | page 996, right column to page 998, right column |
| 4 | Whitening agents | page 24 | | page 998, right column |
| 5 | Antifoggant, Stabilizer | pages 24–25 | page 649, right column to | page 998, right column to page 1000, right column |
| 6 | Light absorbing agent, Filter dyes, Ultraviolet absorbers | pages 25–26 | page 649, right column to page 650, left column | page 1003, left column to page 1003, right column |
| 7 | Antistaining agents | page 25, right column | page 650, left to right column | |
| 8 | Dye image stabilizers | page 25 | | |
| 9 | Hardeners | page 26 | page 651, left column | page 1004, right column to page 1005, left column |
| 10 | Binders | page 26 | ditto | page 1003, right column to page 1004, right column |
| 11 | Plasticizers, and lubricants | page 27 | page 650, right column | page 1006, left column to page 1006, right column |
| 12 | Coating aids, Surface-active agents | pages 26–27 | ditto | page 1005, left column to page 1006, left column |
| 13 | Antistatic agents | page 27 | ditto | page 1006, right column to page 1007, left column |

The total coated amount of silver of the light-sensitive material for use in the present invention is preferably 0.003 to 12 g per $m^2$ in terms of silver. In the case of transmission-type materials, such as color negative films, that amount is preferably 1 to 12 g, and more preferably 3 to 10 g. In the case of reflection-type materials, such as color print papers, that amount is preferably 0.003 to 1 g, in view of rapid processing or lowering of the replenishing rate, and in that case the amount of addition in each light-sensitive layer is preferably 0.001 to 0.4 g. In particular, when the light-sensitive material for use in the present invention is subjected to an intensification process, the amount is preferably 0.003 to 0.3 g, more preferably 0.01 to 0.1 g, and particularly preferably 0.015 to 0.05 g. In that case, the amount in each light-sensitive layer is preferably 0.001 to 0.1 g, and more preferably 0.003 to 0.03 g.

In the present invention, if the coated amount of silver in each light-sensitive layer is too small, the dissolution of silver salts progresses and a satisfactory color density cannot be obtained. On the other hand, if the coated amount of silver in each light-sensitive layer is too large when the intensification process is carried out, there will be an increase in Dmin or bubbling will occur, easily making the resultant material be deteriorated to look it appreciatively.

The total amount of gelatin of the light-sensitive material for use in the present invention is generally 1.0 to 30 g, and preferably 2.0 to 20 g, per $m^2$. In the swelling of the light-sensitive material in an alkali solution having a pH of 12, the time for the swelled film thickness to reach ½ of its saturated swelled film thickness (90% of the maximum swelled thickness) is preferably 15 sec or less, and more preferably 10 sec or less. Further, the swelling rate [(maximum swelled film thickness−film thickness)/film thickness×100] is preferably 50 to 300%, and particularly preferably 100 to 200%.

The processing method of the present invention can be applied to various light-sensitive materials. As examples can be mentioned color negative films, color negative print papers, color reversal print papers, autopositive print papers, color reversal films, negative films for movies, positive films for movies, roentgen films, films for graphic arts, including lith films, and black-and-white negative films. Above all, the processing method of the present invention is preferably applied to color negative films and color negative papers.

Further, in color negative films and color reversal films, ones having a magnetic recording layer on the base are particularly preferable.

Now, light-sensitive materials having a magnetic recording layer that are preferably processed in accordance with the present invention are described.

The magnetic recording layer is a layer formed by coating on a base with an aqueous or organic solvent coating solution containing magnetic particles dispersed in a binder. To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable.

The shape may be any of a needle shape, a rice grain shape, a spherical shape, a cubic shape, a plate-like shape, and the like. The specific surface area is preferably 20 $m^2/g$ or more, and particularly preferably 30 $m^2/g$ or more, in terms of $S_{BET}$. The saturation magnetization (σs) of the ferromagnetic material is preferably $3.0\times10^{-4}$ to $3.0\times10^{-5}$ A/m, and particularly preferably $4.0\times10^{-4}$ to $2.5\times10^{-5}$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or an organic material, as described in JP-A-4-259911 and 5-81652, can be used.

As the binder used for the magnetic particles, as described in JP-A-4-219569, a thermoplastic resin, a thermal-setting resin, a radiation-setting resin, a reactive resin, an acid-degradable polymer, an alkali-degradable polymer, a biodegradable polymer, a natural polymer (e.g. a cellulose derivative and a saccharide derivative), and a mixture of these can be used. The above resins generally have a glass transition temperature Tg of −40 to 300° C. and a weight-average molecular weight of 2,000 to 1,000,000. Examples include vinyl copolymers, cellulose derivatives, such as cellulose diacetates, cellulose triacetates, cellulose acetate propionates, cellulose acetate butylates, and cellulose tripropionates; acrylic resins, and polyvinyl acetal resins; and gelatin is also preferable. Cellulose di(tri)acetates are particularly preferable. To the binder may be added an epoxy, aziridine, or isocyanate crosslinking agent, to harden the binder. Examples of the isocyanate crosslinking agent include isocyanates, such as tolylene diisocyanate, 4,4'-diphenylmethane diisocyanate, hexamethylene diisocyanate, and xylylene diisocyanate; reaction products of these isocyanates with polyalcohols (e.g. a reaction product of 3 mol of tolylene diisocyanate with 1 mol of trimethylolpropane), and polyisocyanates produced by condensation of these isocyanates, which are described, for example, in JP-A-6-59357.

The method of dispersing the foregoing magnetic material in the foregoing binder is preferably one described in JP-A-6-35092, in which method use is made of a kneader, a pin-type mill, an annular-type mill, and the like, which may be used alone or in combination. A dispersant described in JP-A-5-088283 and other known dispersants can be used.

The thickness of the magnetic recording layer is generally 0.1 to 10 μm, preferably 0.2 to 5 μm, and more preferably 0.3 to 3 μm. The weight ratio of the magnetic particles to the binder is preferably from (0.5:100) to (60:100), and more preferably from (1:100) to (30:100).

The coating amount of the magnetic particles is generally 0.005to 3 $g/m^2$, preferably 0.01 to 2 $g/m^2$, and more preferably 0.02 to 0.5 $g/m^2$.

The magnetic recording layer used in the present invention can be provided to the undersurface of the photographic base by coating or printing through all parts or in a striped fashion. To apply the magnetic recording layer, use can be made of an air doctor, a blade, an air knife, squeezing, impregnation, a reverse roll, a transfer roll, gravure, kiss, cast, spraying, dipping, a bar, extrusion, or the like. A coating solution described, for example, in JP-A-5-341436 is preferable.

The magnetic recording layer may be provided with functions, for example, of improving lubricity, of regulating curling, of preventing electrification and adhesion, and of abrading a head, or it may be provided with another functional layer that is provided with these functions. An abrasive in which at least one type of particles comprises aspherical inorganic particles having a Moh's hardness of 5 or more, is preferable. The aspherical inorganic particles preferably comprise a fine powder of an oxide, such as aluminum oxide, chromium oxide, silicon dioxide, and titanium dioxide; a carbide, such as silicon carbide and titanium carbide; diamond, or the like. The surface of these abrasives may be treated with a silane coupling agent or a titanium coupling agent. These particles may be added to the magnetic recording layer, or they may form an overcoat (e.g. a protective layer and a lubricant layer) on the magnetic recording layer. As a binder used at that time, the above-mentioned binders can be used, and preferably the same binder as used in the magnetic recording layer is used. Light-sensitive materials having a magnetic recording layer are described in U.S. Pat. Nos. 5,336,589, 5,250,404, 5,229,259, and 5,215,874, and EP-466 130.

Preferable processing machine (processor) used in the present invention is described below.

The contact area between a photographic processing solution and air in the processing tank can be expressed in terms of the opening ratio, as defined below. That is, Opening ratio=[contact area($cm^2$) of the processing solution with air]÷[Volume($cm^3$) of the processing solution]

In the present invention, the above-defined opening ratio is preferably 0.1 or less, and more preferably from 0.001 to 0.05. The opening ratio can be reduced by, for example, putting a barrier, such as a floating lid, on the liquid surface of the photographic processing solution in the processing tank, using a movable lid, as described in JP-A-1-82033, or utilizing slit development processing, as described in JP-A-63-216050. Further, the opening ratio can be reduced by contacting the liquid surface of the processing solution with a liquid capable of covering over the liquid surface, such as a liquid paraffin, or with a poorly oxidizable and/or non-oxidizable gas. Reduction of the opening ratio is preferable in not only activator but also all the subsequent steps, such as bleach-fix(blix), fixing, washing, and stabilization.

Further, in the processor used in the processing of the present invention, if the thickness of the section of the processing tank at the gas/liquid interface and orthogonal to the traveling direction of the light-sensitive material is W, preferably W is in such a range that $0.1 \leqq W \leqq 2$ cm, and particularly preferably $0.3 \leqq W \leqq 1$ cm. Thus, by decreasing the thickness of the cross-sectional area of the tank at the gas/liquid interface, the area of the processing solution in contact with air can be made small, to prevent the processing solution from being deteriorated.

The followings can be mentioned as preferable modes of the processor that satisfies the above conditions: a light-sensitive material apparatus comprising a V-shaped processing tank where a processing solution for processing a light-sensitive material is held, a guide section, which is formed at part of a wall where the processing tank is not located, that is for guiding the light-sensitive material, and that constitutes a path for conveying the light-sensitive material, and a conveying means disposed in the processing tank that conveys the light-sensitive material along the conveying path; and a light-sensitive material processing apparatus, wherein a processing tank forms a processing path in the form of a slit, as described, for example, in JP-A-2-67552.

In the present invention, if the tank volume at the processing section is V ml and the path length from the inlet of the processing section for the light-sensitive material to the outlet thereof is L cm, it is preferable $V/L \leqq 25$, and particularly preferably $V/L \leqq 20$. Herein, the term "tank volume (V)" means the volume of the processing tank where the light-sensitive material is passed, and it excludes the volume of a subtank for the liquid adjustment, the temperature adjustment, the aeration, etc., of the circulating system. By "L" is meant the path length of the processing section; that is, the path length from the point where the light-sensitive material comes in contact with the processing solution, to the point where the light-sensitive material leaves the processing solution. Preferably the tank volume (V) is in the range of 50 to 5000 ml, and particularly preferably 100 to 3000 ml. The path length (L) varies depending on the type of the processing solution, and the time required for the processing, but L is generally preferably 2 to 200 cm, and more preferably 4 to 150 cm.

A cross-sectional view of an embodiment of a light-sensitive material processing apparatus that can be preferably used in the processing method of the present invention is shown in FIG. 1.

As is shown in FIG. 1, a light-sensitive material processing apparatus 10 preferable for this embodiment is provided with a slit-like processing path 12 for simple processing with the amount of a processing solution being reduced. Herein the slit-like path 12 means a path of a so-called slit type; that is, the section of the passage in the processing tank through which the light-sensitive material is passed, with the section being vertical to the traveling direction of the light-sensitive material, is thin in comparison with the width (in the direction of the width of the light-sensitive material). Further, the shape of the slit may be rectangular or elongated oval. Further, in the processing tank, if the curvature radius of the shape of the processing path at the processing tank bottom is R, preferably the diameter is such that $10 \leqq R \leqq 70$ mm, and further preferably $20 \leqq R \leqq 50$ mm. If R is too large, the processing apparatus becomes large, whereas if R is too small, defective conveying of the light-sensitive material likely occurs.

The path length of the processing path 12 is determined depending on the type of the processing solution and the time required for the processing (the time of the dipping in the processing solution). The slit-like processing path 12 may be provided in all of the processing tanks of the light-sensitive material processing apparatus, or it may be provided in some of the processing tanks and other tanks may work similarly to conventional tanks. In this light-sensitive material processing apparatus 10, all of the processing tanks are provided with the slit-like processing paths 12, in which apparatus 10 a developing tank (color-developing tank/activator tank) 14 having a path length corresponding to the processing time is arranged adjacent to a bleach-fix tank 16, and the light-sensitive material subjected to development in the developing tank 14 is sent by a pair of conveying rollers 18 to the next processing tank, i.e. the bleach-fix tank 16. Four rinsing tanks 20 are arranged adjacent to the bleach-fix tank 16. A developing solution is stored in the developing tank 14, a bleach-fix solution is stored in the bleach-fix tank 16, and a rinsing solution is stored in each of the four rinsing tanks 20.

Further, a drying zone 21 is arranged on the open side of the final rinsing tank (4) 20, and the light-sensitive material coming out of the rinsing tank 20 is inserted into the drying fan, where it will be dried.

In the present invention, the conveying speed of the light-sensitive material in the processor is preferably in the range of 0.1 to 5 m, more preferably 0.2 to 3 m, and particularly preferably 0.3 to 1.5 m, per minute.

The method of conveying a light-sensitive material that is applied to a preferable processor in the present invention is not particularly limited, and a known conveying method, such as a roller-type conveying method, wherein a light-sensitive material is conveyed by nip pressure of a pair of conveying rollers; a drum processing method, wherein a light-sensitive material is inserted into, conveyed through, and delivered into a processing solution kept in a narrow gap by the rotation of a drum; or a so-called leader trailer conveying system, can be chosen to meet the purpose.

According to the processing method of the present invention, by the use of a material excellent in environmental preservation, the light-sensitive material after the processing in a processing step that was excellent in handleability was less in stain, and the effect of the invention excellent in less change in aging of the yellow minimum density and less change in aging of the cyan maximum density, and further, less change in aging associated with the progress of the processing, could be obtained.

EXAMPLES

The present invention will be described in more detail with reference to examples, but the present invention is not restricted to them.

Example 1

(Preparation for Light-sensitive Material)

A paper base, both surfaces of which had been laminated with a polyethylene, was subjected to surface corona discharge treatment; then it was provided with a gelatin undercoat layer containing sodium dodecylbenzensulfonate, and it was coated with various photographic constitutional layers, to produce a multi-layer color printing paper having the layer constitution shown below. The multi-layer color printing paper is named Sample (101).

The coating solutions were prepared as follows.

(Preparation for First-Layer Coating Solution)

27.8 g of a yellow-forming coupler (ExY-1), and 20.5 g of a color-forming reducing agent (CH-32), were dissolved in 52 g of a solvent (Solv-4) and 73 ml of ethyl acetate, and the resulting solution was emulsified and dispersed into 420 ml of a 12% aqueous gelatin solution containing 10% sodium dodecylbenzensulfonate and citric acid, to prepare an emulsified dispersion D.

On the other hand, a silver chlorobromide emulsion D (cubes, a mixture of a large-size emulsion having an average grain size of 0.88 $\mu$m, and a small-size emulsion having an average grain size of 0.70 $\mu$m (3:7 in terms of mol of silver), the deviation coefficients of the grain size distributions being 0.08 and 0.10 respectively, and each emulsion having 0.3 mol % of silver bromide locally contained in part of the grain surface whose substrate was made up of silver chloride) was prepared. To the large-size emulsion of this emulsion, had been added $1.4\times10^{-4}$ mol, per mol of silver, of each of blue-sensitive sensitizing dyes 1, 2, and 3 shown below, and to the small-size emulsion of this emulsion, had been added $1.7\times10^{-4}$ mol, per mol of silver, of each of blue-sensitive sensitizing dyes 1, 2, and 3 shown below. The chemical ripening of this emulsion was carried out optimally with a sulfur sensitizer and a gold sensitizer being added. The above emulsified dispersion D and this silver chlorobromide emulsion D were mixed and dissolved, and a first-layer coating solution was prepared.

Blue-sensitive sensitizing dyes

Sensitizing dye 1

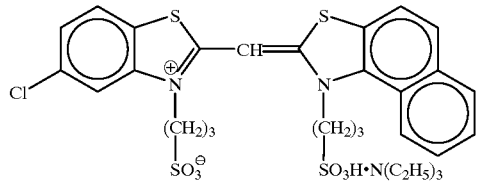

Sensitizing dye 2

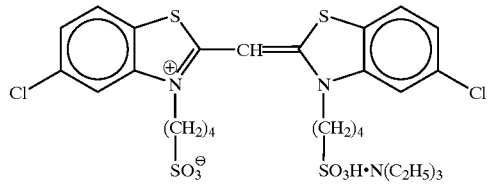

Sensitizing dye 3

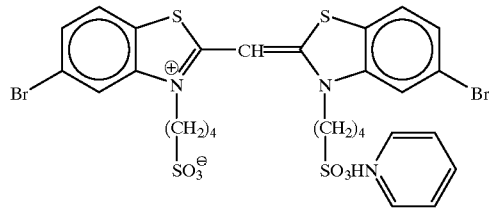

The coating solutions for the third-layer and the fifth-layer were prepared shown below in the similar manner as that for the first-layer coating solution. That is, a silver chlorobromide emulsion E for the third-layer (cubes, a mixture of a large-size emulsion having an average grain size of 0.50 $\mu$m, and a small-size emulsion having an average grain size of 0.41 $\mu$m (1:4 in terms of mol of silver), the deviation coefficients of the grain size distributions being 0.09 and 0.11 respectively, and each emulsion having 0.8 mol % of silver bromide locally contained in part of the grain surface whose substrate was made up of silver chloride) was prepared. To the large-size emulsion of this emulsion, had been added $3.0\times10^{-4}$ mol, per mol of silver, of green-sensitive sensitizing dye 1 shown below, and to the small-size emulsion of this emulsion, had been added $3.6\times10^{-4}$ mol, per mol of silver, of green-sensitive sensitizing dye 1 shown below. To the large-size emulsion of this emulsion, had been added $4.0\times10^{-5}$ mol, per mol of silver, of green-sensitive sensitizing dye 2 shown below, and to the small-size emulsion of this emulsion, had been added $7.0\times10^{-5}$ mol, per mole of silver, of green-sensitive sensitizing dye 2 shown below. Further to the large-size emulsion of this emulsion, had been added $2.0\times10^{-4}$ mol, per mol of silver, of green-sensitive sensitizing dye 3 shown below, and to the small-size emulsion of this emulsion, had been added $2.8\times10^{-4}$ mol, per mol of silver, of green-sensitive sensitizing dye 3 shown below. The silver chlorobromide emulsion E, and an emulsified dispersion E, which was prepared in the some manner as in the emulsified dispersion D, except for containing a magenta-forming coupler (ExM-1) and a color-forming reducing agent (CH-32), were mixed and dissolved, and a third-layer coating solution was prepared.

Green-sensitive sensitizing dyes

Sensitizing dye 1

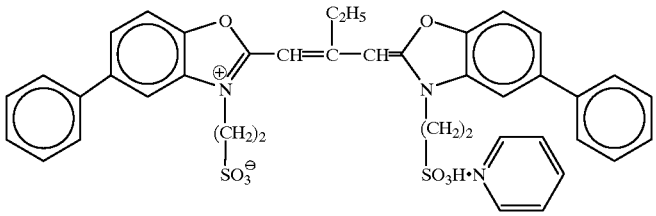

Sensitizing dye 2

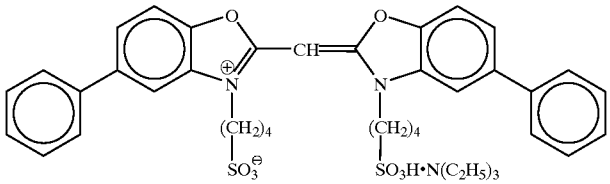

Sensitizing dye 3

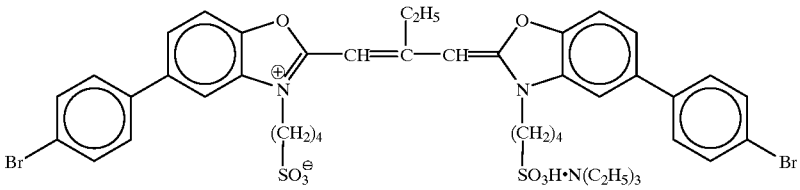

A silver chlorobromide emulsion F for the fifth-layer (cubes, a mixture of a large-size emulsion having an average grain size of 0.50 μm, and a small-size emulsion having an average grain size of 0.41 μm (1:4 in terms of mol of silver), the deviation coefficients of the grain size distributions being 0.09 and 0.11 respectively, and each emulsion having 0.8 mol % of silver bromide locally contained in part of the grain surface whose substrate was made up of silver chloride) was prepared. To the large-size emulsion of this emulsion, had been added $5.0\times10^{-5}$ mol, per mol of silver, of red-sensitive sensitizing dye 1 shown below, and to the small-size emulsion of this emulsion, had been added $6.0\times10^{-5}$ mol, per mol of silver, of red-sensitive sensitizing dye 1 shown below. Further, to the large-size emulsion of this emulsion, had been added $5.0\times10^{-5}$ mol, per mol of silver, of red-sensitive sensitizing dye 2 shown below, and to the small-size emulsion of this emulsion, had been added $6.0\times10^{-5}$ mol, per mol of silver, of red-sensitive sensitizing dye 2 shown below.

Red-sensitive sensitizing dyes

Red-sensitive sensitizing dye-1

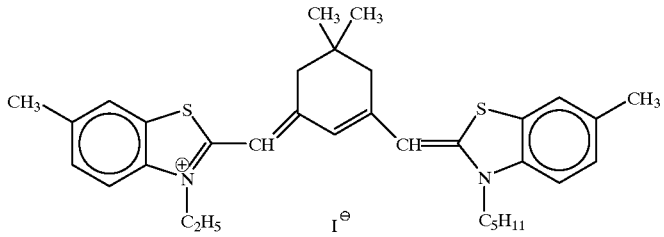

Red-sensitive sensitizing dye-2

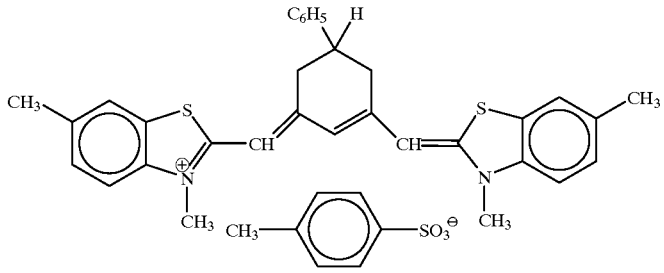

Further, to the fifth layer, had been added $2.6\times10^{-3}$ mol, per mol of silver, of a compound (A-2).

The silver cholorobromide emulsion F, and an emulsified dispersion F, which was prepared in the same manner as in the emulsified dispersion D, except for containing a cyan-forming coupler (ExC-1) and a color-forming reducing agent (CH-16), were mixed and dissolved, and a fifth-layer coating solution was prepared.

(ExY-1) Yellow coupler

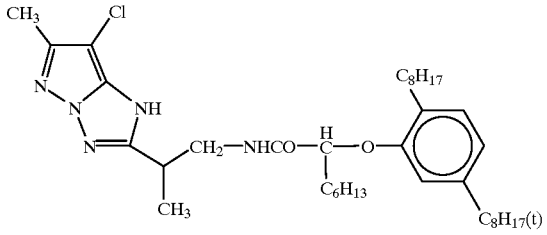

(ExM-1)Magenta coupler

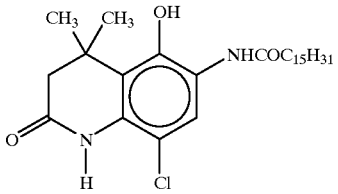

(ExC-1)Cyan coupler

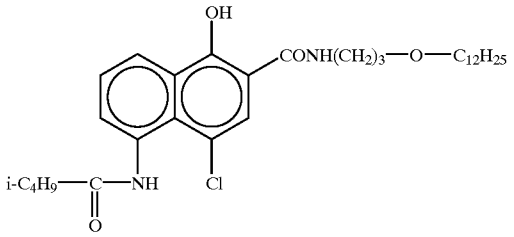

-continued

A-2

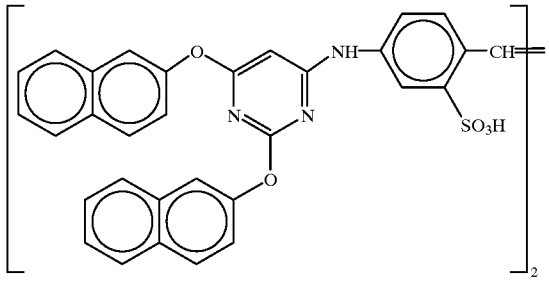

A second-layer, a fourth-layer, a sixth-layer, and a seventh-layer were also prepared to give the respective composition shown below.

Further, to the intermediate-layers of the second-layer and the fourth-layer were added, respectively, $1.4\times10^{-4}$ mol of an auxiliary developing agent (ETA-6) in a state of a dispersion of solid fine-particles.

The solvent, the color-image stabilizer, the ultraviolet absorber, the color-mixing inhibitor, the surface active agent, etc. were used as the same compounds as in example 1.

As the gelatin hardener for each layer, 1-oxy-3,5-dichloro-s-triazine sodium salt was used.

Further, to each layer, were added Cpd-4 and Cpd-5, so that the total amounts would be 25 mg/$m^2$ and 50 mg/m2, respectively.

To the blue-sensitive emulsion layer, the green-sensitive emulsion layer, and the red-sensitive emulsion layer, was added 1-(5-methylureidophenyl)-5-mercaptotetrazole in amounts of $8.5\times10^{-5}$ mol, $9.0\times10^{-4}$ mol, and $2.5\times10^{-4}$ mol, respectively, per mol of the silver halide. Further, to the blue-sensitive emulsion layer and the green-sensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dyes were added to the emulsion layers (the coating amount is shown in parentheses).

Irradiation neutralizing dye

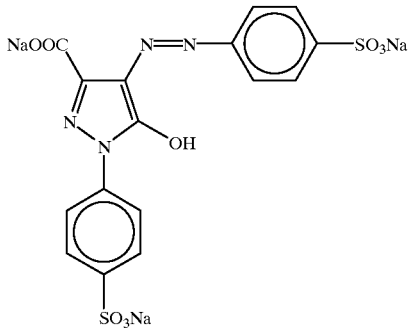

(10mg/$m^2$)

-continued

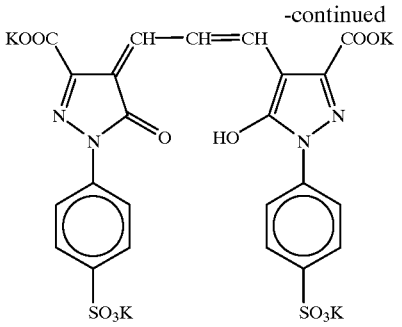

(10mg/m$^2$)

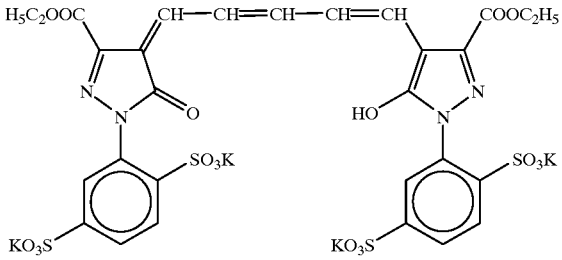

(40mg/m$^2$)

and

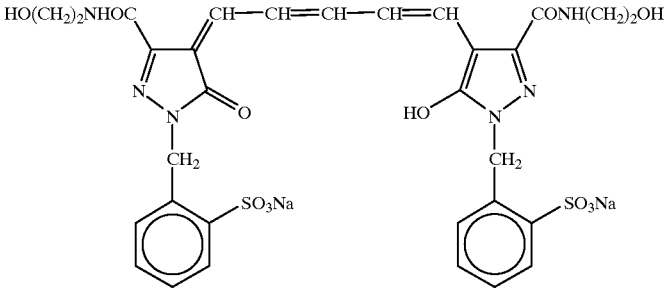

(20mg/m$^2$)

(Layer Constitution)

The composition of each layer is shown below. The numbers show coating amounts (g/m$^2$). In the case of the silver halide emulsion, the coating amount is in terms of silver.

TABLE 1

| | |
|---|---|
| Base | |
| Polyethylene-Laminated Paper [The polyethylene on the first layer side contained a white pigment ($TiO_2$) and a blue dye (ultramarine)] | |
| First Layer (Blue-Sensitive Emulsion Layer) | |
| The above silver chlorobromide emulsion D | 0.20 |
| Gelatin | 1.54 |
| Yellow coupler (ExY-1) | 0.35 |
| Color-forming reducing agent (CH-32) | 0.26 |
| Solvent (Solv-4) | 0.78 |
| Second Layer (Color-Mixing Inhibiting Layer) | |
| Gelatin | 1.00 |
| Color-mixing inhibitor (Cpd-1) | 0.08 |
| Solvent (Solv-1) | 0.25 |
| Solvent (Solv-2) | 0.15 |
| Solvent (Solv-3) | 0.13 |
| Third Layer (Green-Sensitive Emulsion Layer) | |
| Silver chlorobromide emulsion E | 0.20 |
| Gelatin | 1.55 |
| Magenta coupler (ExM-1) | 0.34 |

TABLE 1-continued

| | |
|---|---|
| Color-forming reducing agent (CH-32) | 0.26 |
| Solvent (Solv-4) | 0.78 |
| Fourth Layer (Color-mixing Inhibiting Layer) | |
| Gelatin | 1.00 |
| Color-mixing inhibitor (Cpd-1) | 0.08 |
| Solvent (Solv-1) | 0.25 |
| Solvent (Solv-2) | 0.15 |
| Solvent (Solv-3) | 0.13 |
| Fifth Layer (Red-Sensitive Emulsion Layer) | |
| Silver chlorobromide emulsion F | 0.20 |
| Gelatin | 1.50 |
| Cyan coupler (ExC-1) | 0.29 |
| Color-forming reducing agent (CH-16) | 0.26 |
| Solvent (Solv-4) | 0.78 |
| Sixth Layer (Ultraviolet Absorbing Layer) | |
| Gelatin | 0.60 |
| Ultraviolet absorbing agent (UV-1) | 0.57 |
| Color-image stabilizer (Cpd-2) | 0.06 |
| Solvent (Solv-1) | 0.05 |
| Seventh Layer (Protective Layer) | |
| Gelatin | 1.00 |
| Acryl-modified copolymer of polyvinyl alcohol (modification degree: 17%) | 0.05 |
| Liquid paraffin | 0.02 |
| Surface-active agent (Cpd-3) | 0.01 |

(Solv-1)
Solvent
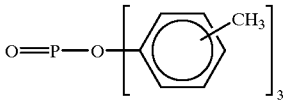
(Solv-2)
Solvent
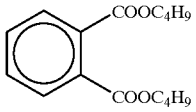
(Solv-3)
Solvent
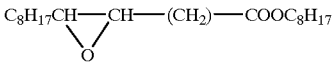
(Solv-4)
Solvent
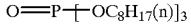
(Cpd-1)
Color-mixing inhibitor
1:1:1 mixture (by weight ratio) of
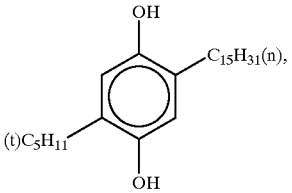
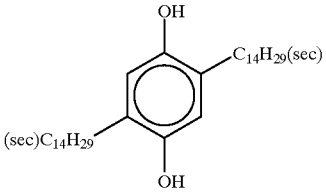
and
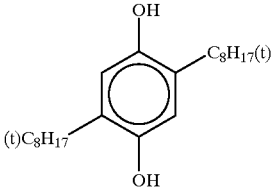
(Cpd-2)
Color-image stabilizer
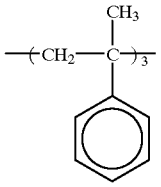
number-average
molecular weight 600
(Cpd-3)
Surface-active agent
2:1:1 mixture (by weight ratio) of
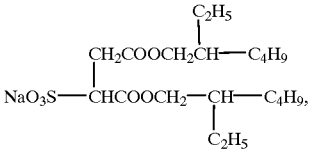
-continued
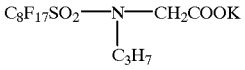
and
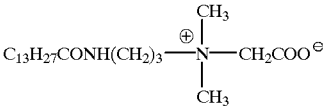
(Cpd-4)
Antiseptic
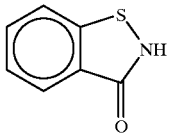
(Cpd-5)
Antiseptic
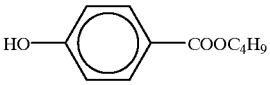
(UV-1)
Ultraviolet absorbing agent
1:2:2:3:1 mixture (by weight ratio) of
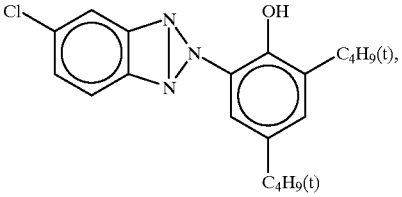
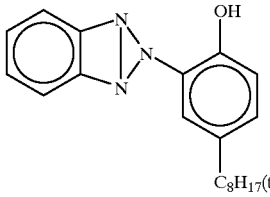
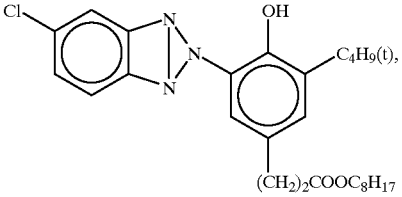
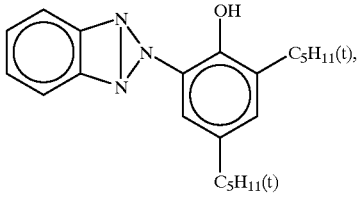
and
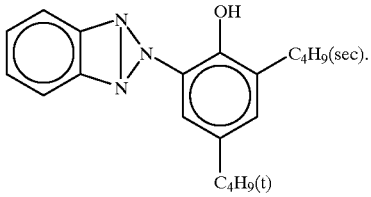

Sample (102) was prepared in the same manner as in Sample (101), except that the color-forming reducing agents (CH-32) and (CH-16) were changed to the color-forming reducing agent (CH-61), in the same molar amounts, and that ExY-1, ExM-1 and ExC-1 were changed, respectively, to ExY-2, ExM-2 and ExC-2, shown below, in the same molar amounts.

Further, Sample (100) containing no color-forming reducing agent, was prepared in the same manner as in Sample (101), except that the additives CH-32 and CH-16 in the first layer, the third layer and the fifth layer were not added.

(ExY-2)

Yellow coupler

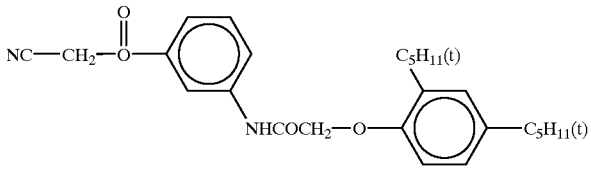

(ExM-2)

Magenta coupler

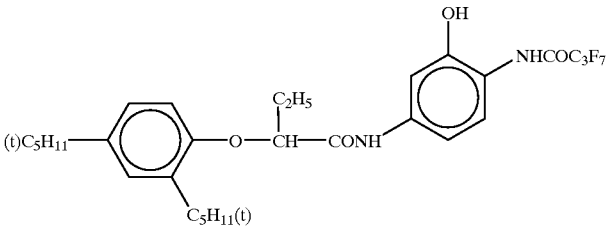

(ExC-2)

Cyan coupler

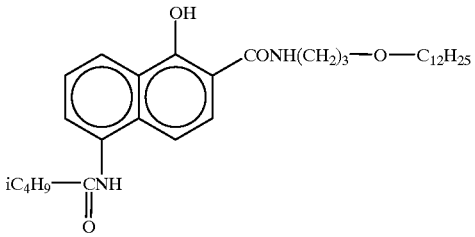

Sample (100) processed by the above method was cut to have a width of 12.7 cm, was exposed to light imagewise, and was given gradation exposure of three-color separation filters for sensitometry.

Exposed Sample (100) was processed daily for one month, such that 1 $m^2$ was processed per day through the below-shown process. During this period, the exposed part for sensitometry was processed first and last daily, and the imagewise-exposed part was processed there between. In the processing, a processor in conformity to the above light-sensitive material processing apparatus shown in FIG. 1 was used. The processing steps and the processing solution compositions are shown below:

(Processing step)

| Processing step | Time | Temperature | Replenisher* | Tank Volume | Opening Ratio |
|---|---|---|---|---|---|
| Color developing | 30 sec | 40° C. | 45 ml | 2.0 liter | 0.003 |

-continued

| Processing step | Time | Temperature | Replenisher* | Tank Volume | Opening Ratio |
|---|---|---|---|---|---|
| Bleach-Fixing | 30 sec | 40° C. | 30 ml | 1.5 liter | 0.005 |
| Rinse (1) | 15 sec | 40° C. | — | 1.0 liter | 0.007 |
| Rinse (2) | 15 sec | 40° C. | — | 1.0 liter | 0.007 |
| Rinse (3) | 15 sec | 40° C. | — | 1.0 liter | 0.007 |
| Rinse (4) | 15 sec | 40° C. | 150 ml | 1.0 liter | 0.007 |
| Drying | 30 sec | 80° C. | | | |

Note: *Replenisher amount per $m^2$ of the light-sensitive material.

The rinsing was of a counter current system from (4) to (1). The amount of the carryover to the subsequent bath was 25 ml per $m^2$ of the light-sensitive material. In each case, the time of the crossover was 3 sec and was included in the processing time of the previous step.

| (Color-developing Solution) | Tank solution | Reple-nisher |
|---|---|---|
| Cation-exchanged water | 800 ml | 800 ml |
| Dimethylpolysiloxane-series surface-active agent (Silicone KF351A; trade name, manufactured by Shinetsu Chemical Industry Co., Ltd.) | 0.1 g | 0.1 g |
| Ethylenediamine-N,N,N',N'-tetraacetic acid | 4.0 g | 4.0 g |
| Sodium 4,5-dihydroxybenzene-1,3-disulphonate | 0.5 g | 0.5 g |
| Triethanolamine | 12.0 g | 12.0 g |
| Potassium chloride | 12.0 g | — |
| Potassium bromide | 45 mg | — |
| Triazinyl-4,4-diaminostilbene-series brightening agent (Hacchol OW-10EX; trade name, manufactured by Showa Chemical Industry Co., Ltd.) | 1.0 g | 3.0 g |
| Sodium sulfite | 0.1 g | 0.1 g |
| Disodium-N,N-bis(sulfonatoethyl)-hydroxylamine | 8.0 g | 15.0 g |
| Sodium triisopropylnaphthalene(β) sulfonate | 0.1 g | 0.1 g |
| N-ethyl-N(β-methanesulfonamidoethyl)-3-methyl-4-aminoaniline 3/2 sulfonate.monohydrat | 5.0 g | 18.0 g |
| Pottasium carbonate | 27.0 g | 27.0 g |
| Water to make | 1000 ml | 1000 ml |
| pH (25° C., adjusted by potassium) hydroxide or sulfuric acid) | 10.15 | 12.6 |

| (Bleach-fix Solution) | Tank solution | Reple-nisher |
|---|---|---|
| Water | 700 ml | 700 ml |
| Chelating agent described in Table 2 | 0.17 mol | 0.35 mol |
| Iron (III) nitrate nonahydrate | 0.15 mol | 0.33 mol |
| Ammonium thiosulfate (750 g/liter) | 200 ml | 330 ml |
| Ammonium sulfite | 35.0 g | 80.0 g |
| Water to make | 1,000 ml | 1,000 ml |
| pH (25° C./adjusted by sulfuric acid or aqueous ammonia) | 7.00 | 6.00 |

| (Rinse) | Both tank solution and replenisher |
|---|---|
| Sodium chlorinated isocyanurate | 0.02 g |
| Deionized water (conductivity: 5 μs/cm or below) | 1000 ml |
| pH | 6.5 |

Then, the Samples (101) and (102), were processed and evaluated in the same manner as that of Sample (100), respectively, except that the color developing step using the color developing solution was changed to an activator treatment shown below using an activator solution.

| Processing step | Time | Temperature | Reple-nisher* | Tank Volume | Opening ratio |
|---|---|---|---|---|---|
| Activator | 30 sec | 40° C. | 45 ml | 2.0 liter | 0.003 |

| (Activator Solution) | Tank solution | Reple-nisher |
|---|---|---|
| Water | 800 ml | 800 ml |
| Tripotassium phosphate | 20.0 g | 25.0 g |

-continued

| (Activator Solution) | Tank solution | Reple-nisher |
|---|---|---|
| Potassium chrolide | 10.0 g | 12.0 g |
| Hydroxyethylidene-1,1-diphosphonic acid (30% solution) | 2.0 ml | 3.0 ml |
| Water to make | 1,000 ml | 1,000 ml |
| pH (25° C./adjusted by KOH or sulfuric acid) | 12.00 | 12.7 |

With respect to Samples (100) to (102) processed by the above method, the stain of the light-sensitive materials was visually evaluated. With respect to the first sensitometry exposed part at the start of the processing and the last sensitometry part at the last of the processing, the minimum density (Dmin(B)) of yellow and the maximum density (Dmax(R)) of cyan were measured, using a densitometer FSD 103, manufactured by Fuji Photo Film Co., Ltd.

The samples whose densities were measured in the above method were stored under the below-shown conditions, and after the storage, respective densities were measured to find the changes ΔDmin(B) and ΔDmax(R), according to the following. Further, from the change in aging of the samples at the start of the processing and the change in aging of the samples at the end of the processing, the changes (ΔRun) resulting from the progress of the processing were found. The results are shown in Table 2. (Conditions of storage): under forced conditions of 100° C. for 3 weeks ΔDmin(B)=(Dmin(B) measured after the storage)−(Dmin(B) measured before the storage)

ΔDmax(R)=(Dmax(R) measured before the storage)−(Dmax(R) measured after the storage)

Run(B)=(ΔDmin(B) of the last processed part)−(ΔDmin(B) of the first processed part)

ΔRun(R)=(ΔDmax(R) of the last processed part)−(ΔDmax(R) of the first processed part)

TABLE 2

| Sam-ple | Chelating agent | Stain | ΔDmin (B)/Last | ΔRun (B) | ΔDmax (R)/Last | ΔRun (R) | Remarks |
|---|---|---|---|---|---|---|---|
| 100 | EDTA | ○ | 0.48 | 0.03 | 1.57 | 0.05 | Comparative example |
| " | 1,3-PDTA | ○ | 0.50 | 0.03 | 1.62 | 0.06 | Comparative example |
| " | I-7 | Δ | 0.64 | 0.04 | 1.75 | 0.06 | Comparative example |
| " | I-23 | X | 0.61 | 0.07 | 1.71 | 0.07 | Comparative example |
| " | I-25 | X | 0.60 | 0.05 | 1.70 | 0.07 | Comparative example |
| " | I-55 | Δ | 0.63 | 0.03 | 1.74 | 0.05 | Comparative example |
| " | II-2 | X | 0.65 | 0.04 | 1.73 | 0.06 | Comparative example |
| " | II-15 | X | 0.66 | 0.03 | 1.75 | 0.07 | Comparative example |
| 101 | EDTA | ○ | 0.53 | 0.03 | 1.60 | 0.06 | Comparative example |
| " | 1,3-PDTA | Δ | 0.55 | 0.04 | 1.65 | 0.06 | Comparative example |
| " | I-7 | ○ | 0.42 | 0.02 | 1.45 | 0.04 | This invention |
| " | I-23 | ○ | 0.45 | 0.03 | 1.51 | 0.05 | This invention |

TABLE 2-continued

| Sample | Chelating agent | Stain | ΔDmin (B)/Last | ΔRun (B) | ΔDmax (R)/Last | ΔRun (R) | Remarks |
|---|---|---|---|---|---|---|---|
| " | I-25 | ○ | 0.44 | 0.03 | 1.53 | 0.05 | This invention |
| " | I-55 | ○ | 0.39 | 0.02 | 1.39 | 0.03 | This invention |
| " | II-2 | ○ | 0.43 | 0.03 | 1.44 | 0.04 | This invention |
| " | II-15 | ○ | 0.41 | 0.02 | 1.43 | 0.04 | This invention |
| 102 | I-7 | ○ | 0.43 | 0.02 | 1.46 | 0.04 | This invention |
| " | I-23 | ○ | 0.47 | 0.03 | 1.51 | 0.05 | This invention |
| " | I-25 | ○ | 0.45 | 0.02 | 1.52 | 0.04 | This invention |
| " | I-55 | ○ | 0.41 | 0.02 | 1.40 | 0.03 | This invention |
| " | II-2 | ○ | 0.44 | 0.03 | 1.45 | 0.04 | This invention |
| " | II-15 | ○ | 0.42 | 0.02 | 1.44 | 0.03 | This invention |

ΔDmin(B)/Last: The change in aging of the yellow minimum density of the last processed part
ΔDmax(R)/Last: The change in aging of the cyan maximum density of the last processed part
Stain:
○(Stain was not observed by visual evaluation)
Δ(Stain was observed at the edge)
X(Stain was observed at the image part)

As is shown in Table 2, in the present invention, it can be understood that the light-sensitive materials after the processing had less stain, and the change in aging of the yellow minimum density and the change in aging of the cyan maximum density, and further the change in aging resulting from the progress of the processing were excellent. In passing, the cyan maximum density before the aging was 2.60.

Example 2

The activator processing and evaluation of Samples were carried out in the same manner as Example 1, except that processing solutions were replace with those mentioned below. Results are shown in Table 3.

TABLE 3

| Chelating agent | Fixing agent | Stain | ΔDmin (B)/Last | ΔRun (B) | ΔDmax (R)/Last | ΔRun (R) | Remarks |
|---|---|---|---|---|---|---|---|
| 1,3-PDTA | ATS | ○ | 0.49 | 0.03 | 1.63 | 0.05 | Comparative example |
| " | A-4 | Δ | 0.51 | 0.03 | 1.65 | 0.05 | Comparative example |
| " | B-3 | Δ | 0.50 | 0.04 | 1.63 | 0.05 | Comparative example |
| " | C-1 | Δ | 0.53 | 0.03 | 1.64 | 0.06 | Comparative example |
| " | D-2 | X | 0.53 | 0.05 | 1.66 | 0.05 | Comparative example |
| " | E-1 | Δ | 0.52 | 0.03 | 1.64 | 0.07 | Comparative example |
| I-55 | ATS | ○ | 0.43 | 0.03 | 1.44 | 0.05 | This invention |

TABLE 3-continued

| Chelating agent | Fixing agent | Stain | ΔDmin (B)/Last | ΔRun (B) | ΔDmax (R)/Last | ΔRun (R) | Remarks |
|---|---|---|---|---|---|---|---|
| " | A-4 | ○ | 0.35 | 0.02 | 1.36 | 0.04 | This invention |
| " | A-10 | ○ | 0.37 | 0.02 | 1.37 | 0.04 | This invention |
| " | A-18 | ○ | 0.38 | 0.03 | 1.39 | 0.05 | This invention |
| " | B-3 | ○ | 0.37 | 0.02 | 1.37 | 0.04 | This invention |
| " | B-4 | ○ | 0.39 | 0.03 | 1.38 | 0.05 | This invention |
| " | B-8 | ○ | 0.37 | 0.03 | 1.38 | 0.04 | This invention |
| " | C-1 | ○ | 0.36 | 0.03 | 1.39 | 0.04 | This invention |
| " | C-5 | ○ | 0.38 | 0.03 | 1.39 | 0.04 | This invention |
| " | D-2 | ○ | 0.31 | 0.02 | 1.33 | 0.03 | This invention |
| " | D-29 | ○ | 0.35 | 0.02 | 1.35 | 0.04 | This invention |
| " | E-1 | ○ | 0.33 | 0.02 | 1.35 | 0.04 | This invention |
| " | E-9 | ○ | 0.38 | 0.03 | 1.36 | 0.04 | This invention |
| II-15 | A-4 | ○ | 0.37 | 0.02 | 1.36 | 0.04 | This invention |
| " | B-3 | ○ | 0.38 | 0.02 | 1.38 | 0.04 | This invention |
| " | C-1 | ○ | 0.37 | 0.03 | 1.39 | 0.04 | This invention |
| " | D-2 | ○ | 0.33 | 0.02 | 1.35 | 0.04 | This invention |
| " | E-1 | ○ | 0.35 | 0.03 | 1.37 | 0.04 | This invention |

ATS: ammounium thiosulfate

| (Activator Solution) | Tank solution | Replenisher |
|---|---|---|
| Water | 800 ml | 800 ml |
| Sodium 5-sulfosalicylate | 20.0 g | 25.0 g |
| Potassium chloride | 10.0 g | 12.0 g |
| Compound (I-52) for use in the present invention | 5.0 g | 8.0 g |
| Water to make | 1,000 ml | 1,000 ml |
| pH (25° C./adjusted by KOH or sulfuric acid) | 12.00 | 12.7 |

| (Bleach-fixing Solution) | Tank solution | Replenisher |
|---|---|---|
| Water | 700 ml | 700 ml |
| Chelating agent described in Table 3 | 0.17 mol | 0.35 mol |
| Iron (III) nitrate nonahydrate | 0.15 mol | 0.33 mol |
| Fixing agent described in Table 3 | 1.5 mol | 3.2 mol |
| Ammonium sulfite | 35.0 g | 80.0 g |
| Ammonium bromide | 10.0 g | 25.0 g |
| Water to make | 1,000 ml | 1,000 ml |
| pH (25° C./adjusted by sulfuric acid or aqueous ammonia) | 6.00 | 5.50 |

| Rinse | Both tank solution and replenisher |
|---|---|
| Citric acid | 5.0 g |
| 5-chrolo-2-methyl-4-isothiazoline-3one | 0.02 g |
| Deionized water (conductivity: 5 μs/cm or below) | 1000 ml |
| pH | 6.0 |

As is shown in Table 3, in the present invention, it can be understood that the light-sensitive materials after the processing had less stain, and the change in aging of the yellow minimum density and the change in aging of the cyan maximum density, and further the change in aging resulting from the progress of the processing were excellent.

Example 3

The processing and evaluation of Samples were conducted in the same manner as Example 2, except that the bleach-fixing solution was replaced with one mentioned below. Results are shown in Table 4.

TABLE 4

| Fixing agent | Concentration of ammonium ion (mol/l) | Concentration of sulfite (mol/l) | Δ D min (B)/Last | Δ D max (R)/Last |
|---|---|---|---|---|
| A-4 | 4.0 | 0.3 | 0.35 | 1.37 |
| " | 1.0 | 0.3 | 0.35 | 1.36 |
| " | 0.5 | 0.3 | 0.34 | 1.36 |
| " | 0.1 | 0.3 | 0.30 | 1.33 |
| " | 0.0 | 0.3 | 0.28 | 1.32 |
| " | 0.0 | 0.1 | 0.28 | 1.32 |
| " | 0.0 | 0.05 | 0.25 | 1.29 |
| " | 0.0 | 0.0 | 0.25 | 1.27 |
| B-3 | 1.0 | 0.1 | 0.38 | 1.34 |
| " | 0.0 | 0.1 | 0.28 | 1.33 |
| " | 0.0 | 0.05 | 0.26 | 1.27 |
| C-1 | 1.0 | 0.1 | 0.37 | 1.36 |
| " | 0.0 | 0.1 | 0.29 | 1.35 |
| " | 0.0 | 0.05 | 0.27 | 1.29 |
| D-2 | 1.0 | 0.1 | 0.32 | 1.33 |
| " | 0.0 | 0.1 | 0.26 | 1.33 |
| " | 0.0 | 0.05 | 0.24 | 1.27 |
| E-1 | 1.0 | 0.1 | 0.34 | 1.34 |
| " | 0.0 | 0.1 | 0.29 | 1.34 |
| " | 0.0 | 0.05 | 0.27 | 1.29 |

| (Bleach-fixing Solution) | Tank solution | Replenisher |
|---|---|---|
| Water | 700 ml | 700 ml |
| Chelating agent (II-15) for use in the present invention | 0.17 mol | 0.35 mol |
| Iron (III) nitrate nonahydrate | 0.15 mol | 0.33 mol |
| Fixing agent (described in Table 4) | 1.5 mol | 3.2 mol |
| Sulfite (described in Table 4) | described in Table 4 | Tank solution × 2 |
| Sodium bromide | 10.0 g | 25.0 g |
| Glycollic acid | 8.0 g | 10.0 g |
| 1,2-benzoisothiazoline-3-one | 0.1 g | 0.3 g |
| Water to make | 1,000 ml | 1,000 ml |
| pH (25° C./adjusted by sulfuric acid, aqueous ammonia or NaOH) | 5.50 | 5.00 |

As is shown in Table 4, in the present invention, it can be understood that both the change in aging of the yellow minimum density and the change in aging of the cyan maximum density of the light-sensitive material after processing, were excellent.

Example 4

Sample (103) was prepared in the same manner as Sample (101) in Example 1, except that the color-forming reducing agent (CH-16) contained in Sample (101) was changed to a color-forming reducing agent (CH-1), in the same molar amount. The processing and evaluation of Samples were conducted in the same manner as Example 2, except that the bleach-fixing solution was replaced with one shown below. As a result, similarly, excellent properties in both the change in aging of the yellow minimum density and the change in aging of the cyan maximum density, were obtained.

| (Bleach-fixing Solution) | Tank solution | Replenisher |
|---|---|---|
| Water | 700 ml | 700 ml |
| Chelating agent (I-55) for use in the present invention | 0.15 mol | 0.30 mol |
| Iron (III) nitrate nonahydrate | 0.12 mol | 0.25 mol |
| Compound (D-1) for use in the present invention | 1.5 mol | 3.2 mol |
| 2,6-pyridinedicarboxylic acid | 2.0 g | 4.0 g |
| Kojic acid | 0.5 g | 1.0 g |
| Sodium bromide | 5.0 g | 10.0 g |
| Water to make | 1,000 ml | 1,000 ml |
| pH (25° C./adjusted by nitric acid or KOH) | 5.00 | 4.00 |

Having described our invention as related to the present embodiments, it is our intention that the invention not be limited by any of the details of the description, unless otherwise specified, but rather be construed broadly within its spirit and scope as set out in the accompanying claims.

What I claim is:

1. A method for processing a silver halide color photographic light-sensitive material, comprising processing a silver halide color photographic light-sensitive material that contains 0.05 to 5 mmol/$m^2$ of a color-forming reducing agent, with an alkaline solution having a pH of 9 to 13 that is substantially free from a color-developing agent, and then processing said silver halide color photographic light-sensitive material with a bleach-fix solution containing 0.05 to 1.0 mol/l of at least one selected from the group consisting of ferric complex salts of a monoamine compound represented by formula (1-a) and ferric complex salts of a compound represented by formula (II):

formula (I-a)

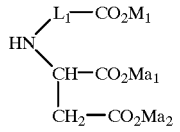

wherein $L_1$ represents an alkylene group and $M_1$, $Ma_1$ and $Ma_2$ each represent a hydrogen atom or a cation;

formula (II)

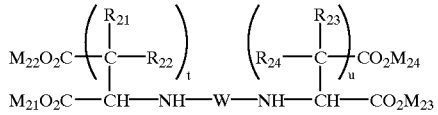

wherein $R_{21}$, $R_{22}$, $R_{23}$, and $R_{24}$ each represent a hydrogen atom, an aliphatic hydrocarbon group, an aryl group, a heterocyclic group, a hydroxyl group, or a carboxyl group; t and u are each 0 or 1; W represents a divalent carbon-containing linking group; and $M_{21}$, $M_{22}$, $M_{23}$, and $M_{24}$ each represent a hydrogen atom or a cation.

2. The method for processing a silver halide color photographic light-sensitive material as claimed in claim 1, wherein a content of the color-developing agent in the said alkaline solution is 0.5 mmol/l or less.

3. The method for processing a silver halide color photographic light-sensitive material as claimed in claim 1, wherein said alkaline solution has a pH value of 9 to 14.

4. The method for processing a silver halide color photographic light-sensitive material as claimed in claim 1, wherein, in formula (II), $R_{21}$, $R_{22}$, $R_{23}$, and $R_{24}$ each represent a hydrogen atom, t and u are each 1, W represents ethylene or trimethylene, and $M_{21}$, $M_{22}$, $M_{23}$, and $M_{24}$ each represent one selected from the group consisting of a hydrogen atom, $Na^+$, $K^+$, and $NH_4^+$.

5. The method for processing a silver halide color photographic light-sensitive material as claimed in claim 1, wherein said monoamine compound represented by formula (I-a) and/or the said compound represented by formula (II) and a ferric salt are added in said bleach-fix solution, to form said ferric complex salt.

6. The method for processing a silver halide color photographic light-sensitive material as claimed in claim 1, wherein a concentration of the ferric complex salt of said compound represented by formula (I-a) or (II) in said bleach-fix solution is 0.003 to 3.00 mol/l.

7. The method for processing a silver halide color photographic light-sensitive material as claimed in claim 1, wherein said bleach-fix solution contains at least one selected from compounds represented by one of formulae (A) to (E):

formula (A)

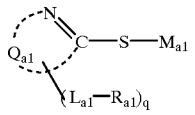

wherein $Q_{a1}$ represents a group of non-metal atoms required to form a 5- or 6-membered heterocycle, which may be condensed to a carboaromatic ring or a heteroaromatic ring; $L_{a1}$ represents a single bond, a divalent aliphatic group, a divalent aromatic hydrocarbon group, a divalent heterocyclic group, or a linking group formed by these groups in combination; $R_{a1}$ represents a carboxylic acid or its salt, a sulfonic acid or its salt, a phosphonic acid or its salt, an amino group, or an ammonium salt; q is an integer of 1 to 3, and $M_{a1}$ represents a hydrogen atom or a cation;

formula (B)

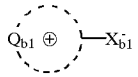

wherein $Q_{b1}$ represents a 5- or 6-membered meso-ionic ring composed of carbon atoms, nitrogen atoms, oxygen atoms, sulfur atoms, or selenium atoms; and $X_{b1}^-$ represents $—O^-$, $—S^-$, or $—N^-R_{b1}$, in which $R_{b1}$ represents an aliphatic group, an aromatic hydrocarbon group, or a heterocyclic group;

$$L_{C1}—(A_{C1}—L_{C2})_r—A_{C2}—L_{C3}$$ formula (C)

wherein $L_{C1}$ and $L_{C3}$, which are the same or different, each represent an aliphatic group, an aromatic hydrocarbon group, or a heterocyclic group; $L_{C2}$ represents a divalent aliphatic group, a divalent aromatic hydrocarbon group, a divalent heterocyclic linking group, or a linking group formed by these in combination; $A_{C1}$ and $A_{C2}$ each represent —S—, —O—, $—NR_{C20}—$, —CO—, $—SO_2—$, or a group formed by these in combination; and r is an integer of 1 to 10, with the proviso that at least one of $L_{C1}$ and $L_{C3}$ is substituted by $—SO_3M_{C1}$, $—PO_3M_{C2}M_{C3}$, $—NR_{C1}(R_{C2})$, $—N^+R_{C3}(R_{C4})(R_{C5}).X_{C1}^-$, $—SO_2NR_{C6}(R_{C7})$, $—NR_{C8}SO_2R_{C9}$, $—CONR_{C10}(R_{C11})$, $—NR_{C12}COR_{C13}$, $—SO_2R_{14}$, $—PO(—NR_{C15}(R_{C16}))_2$, $—NR_{C17}CONR_{C18}(R_{C19})$, $—COOM_{C4}$, or a heterocyclic group, in which $M_{C1}$, $M_{C2}$, $M_{C3}$, and $M_{C4}$, which are the same or different, each represent a hydrogen atom or a counter cation, $R_{C1}$ to $R_{C20}$, which are the same or different, each represent a hydrogen atom, an aliphatic group, or an aromatic hydrocarbon group, and $X_{C1}^-$ represents a counter anion, and with the proviso that at least one of $A_{C1}$ and $A_{C2}$ represents —S—;

formula (D)

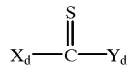

wherein $X_d$ and $Y_d$ each represent an aliphatic group, an aromatic hydrocarbon group, a heterocyclic group, $—N(R_{d1})R_{d2}$, $—N(R_{d3})N(R_{d4})R_{d5}$, $—OR_{d6}$, or $—SR_{d7}$; $X_d$ and $Y_d$ may form a ring but are not enolized, in which $R_{d1}$, $R_{d2}$, $R_{d3}$, $R_{d4}$, and $R_{d5}$ each represent a hydrogen atom, an aliphatic group, an aromatic hydrocarbon group, or a heterocyclic group, and in which $R_{d6}$ and $R_{d7}$ each represent a hydrogen atom, a cation, an aliphatic group, an aromatic hydrocarbon group, or a heterocyclic group, with the proviso that at least one of $X_d$ and $Y_d$ is substituted by at least one selected from the group consisting of a carboxylic acid or its salt, a sulfonic acid or its salt, a phosphonic acid or its salt, an amino group, an ammonium group, and a hydroxyl group;

formula (E)

$$RSO_2SM$$

wherein R represents an aliphatic group, an aryl group, or a heterocyclic group, and M represents a hydrogen atom or a cation.

8. The method for processing a silver halide color photographic light-sensitive material as claimed in claim 7, wherein the compound represented by formula (A) is represented by formula (A-1):

formula (A-1)

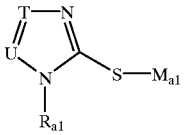

wherein $M_{a1}$ and $R_{a1}$ have the same meanings as those defined in formula (A); T and U each represent $C—R_{a2}$ or N, in which $R_{a2}$ represents a hydrogen atom, a halogen atom, a hydroxyl group, a nitro group, an alkyl group, an alkenyl group, an aralkyl group, an aryl group, a carbonamido group, a sulfonamido group, a ureido group, or a group represented by $R_{a1}$; and when $R_{a2}$ represents the group represented by $R_{a1}$, $R_{a1}$ and $R_{a2}$ are the same or different.

9. The method for processing a silver halide color photographic light-sensitive material as claimed in claim 7, wherein the compound represented by formula (B) is represented by formula (B-1):

formula (B-1)

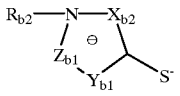

wherein $X_{b2}$ represents N or C—$R_{b3}$, $Y_{b1}$ represents O, S, N, or N—$R_{b4}$, and $Z_{b1}$ represents N, N—$R_{b5}$, or C—$R_{b6}$, in which $R_{b2}$, $R_{b3}$, $R_{b4}$, $R_{b5}$, and $R_{b6}$ each represent an aliphatic group, an aromatic group, a heterocyclic group, an amino group, an acylamino group, a sulfonamido group, a ureido group, a sulfamoylamino group, an acyl group, or a carbamoyl group, and in which $R_{b3}$ and $R_{b6}$ each can be a hydrogen atom, and $R_{b2}$ and $R_{b3}$, $R_{b2}$ and $R_{b5}$, $R_{b2}$ and $R_{b6}$, $R_{b4}$ and $R_{b5}$, and $R_{b4}$ and $R_{b6}$ may form a ring.

10. The method for processing a silver halide color photographic light-sensitive material as claimed in claim 7, wherein, in formula (D), $X_d$ and $Y_d$ each represent an alkyl group having 1 to 6 carbon atoms, —N($R_{d1}$)$R_{d2}$ having 0 to 6 carbon atoms, —N($R_{d3}$)N($R_{d4}$)$R_{d5}$ having 0 to 6 carbon atoms, or —O$R_{d6}$ having 0 to 6 carbon atoms, each of which is substituted by at least one or two groups selected from the group consisting of carboxylic acids or their salts, and sulfonic acids or their salts, in which $R_{d1}$, $R_{d2}$, $R_{d3}$, $R_{d4}$, $R_{d5}$, and $R_{d6}$ each represent a hydrogen atom or an alkyl group.

11. The method for processing a silver halide color photographic light-sensitive material as claimed in claim 7, wherein an amount of the compound represented by one of formulae (A) to (E) to be added in the said bleach-fix solution is $1\times10^{-5}$ to 10 mol/l.

12. The method for processing a silver halide color photographic light-sensitive material as claimed in claim 1, wherein an ammonium ion concentration of said bleach-fix solution is 0 to 0.1 mol/liter or less.

13. The method for processing a silver halide color photographic light-sensitive material as claimed in claim 1, wherein a sulfite concentration of said bleach-fix solution is 0 to 0.05 mol/liter or less.

14. The method for processing a silver halide color photographic light-sensitive material as claimed in claim 1, wherein said bleach-fix solution contains at least one compound represented by formula (a) or (b):

formula (a)

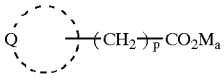

wherein Q represents a group of non-metal atoms required to form a heterocyclic ring, p is 0 or 1, and $M_a$ represents a hydrogen atom or a cation.

formula (b)

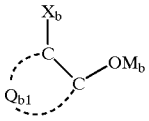

wherein $Q_b$ represents a group of non-metal atoms required to form a ring structure, $X_b$ represents an oxygen atom, a sulfur atom, or N—$R_b$, in which $R_b$ represents a hydrogen atom, an aliphatic hydrocarbon group, an aryl group, or a heterocyclic group, and $M_b$ represents a hydrogen atom or a cation.

15. The method for processing a silver halide color photographic light-sensitive material as claimed in claim 1, wherein at least one of said color-forming reducing agent contained in said silver halide color photographic light-sensitive material is represented by formula (CH):

$R^{11}$—NHNH—X—$R^{12}$ formula (CH)

wherein $R^{11}$ represents an aryl group or a heterocyclic group; $R^{12}$ represents an alkyl group, an alkenyl group, an alkynyl group, an aryl group, or a heterocyclic group; and X represents —$SO_2$—, —CO—, —COCO—, —CO—O—, —CO—N($R^{13}$)—, —COCO—O—, —COCO—N($R^{13}$)— or —$SO_2$N($R^{13}$)—, in which $R^{13}$ represents a hydrogen atom or a group represented by $R^{12}$ that is defined above.

16. The method for processing a silver halide color photographic light-sensitive material as claimed in claim 15, wherein said color-forming reducing agent represented by formula (CH) is represented by formula (CH2) or (CH3):

formula (CH2)

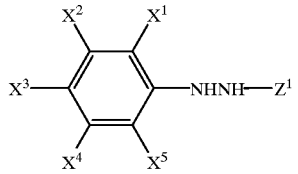

formula (CH3)

$R^3$—NHNH—$Z^2$ wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

17. The method for processing a silver halide color photographic light-sensitive material as claimed in claim 16, wherein said color-forming reducing agent represented by formula (CH2) or (CH3) is represented by formula (CH4) or (CH5), respectively:

formula (CH4)

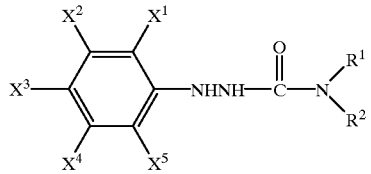

formula (CH5)

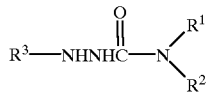

wherein $R^1$ and $R^2$ each represent a hydrogen atom or a substituent; $X^1$, $X^2$, $X^3$, $X^4$, and $X^5$ each represent a hydrogen atom or a substituent, provided that the sum of the Hammett substituent constant σp values of $X^1$, $X^3$, and $X^5$ and the Hammett substituent constant σm values of $X^2$ and $X^4$ is 0.80 or more but 3.80 or below; and $R^3$ represents a heterocyclic group.

18. The method for processing a silver halide color photographic light-sensitive material as claimed in claim 17, wherein said color-forming reducing agent represented by formula (CH4) or (CH5) is represented by formula (CH6) or (CH7), respectively:

formula (CH6)

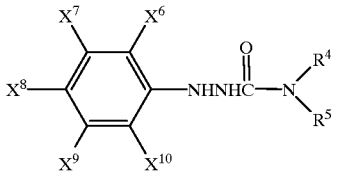

-continued formula (CH7)

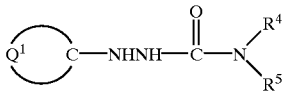

wherein $R^4$ and $R^5$ each represent a hydrogen atom or a substituent; and $X^6$, $X^7$, $X^8$, $X^9$, and $X^{10}$ each represent a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the sum of the Hammett substituent constant σp values of $X^6$, $X^8$, and $X^{10}$ and the Hammett substituent constant σm values of $X^7$ and $X^9$ is 1.20 or more but 3.80 or below. $Q^1$ represents a group of nonmetal atoms required to form a nitrogen-containing 5-membered to 8-membered heterocyclic ring together with the C.

* * * * *